US011342660B2

(12) United States Patent
Jong et al.

(10) Patent No.: US 11,342,660 B2
(45) Date of Patent: May 24, 2022

(54) ELECTRONIC DEVICE INCLUDING ANTENNA

(71) Applicant: Samsung Electronics Co., Ltd., Suwon-si (KR)

(72) Inventors: Jehun Jong, Suwon-si (KR); Dongyeon Kim, Suwon-si (KR); Hosaeng Kim, Suwon-si (KR); Seongjin Park, Suwon-si (KR); Sumin Yun, Suwon-si (KR); Myunghun Jeong, Suwon-si (KR); Jaehoon Jo, Suwon-si (KR); Jinwoo Jung, Suwon-si (KR); Jaebong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 64 days.

(21) Appl. No.: 16/870,160

(22) Filed: May 8, 2020

(65) Prior Publication Data

US 2020/0358173 A1 Nov. 12, 2020

(30) Foreign Application Priority Data

May 10, 2019 (KR) ..... 10-2019-0054947

(51) Int. Cl.
*H01Q 15/02* (2006.01)
*H01Q 1/42* (2006.01)
(Continued)

(52) U.S. Cl.
CPC ..... *H01Q 1/422* (2013.01); *H01Q 3/2617* (2013.01); *H01Q 9/0407* (2013.01); *H01Q 21/065* (2013.01)

(58) Field of Classification Search
CPC .... H01Q 1/422; H01Q 3/2617; H01Q 9/0407; H01Q 21/065
See application file for complete search history.

(56) References Cited

U.S. PATENT DOCUMENTS

2010/0214178 A1 8/2010 Toyao et al.
2012/0032865 A1 2/2012 Toyao et al.
(Continued)

FOREIGN PATENT DOCUMENTS

EP 3 429 028 A1 1/2019
JP 2005-130532 A 5/2005
(Continued)

OTHER PUBLICATIONS

International Search Report dated Aug. 14, 2020, issued in International Application No. PCT/KR2020/006124.
(Continued)

*Primary Examiner* — Dieu Hien T Duong
(74) *Attorney, Agent, or Firm* — Jefferson IP Law, LLP

(57) ABSTRACT

An electronic device is provided. The electronic device includes a housing including a front plate, a rear plate facing away from the front plate, and a side member attached to the front plate or integrated with the rear plate, and surrounding a space between the front and rear plates, an antenna device disposed inside the housing and including stacked first to fourth layers, and a wireless communication circuit electrically coupled to the antenna element. The first layer includes a ground, the second layer includes at least one antenna element and a dielectric adjacent to the at least one antenna element, the third layer includes a first area with a first periodic structure of first conductive cells and a second area at least partially surrounded by the first area, and the fourth layer includes a third area with a second periodic structure of second conductive cells and a fourth area at least partially surrounded by the third area.

19 Claims, 39 Drawing Sheets

(51) Int. Cl.

| | |
|---|---|
| ***H01Q 3/26*** | (2006.01) |
| ***H01Q 9/04*** | (2006.01) |
| ***H01Q 21/06*** | (2006.01) |

(56) References Cited

U.S. PATENT DOCUMENTS

| | | | | |
|---|---|---|---|---|
| 2012/0299797 | A1 | 11/2012 | Murdock et al. | |
| 2012/0319908 | A1 | 12/2012 | Tsutsumi et al. | |
| 2017/0126046 | A1 | 5/2017 | Contopanagos | |
| 2019/0020100 | A1 | 1/2019 | Jong et al. | |
| 2019/0020110 | A1* | 1/2019 | Paulotto ..... | H01Q 19/005 |
| 2019/0098750 | A1* | 3/2019 | Woo ..... | H05K 1/0236 |
| 2019/0131701 | A1 | 5/2019 | Watanabe et al. | |

FOREIGN PATENT DOCUMENTS

| | | | |
|---|---|---|---|
| JP | 2010-199881 | A | 9/2010 |
| JP | 5533860 | B2 | 6/2014 |
| KR | 10-2008-0014304 | A | 2/2008 |
| KR | 10-2017-0049443 | A | 5/2017 |
| KR | 10-2019-0036438 | A | 4/2019 |
| WO | 2019/066924 | A1 | 4/2019 |

OTHER PUBLICATIONS

European Search Report dated Oct. 5, 2020, issued in European Application No. 20173985.1.
European Office Action dated Sep. 8, 2021, issued in European Application No. 20173985.1.

* cited by examiner

ELECTRONIC DEVICE INCLUDING ANTENNA

CROSS-REFERENCE TO RELATED APPLICATION(S)

This application is based on and claims priority under 35 U.S.C. § 119(a) of a Korean patent application number 10-2019-0054947, filed on May 10, 2019, in the Korean Intellectual Property Office, the disclosure of which is incorporated by reference herein in its entirety.

BACKGROUND

1. Field

The disclosure relates to an electronic device and a structure of an antenna array included in the electronic device. More particularly, the disclosure relates to an electronic device including an antenna array for increasing a bandwidth, a gain, and a radiation angle and reducing coupling between antennas.

2. Description of Related Art

In order to provide stable quality of service in a commercialized wireless communication network environment, an antenna device in an electronic device should satisfy a high gain and wide beam coverage. Recently, with the rapid increase in mobile traffic, millimeter wave communication in a frequency band at or above tens of GHz (for example, a high band frequency at or above 28 GHz) has been used. In the frequency band at or above tens of GHz, the wavelength of a beam emitted from an antenna is short, thus enabling miniaturization and/or lightening of an antenna, an antenna structure, and a device including the antenna. However, because the millimeter wave beam has high linearity and directionality of radio waves, it may increase propagation path loss and degrade propagation characteristics depending on the installation environment of the antenna.

When a patch antenna array is adopted for transmission and reception of a millimeter wave beam, performance may be degraded due to a narrow bandwidth, a low gain, a narrow radiation angle, and interference between patch antennas.

When an antenna array in which antennas and a plurality of conductive cells arranged around the antennas forming a periodic structure is used, it is possible to extend a bandwidth to a certain degree, but with difficulty in fabricating the antenna structure in a small size.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device including an antenna array for increasing a bandwidth, a gain, and a radiation angle and reducing coupling between antennas.

Additional aspects will be set forth in part in the description which follows and, in part, will be apparent from the description, or may be learned by practice of the presented embodiments of the disclosure.

In accordance with an aspect of the disclosure, an electronic device is provided. The electronic device includes a housing including a front plate, a rear plate facing away from the front plate, and a side member attached to the front plate or integrally formed with the rear plate, and surrounding a space between the front plate and the rear plate, an antenna device disposed inside the housing and including a first layer, a second layer, a third layer, and a fourth layer formed in a stacked structure, wherein the first layer includes a ground, the second layer includes at least one antenna element and a dielectric disposed adjacent to the at least one antenna element, the third layer includes a first area in which a first periodic structure including a plurality of first conductive cells is disposed and a second area at least partially surrounded by the first area, and the fourth layer includes a third area in which a second periodic structure including a plurality of second conductive cells is disposed and a fourth area at least partially surrounded by the third area, and a wireless communication circuit electrically coupled to the at least one antenna element.

In accordance with another aspect of the disclosure, an electronic device is provided. The electronic device includes an antenna device including a first layer including a ground, a second layer including at least one antenna element and a dielectric disposed adjacent to the at least one antenna element, a third layer including a first area in which a first periodic structure including a plurality of first conductive cells is disposed and a second area at least partially surrounded by the first area, and a fourth layer including a third area in which a second periodic structure including a plurality of second conductive cells is disposed and a fourth area at least partially surrounded by the third area, and a wireless communication circuit electrically coupled to the at least one antenna element, wherein, when viewed from above the antenna device, at least a part of the first periodic structure overlaps with at least a part of the second periodic structure.

In accordance with another aspect of the disclosure, an electronic device is provided. The electronic device includes an antenna device including a first layer including a ground, a second layer including a first antenna element and a dielectric disposed adjacent to at least a part of the first antenna element, a third layer in which a first periodic structure including a plurality of first conductive cells is disposed; a fourth layer in which a second periodic structure including a plurality of second conductive cells is disposed, and a fifth layer including a second antenna element and a dielectric disposed adjacent to at least a part of the second antenna element, and a wireless communication circuit electrically coupled to each of the first antenna element and the second antenna element and configured to transmit and/or receive signals in different frequency bands simultaneously or at different time points.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
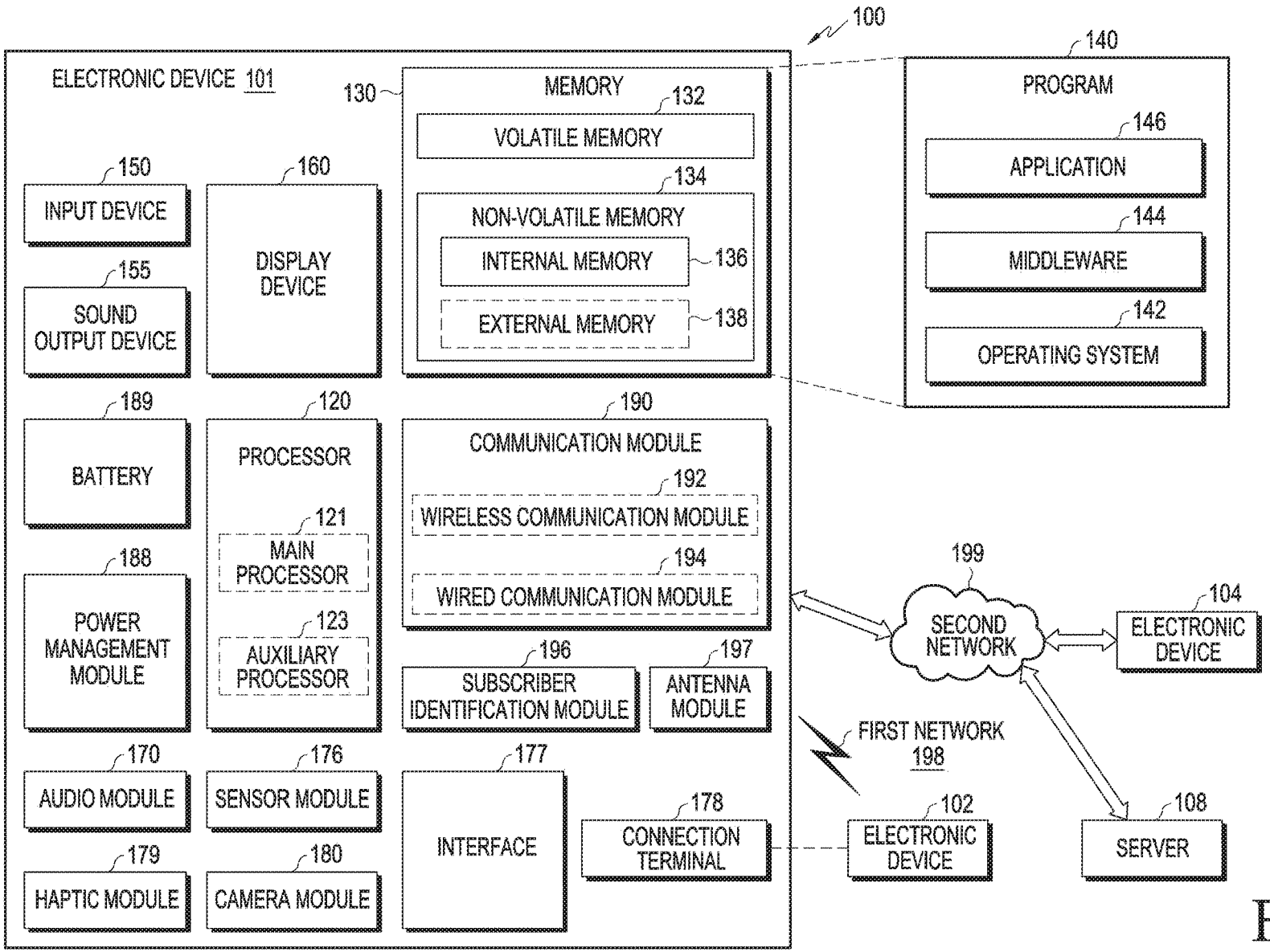
FIG. 1 is a block diagram of an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (for example, a short-range wireless communication network), or an electronic device 104 or a server 108 via a second network 199 (for example, a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (for example, the display device 160 or the camera module 180) of the components may be omitted from the electronic device 101, or one or more other components may be added in the electronic device 101. In some embodiments, some of the components may be implemented as single integrated circuitry. For example, the sensor module 176 (for example, a fingerprint sensor, an iris sensor, or an illuminance sensor) may be implemented as embedded in the display device 160 (for example, a display).

The processor 120 may execute, for example, software (for example, a program 140) to control at least one other component (for example, a hardware or software component) of the electronic device 101 coupled with the processor 120, and may perform various data processing or computation. According to one embodiment, as at least part of the data processing or computation, the processor 120 may load a command or data received from another component (for example, the sensor module 176 or the communication module 190) in volatile memory 132, process the command or the data stored in the volatile memory 132, and store resulting data in non-volatile memory 134. According to an embodiment, the processor 120 may include a main processor 121 (for example, a central processing unit (CPU) or an application processor (AP)), and an auxiliary processor 123 (for example, a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (for example, the display device 160, the sensor module 176, or the communication module 190) among the components of the electronic device 101, instead of the main processor 121 while the main processor 121 is in an inactive (for example, sleep) state, or together with the main processor 121 while the main processor 121 is in an active state (for example, executing an application). According to an embodiment, the auxiliary processor 123 (for example, an image signal processor or a communication processor) may be implemented as part of another component (for example, the camera module 180 or the communication module 190) functionally related to the auxiliary processor 123.

The memory 130 may store various data used by at least one component (for example, the processor 120 or the sensor module 176) of the electronic device 101. The various data may include, for example, software (for example, the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (for example, the processor 120) of the electronic device 101, from the outside (for example, a user) of the electronic device 101. The input device 150 may include, for example, a microphone, a mouse, a keyboard, or a digital pen (for example, a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (for example, a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (for example, a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (for example, an electronic device 102) directly (for example, wiredly) or wirelessly coupled with the electronic device 101.

The sensor module 176 may detect an operational state (for example, power or temperature) of the electronic device 101 or an environmental state (for example, a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (for example, the electronic device 102) directly (for example, wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (for example, the electronic device 102). According to an embodiment, the connecting terminal 178 may include, for example, a HDMI connector, a USB connector, a SD card connector, or an audio connector (for example, a headphone connector).

The haptic module 179 may convert an electrical signal into a mechanical stimulus (for example, a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (for example, wired) communication channel or a wireless communication channel between the electronic device 101 and the external electronic device (for example, the electronic device 102, the electronic device 104, or the server 108) and performing communication via the established communication channel. The communication module 190 may include one or more communication processors that are operable independently from the processor 120 (for example, the application processor (AP)) and supports a direct (for example, wired) communication or a wireless communication. According to an embodiment, the communication module 190 may include a wireless communication module 192 (for example, a cellular communication module, a short-range wireless communication module, or a global navigation satellite system (GNSS) communication module) or a wired communication module 194 (for example, a local area network (LAN) communication module or a power line communication (PLC) module). A corresponding one of these communication modules may communicate with the external electronic device via the first network 198 (for example, a short-range communication network, such as Bluetooth™ wireless-fidelity (Wi-Fi) direct, or infrared data association (IrDA)) or the second network 199 (for example, a long-range communication network, such as a cellular network, the Internet, or a computer network (for example, local area network (LAN) or wide area network (WAN)). These various types of communication modules may be implemented as a single component (for example, a single chip), or may be implemented as multi components (for example, multi chips) separate from each other. The wireless communication module 192 may identify and authenticate the electronic device 101 in a communication network, such as the first network 198 or the second network 199, using subscriber information (for example, international mobile subscriber identity (IMSI)) stored in the subscriber identification module 196.

The antenna module 197 may transmit or receive a signal or power to or from the outside (for example, the external electronic device) of the electronic device 101. According to an embodiment, the antenna module 197 may include an antenna including a radiating element composed of a conductive material or a conductive pattern formed in or on a substrate (for example, printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (for example, the wireless communication module 192) from the plurality of antennas. The signal or the power may then be transmitted or received between the communication module 190 and the external electronic device via the selected at least one antenna. According to an embodiment, another component (for example, a radio frequency integrated circuit (RFIC)) other than the radiating element may be additionally formed as part of the antenna module 197.

At least some of the above-described components may be coupled mutually and communicate signals (for example, commands or data) therebetween via an inter-peripheral communication scheme (for example, a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
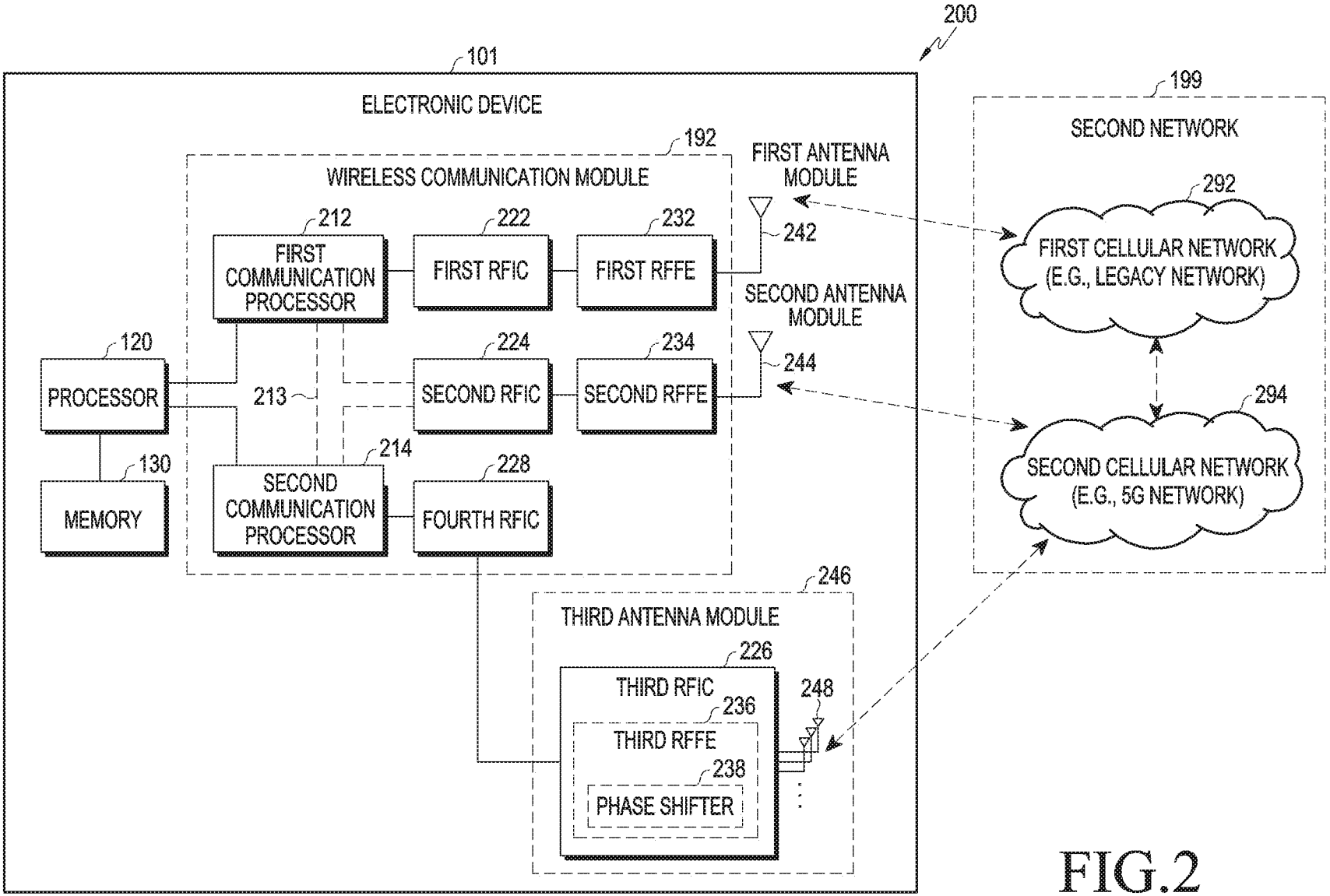
FIG. 2 is a block diagram of an electronic device in a network environment including a plurality of cellular networks according to an embodiment of the disclosure.

FIG. 2 is a block diagram 200 of an electronic device in a network environment including a plurality of cellular networks according to an embodiment of the disclosure.

Referring to FIG. 2, an electronic device 101 may include a first communication processor 212, a second communication processor 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include the processor 120 and the memory 130. The second network 199 may include a first cellular network 292 and a second cellular network 294. According to another embodiment of the disclosure, the electronic device 101 may further include at least one of the components illustrated in FIG. 1, and the second network 199 may further include at least one other network. According to an embodiment of the disclosure, the first communication processor 212, the second communication processor 214, the first RFIC 222, the second RFIC 224, the fourth RFIC 228, the first RFFE 232, and the second RFFE 234 may form at least a part of the wireless communication module 192. According to another embodiment of the disclosure, the fourth RFIC 228 may be omitted or included as a part of the third RFIC 226.

The first communication processor 212 may establish a communication channel 213 in a band to be used for wireless communication with the first cellular network 292 and support legacy network communication through the established communication channel. According to various embodiments of the disclosure, the first cellular network 292 may be a legacy network including a $2^{nd}$ generation (2G), $3^{rd}$ generation (3G), $4^{th}$ generation (4G), or long term evolution (LTE) network. The second communication processor 214 may establish a communication channel corresponding to a predetermined band (for example, about 6 GHz to about 60 GHz) out of a band to be used for wireless communication with the second cellular network 294 and support $5^{th}$ generation (5G) network communication through the established communication channel. According to various embodiments of the disclosure, the second cellular network 294 may be a 5G network defined by the $3^{rd}$ generation partnership project (3GPP). Additionally, according to an embodiment of the disclosure, the first communication processor 212 or the second communication processor 214 may establish a communication channel corresponding to another predetermined band (for example, about 6 GHz or less) out of the band to be used for wireless communication with the second cellular network 294 and support 5G network communication through the established communication channel. According to an embodiment of the disclosure, the first communication processor 212 and the second communication processor 21 may be implemented on a single chip or in a single package. According to various embodiments of the disclosure, the first communication processor 212 or the second communication processor 214 may be formed together with the processor 120, the auxiliary processor 123, or the communication module 190 on a single chip or in a single package.

For transmission, the first RFIC 222 may convert a baseband signal generated by the first communication processor 212 to an RF signal at about 700 MHz to about 3 GHz used in the first cellular network 292 (for example, the legacy network). For reception, an RF signal may be obtained from the first cellular network 292 (for example, the legacy network) through an antenna (for example, the first antenna module 242) and pre-processed in an RFFE (for example, the first RFFE 232). The first RFIC 222 may convert the pre-processed RF signal to a baseband signal so that the baseband signal may be processed in the first communication processor 212.

For transmission, the second RFIC 224 may convert a baseband signal generated by the first communication processor 212 or the second communication processor 214 to an RF signal (referred to as a 5G Sub6 RF signal) in a Sub6 band (for example, about 6 GHz or less) used in the second cellular network 294 (for example, the 5G network). For reception, a 5G Sub6 RF signal may be obtained from the second cellular network 294 (for example, the 5G network)

through an antenna (for example, the second antenna module 244) and pre-processed in an RFFE (for example, the second RFFE 234). The second RFIC 224 may convert the pre-processed 5G Sub6 RF signal to a baseband signal so that the baseband signal may be processed in a corresponding one of the first communication processor 212 and the second communication processor 214.

For transmission, the third RFIC 226 may convert a baseband signal generated by the second communication processor 214 to an RF signal in a 5G Above6 band (for example, about 6 GHz to about 60 GHz) to be used in the second cellular network 294 (for example, the 5G network). For reception, a 5G Above6 RF signal may be obtained from the second cellular network 294 (for example, the 5G network) through an antenna (for example, the antenna 248) and pre-processed in the third RFFE 236. The third RFIC 226 may convert the pre-processed 5G Above6 RF signal to a baseband signal so that the baseband signal may be processed in the second communication processor 214. According to an embodiment of the disclosure, the third RFFE 236 may be formed as a part of the third RFIC 226.

According to an embodiment of the disclosure, the electronic device 101 may include the fourth RFIC 228 separately from or as a part of the third RFIC 226. In this case, the fourth RFIC 228 may convert a baseband signal generated by the second communication processor 214 to an RF signal in an intermediate frequency (IF) band (for example, about 9 GHz to about 11 GHz) (hereinafter, referred to as an IF signal), and provide the IF signal to the third RFIC 226. The third RFIC 226 may convert the IF signal to a 5G Above6 RF signal. During reception, a 5G Above6 RF signal may be received from the second cellular network 294 (for example, the 5G network) through an antenna (for example, the antenna 248) and converted to an IF signal by the third RFIC 226. The fourth RFIC 228 may convert the IF signal to a baseband signal so that the baseband signal may be processed in the second communication processor 214.

According to an embodiment of the disclosure, the first RFIC 222 and the second RFIC 224 may be implemented as at least a part of a single chip or a single package. According to an embodiment of the disclosure, the first RFFE 232 and the second RFFE 234 may be implemented as at least a part of a single chip or a single package. According to an embodiment of the disclosure, at least one of the first antenna module 242 or the second antenna module 244 may be omitted or combined with the other antenna module to process RF signals in a plurality of corresponding bands.

According to an embodiment of the disclosure, the third RFIC 226 and the antenna 248 may be arranged on the same substrate to form a third antenna module 246. For example, the wireless communication module 192 or the processor 120 may be arranged on a first substrate (for example, a main PCB). In this case, the third RFIC 226 may be arranged in a partial area (for example, on the bottom surface) of a second substrate (for example, a sub-PCB) other than the first substrate and the antenna 248 may be arranged in another partial area (for example, on the top surface) of the second substrate, to form the third antenna module 246. As the third RFIC 226 and the antenna 248 are arranged on the same substrate, it is possible to reduce the length of a transmission line between the third RFIC 226 and the antenna 248. This may reduce, for example, loss (for example, attenuation) of a signal in a high frequency band (for example, about 6 GHz to about 60 GHz) used for 5G network communication, on the transmission line. Therefore, the electronic device 101 may increase the quality or speed of communication with the second cellular network 294 (for example, the 5G network).

According to an embodiment of the disclosure, the antenna 248 may be formed to be an antenna array including a plurality of antenna elements which may be used for beamforming. In this case, for example, the third RFIC 226 may include a plurality of phase shifters 238 corresponding to the plurality of antenna elements, as a part of the third RFFE 236. During transmission, each of the phase shifters 238 may change the phase of a 5G Above6 RF signal to be transmitted to the outside of the electronic device 101 (for example, a base station (BS) in the 5G network) through an antenna element corresponding to the phase shifter 238. During reception, each of the phase shifters 238 may change the phase of a 5G Above6 RF signal received from the outside through an antenna element corresponding to the phase shifter 238 to the same or substantially same phase. This enables transmission or reception through beamforming between the electronic device 101 and the outside.

The second cellular network 294 (for example, the 5G network) may be operated independently of the first cellular network 292 (for example, the legacy network) (for example, stand-alone (SA)) or in connection to the first cellular network 292 (for example, the legacy network) (for example, non-stand-alone (NSA)). For example, the 5G network may include only an access network (for example, a fifth generation (5G) radio access network (RAN) or next generation RAN (NG RAN)) without a core network (for example, a next generation core (NGC)). In this case, after accessing the access network of the 5G network, the electronic device 101 may access an external network (for example, the Internet) under the control of the core network (for example, evolved packet core (EPC)) of the legacy network. Protocol information for communication with the legacy network (for example, long term evolution (LTE) protocol information) or protocol information for communication with the 5G network (for example, new radio (NR) protocol information) may be stored in the memory 230 and accessed by another component (for example, the processor 120, the first communication processor 212, or the second communication processor 214).

Figure 3A:
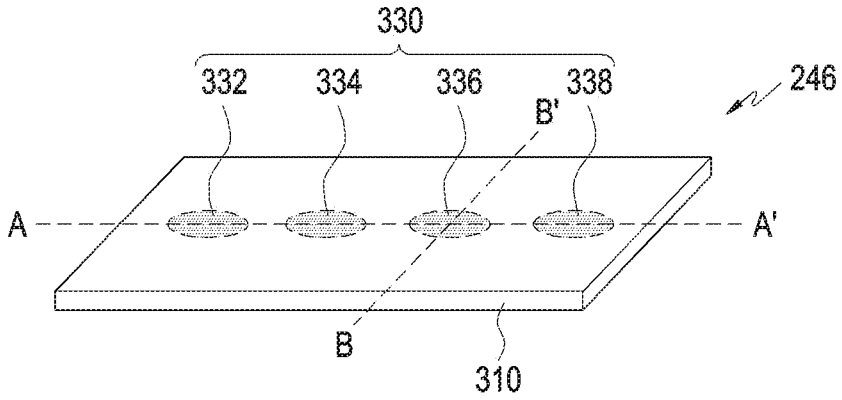
FIGS. 3A, 3B, and 3C illustrate a structure of an antenna module described with reference to FIG. 2 according to various embodiments of the disclosure.
Figure 3B:
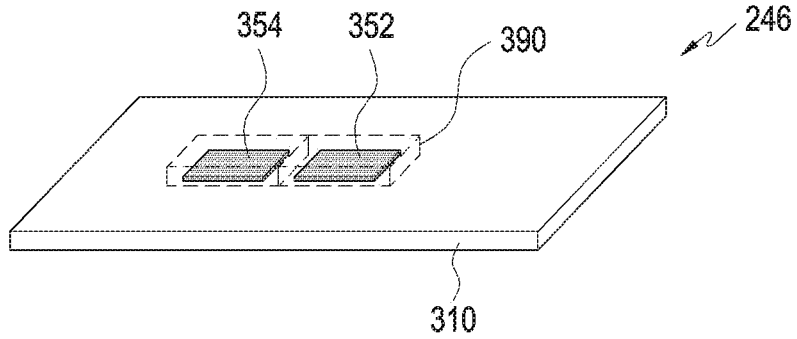
Figure 3C:
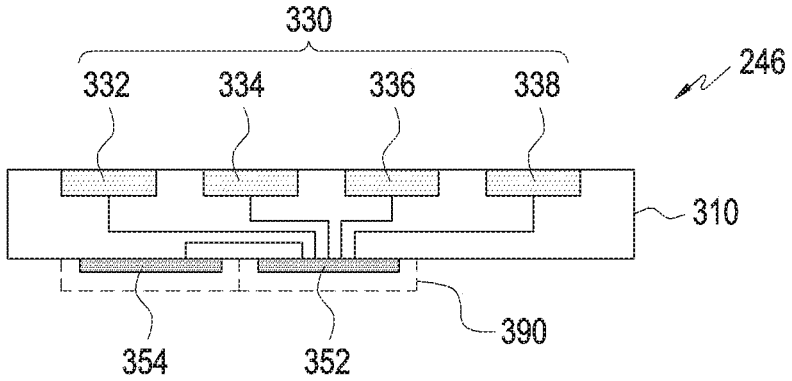

FIGS. 3A, 3B and 3C illustrate a structure of an antenna module described with reference to FIG. 2 according to various embodiments of the disclosure.

FIG. 3A illustrates a perspective view of the third antenna module 246 viewed from one side thereof, and FIG. 3B illustrates a perspective view of the third antenna module 246 viewed from the other side thereof. FIG. 3C illustrates a sectional view of the third antenna module 246, taken along line A-A'.

Referring to FIGS. 3A to 3C, in an embodiment of the disclosure, the third antenna module 246 may include a printed circuit board (PCB) 310, an antenna array 330, an RFIC 352, and a PMIC 354. Optionally, the third antenna module 246 may further include a shielding member 390. In other embodiments of the disclosure, at least one of the afore-mentioned components may be omitted, or at least two of the components may be integrated.

According to various embodiments of the disclosure, the PCB 310 may include a plurality of conductive layers, and a plurality of non-conductive layers stacked alternately with the conductive layers. The PCB 310 may provide electrical connectivity between various electronic components disposed on and/or outside the PCB 310, using wires and conductive vias formed on the conductive layers.

According to various embodiments of the disclosure, the antenna array 330 may include a plurality of antenna elements 332, 334, 336, and 338 arranged to form directional beams. The antenna elements 332, 334, 336, and 338 may be formed on a first surface of the PCB 310, as illustrated in FIGS. 3A to 3C. According to another embodiment of the disclosure, the antenna array 330 may be formed inside the PCB 310. According to embodiments of the disclosure, the antenna array 330 may include a plurality of antenna arrays of the same or different shapes or types (for example, dipole antenna arrays and/or patch antenna arrays).

According to various embodiments of the disclosure, the RFIC 352 may be disposed in another area (for example, on a second surface of the PCB 310 opposite to the first surface thereof), apart from the antenna array 330. The RFIC 352 is configured to process a signal of a selected frequency band, which is transmitted/received through the antenna array 330. According to an embodiment of the disclosure, the RFIC 352 may convert a baseband signal obtained from a communication processor (not shown) into an RF signal of a predetermined band during transmission. During reception, the RFIC 352 may convert an RF signal received through the antenna array 330 into a baseband signal and transmit the baseband signal to the communication processor.

According to another embodiment of the disclosure, the RFIC 352 may upconvert an IF signal (for example, at about 9 GHz to about 11 GHz) obtained from an intermediate frequency integrated circuit (IFIC) to a radio frequency (RF) signal of a selected band during transmission. During reception, the RFIC 352 may downconvert an RF signal obtained through the antenna array 330 into an IF signal and transmit the converted IF signal to the IFIC.

According to various embodiments of the disclosure, the PMIC 354 may be disposed in another partial area of the PCB 310 (for example, on the second surface of the PCB 310), apart from the antenna array 330. The PMIC 354 may receive a voltage from a main PCB (not shown) and supply power required for various components (for example, the RFIC 352) on the antenna module.

According to various embodiments of the disclosure, the shielding member 390 may be disposed in a part (for example, on the second surface) of the PCB 310 to electromagnetically shield at least one of the RFIC 352 or the PMIC 354. According to an embodiment of the disclosure, the shielding member 390 may include a shield can.

In various embodiments of the disclosure, while not shown, the third antenna module 246 may be electrically coupled to another PCB (for example, the main PCB) through a module interface. The module interface may include a connection member, for example, a coaxial cable connector, a board to board connector, an interposer, or a flexible printed circuit board (FPCB). The RFIC 352 and/or the PMIC 354 of the third antenna module 246 may be electrically coupled to the PCB 310 through the connection member.

Figure 4A:
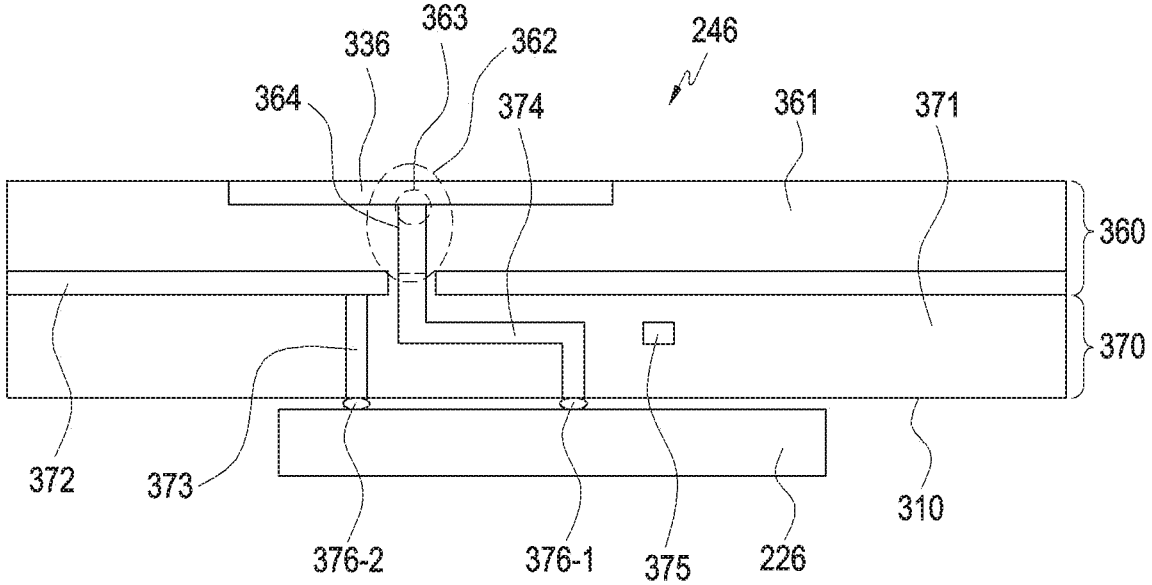
FIG. 4A is a sectional view illustrating a cross-section of an antenna module according to an embodiment of the disclosure.

FIG. 4A is a sectional view illustrating one cross-section of an antenna module according to an embodiment of the disclosure.

Referring to FIG. 4A, the PCB 310 may include an antenna layer 360 and a network layer 370.

According to various embodiments of the disclosure, the antenna layer 360 may include at least one dielectric 361, and the antenna element 336 and/or a feeder 362 formed on the outer surface of the dielectric 361 or inside the dielectric 361. The feeder 362 may include a power feeding point 363 and/or a power feeding line 364.

According to various embodiments of the disclosure, the network layer 370 may include at least one dielectric 371 and at least one ground layer 372, at least one conductive via 373, a transmission line 374, and/or a signal line 375, which is formed on the outer surface of the dielectric 371 or inside the dielectric 371.

According to various embodiments of the disclosure, an RFIC (for example, the third RFIC 226 in FIG. 2) may be electrically coupled to the network layer 370 through, for example, first and second connectors (for example, solder bumps) 376-1 and 376-2. In other embodiments of the disclosure, various connection structures (for example, solders or ball grid arrays (BGAs)) may be used, instead of the connectors. The RFIC (for example, the third RFIC 226 in FIG. 2) may be electrically coupled to the antenna element 336 through the first connector 376-1, the transmission line 374, and the feeder 362. The RFIC (for example, the third RFIC 226 in FIG. 2) may also be electrically coupled to the at least one ground layer 372 through the second connector 376-2 and the conductive via 373. While not shown, the RFIC (for example, the third RFIC 226 in FIG. 2) may be electrically coupled to the above-mentioned module interface through the signal line 375.

Figure 4B:
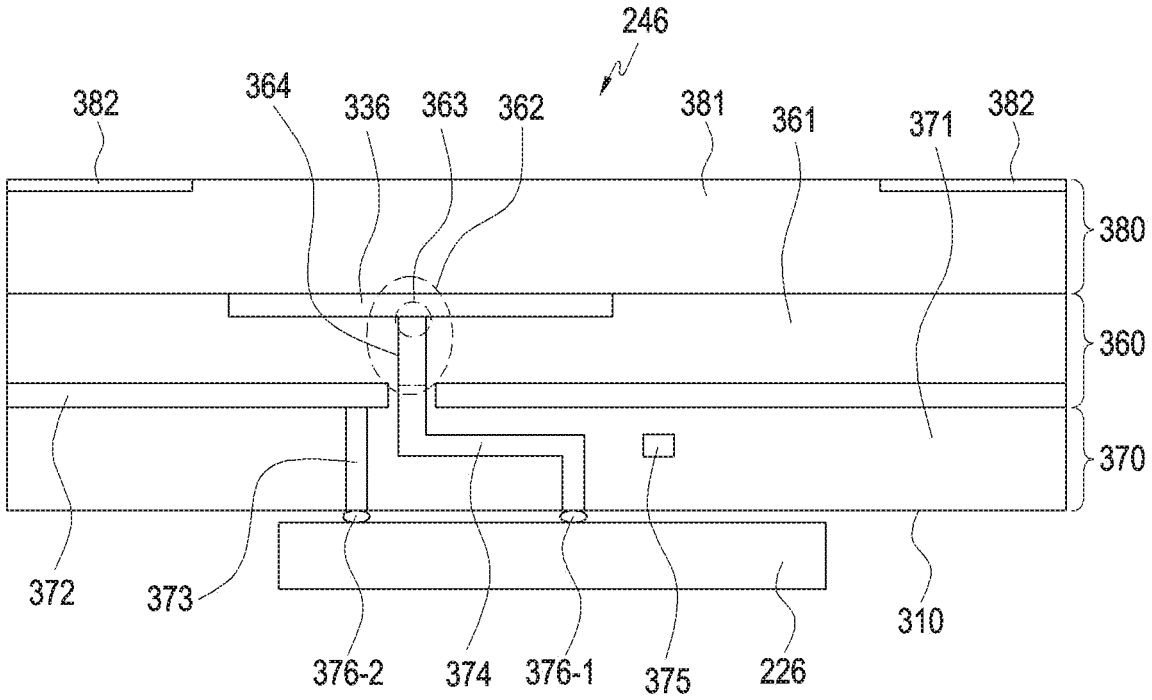
FIG. 4B is a sectional view illustrating a cross-section of an antenna module different from that of FIG. 4A according to an embodiment of the disclosure.

FIG. 4B is a sectional view illustrating a cross-section of an antenna module different from that of FIG. 4A according to an embodiment of the disclosure.

Referring to FIG. 4B, according to various embodiments of the disclosure, the PCB 310 may include the antenna layer 360 and the network layer 370, and may further include at least one other antenna layer (for example, one other antenna layer 380 in FIG. 4B) on the antenna layer 360.

The antenna layer 360 may include the at least one dielectric 361, the antenna element 336, and/or the feeder 362. The network layer 370 may include the at least one dielectric 371, the at least one ground layer 372, the at least one conductive via 373, the transmission line 374, and/or the signal line 375. For the convenience of description, a description redundant with that of the embodiment of FIG. 4A will not be provided herein.

Referring to FIG. 4B, a structure in which another antenna layer 380 is stacked on the antenna layer 360 on the PCB 310 is illustrated as an example. According to various embodiments of the disclosure, each of the antenna layer 360 and the other antenna layer 380 may include a dielectric 361 or 381, and an antenna element 336 or 382 at least partially surrounded by the dielectric 361 or 381. For example, the antenna element 336 included in the antenna layer 360 and the antenna element 382 included in the other antenna layer 380 may be disposed to face in one direction (for example, a direction perpendicular to the PCB 310). Antenna elements 382 included in the other antenna layer 380 may form a periodic structure (or repetition pattern). The periodic structure will be described later in greater detail in the embodiment of FIGS. 5A to 5D.

According to another embodiment of the disclosure, the antenna layer 360 and another antenna layer disposed adjacent to (or stacked on) the antenna layer 360 (for example, refer to the relationship between a second antenna layer 1120 and a sixth antenna 1160 in FIG. 46 which will be described later) may be substantially identical in structure. For example, unlike FIG. 4B, the antenna layer 360 and the other antenna layer may have dielectrics and antenna elements of substantially similar structures, each antenna element being coupled to a power feeding line. Accordingly, the antenna layer 360 and the other antenna layer may be configured to cover different frequency bands. When the antenna layer 360 and the other antenna layer are configured to cover different frequency bands, the third antenna module 246 may include a dual-band antenna element structure. Besides, when the third antenna module 246 includes two or more antenna layers, the third antenna module 246 may include a multi-band antenna element structure of three or more bands. The multi-band antenna element structure will be described later in greater detail in the embodiments of FIGS. 44 to 47, and 48A to 48D.

Figure 5A:
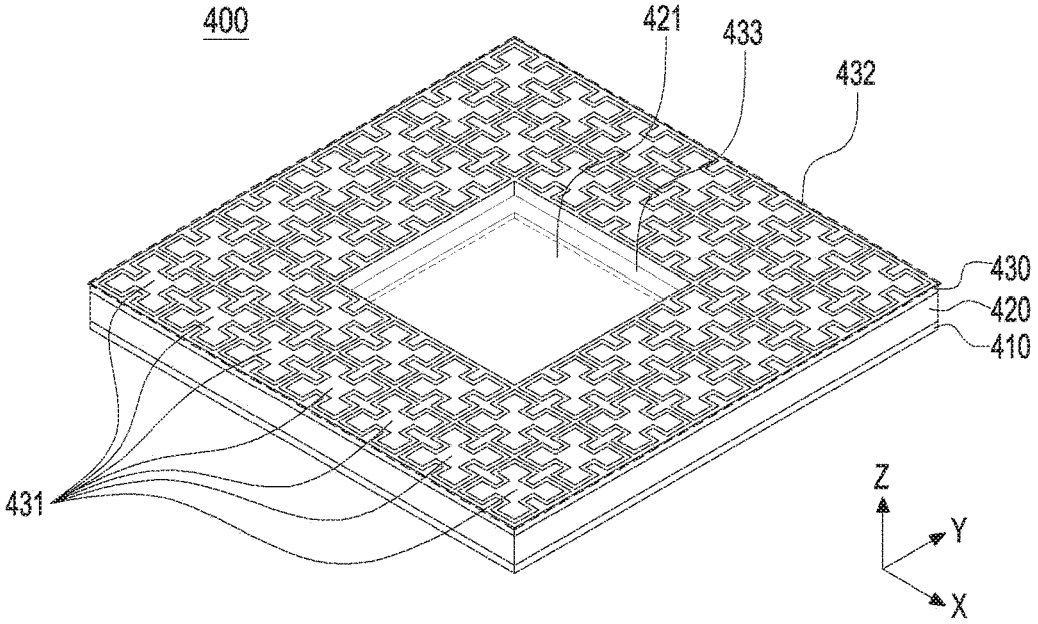
FIG. 5A is a perspective view schematically illustrating an antenna device in an electronic device according to an embodiment of the disclosure.

FIG. 5A is a perspective view schematically illustrating an antenna device in an electronic device according to an embodiment of the disclosure.

Figure 5B:
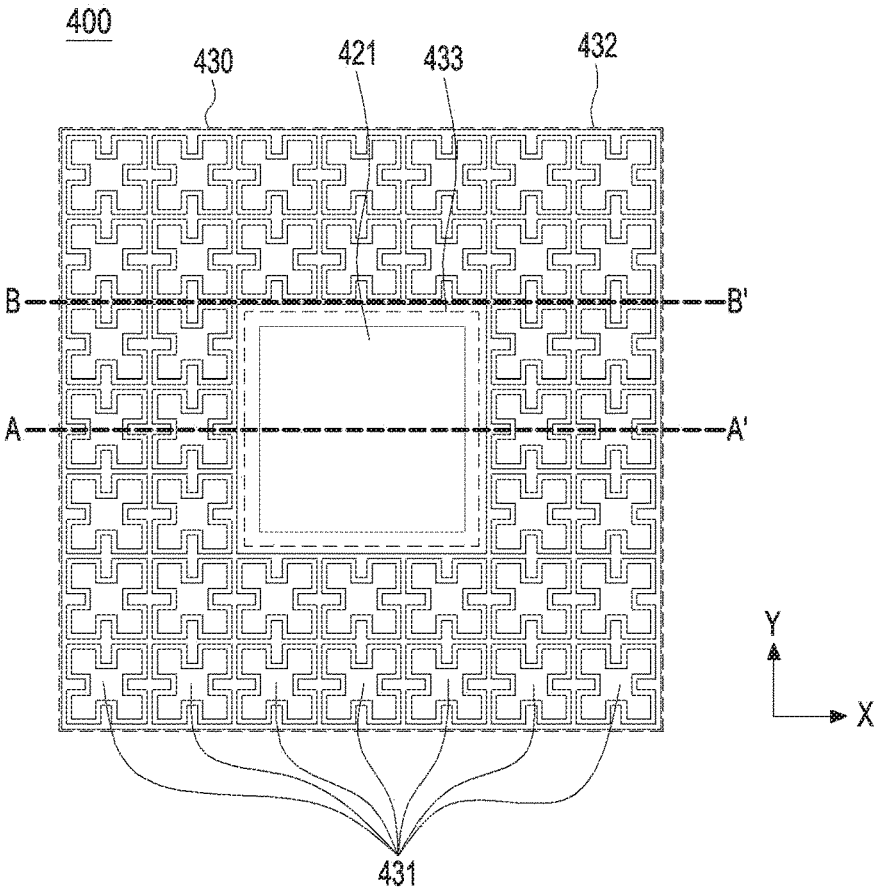
FIG. 5B is a front view schematically illustrating an antenna device in an electronic device illustrated in FIG. 5A according to an embodiment of the disclosure.

FIG. 5B is a front view schematically illustrating an antenna device in an electronic device illustrated in FIG. 5A according to an embodiment of the disclosure.

Figure 5C:
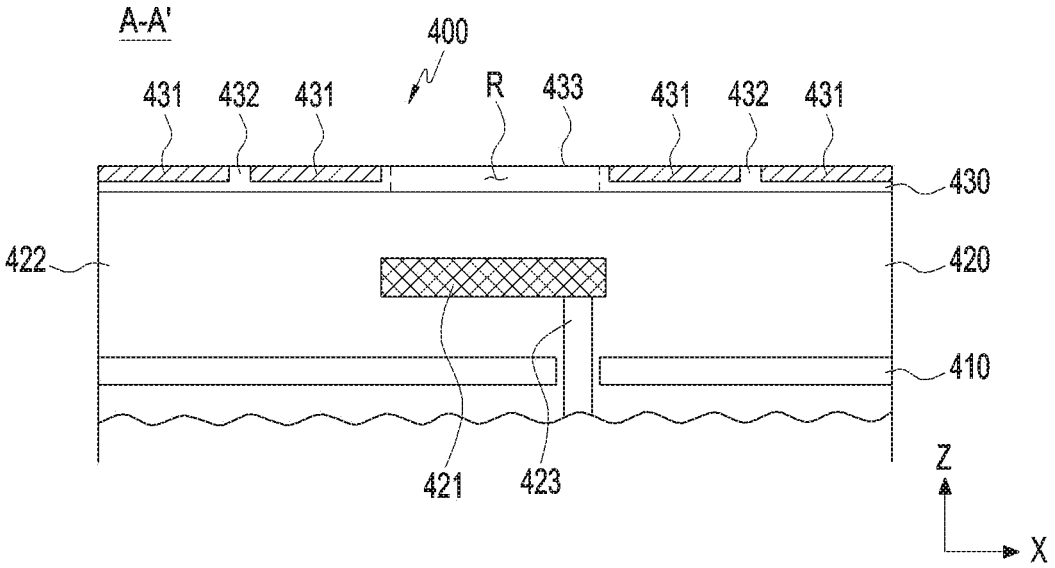
FIG. 5C is a sectional view schematically illustrating a stacked structure of an antenna device in an electronic device illustrated in FIG. 5A according to an embodiment of the disclosure.

FIG. 5C is a sectional view schematically illustrating a stacked structure of an antenna device in an electronic device illustrated in FIG. 5A according to an embodiment of the disclosure.

Figure 5D:
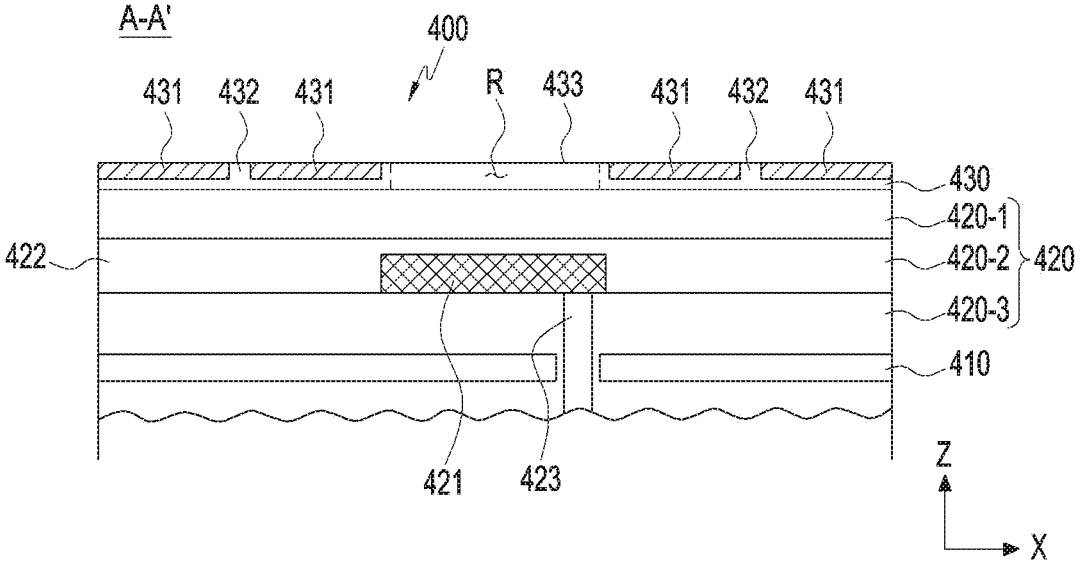
FIG. 5D is a sectional view schematically illustrating a stacked structure of an antenna device in an electronic device according to an embodiment of the disclosure.

FIG. 5D is a sectional view schematically illustrating a stacked structure of an antenna device in an electronic device according to an embodiment of the disclosure. FIG. 5B may illustrate the antenna device 400 of FIG. 5A, viewed from above a third layer 430.

Referring to FIG. 5A, according to various embodiments of the disclosure, the antenna device 400 may include a first layer 410, a second layer 420, or the third layer 430.

The first layer 410 may be a part of the network layer 370 described above with reference to FIG. 4A. The first layer 410 may be a part of the network layer 370, which includes a ground layer (for example, the at least one ground layer 372 in FIG. 4A). The dielectric 371, the conductive via 373, the transmission line 374, or the signal line 375 described with reference to FIG. 4A may be omitted in FIGS. 5A to 5D. According to an embodiment of the disclosure, the first layer 410 may be formed in parallel with a rear plate of an electronic device (for example, the electronic device 101 in FIG. 2). According to another embodiment of the disclosure, the first layer 410 may be formed in parallel with a side member of the electronic device.

The second layer 420 may be the antenna layer 360 described before with reference to FIG. 4A. The second layer 420 may include an antenna element 421. According to an embodiment of the disclosure, the second layer 420 may be stacked on the first layer 410. The third layer 430 may include a conductive cell 431 (hereinafter referred to as a "first conductive cell 431"). The first conductive cell 431 may be, for example, a small-size metallic plate containing a metal material. A plurality of first conductive cells 431 may be provided on the third layer 430. As the plurality of first conductive cells 431 are provided, they may be a configuration to perform a certain function (for example, to improve the radiation performance of the antenna). The plurality of first conductive cells 431 may be apart from each other by a predetermined distance to form a conductive island structure (or a floating structure). The plurality of first conductive cells 431 may form a periodic structure. The third layer 430 may include a first area 432 with the periodic structure (for example, a first periodic structure) of the plurality of first conductive cells 431 and a second area 433 at least partially surrounded by the first area 432.

Referring to FIG. 5B, the antenna device 400 of FIG. 5A is illustrated, viewed from above the third layer 430. FIGS. 5C and 5D illustrate cross-sections of the stacked structure of the first layer 410, the second layer 420, and the third layer 430 in the antenna device 400 illustrated in FIG. 5A. Further, FIGS. 5C and 5D illustrate cross-sections of a part of the antenna device illustrated in the embodiment of FIG. 5B, taken along line A-A'.

Referring to FIGS. 5A, 5B, 5C, and 5D together, the antenna device 400 according to various embodiments of the disclosure may be formed in a structure in which the first layer 410, the second layer 420, and the third layer 430 are stacked.

According to an embodiment of the disclosure, in the stacked structure of the first to third layers 410, 420, and 430, the first to third layers 410, 420, and 430 may be substantially identical in their horizontal lengths and vertical lengths.

The third layer 430 may include the first area 432 in which the periodic structure (for example, the first periodic structure) of the plurality of first conductive cells 431 is formed, and the second area 433 least partially surrounded by the first layer 410. Referring to FIG. 5A, for example, the second area 433 may be an area defined inside a rectangular boundary indicated by reference numeral 433, and the first area 432 may be an area excluding the second area 433 from the inside of a boundary indicated by reference numeral 432.

Referring to FIG. 5C, according to various embodiments of the disclosure, an opening R may be formed in the second area 433. At least a part of the antenna element 421 of the second layer 420 may be exposed to the outside through the opening R. According to an embodiment of the disclosure, the opening R may be filled with a non-conductive dielectric. Further, according to an embodiment of the disclosure, the antenna element 421 may be disposed in the opening R in a size and/or shape substantially similar to that of the opening R, and radiate in at least one direction (for example, the Z direction in FIG. 5B) through the opening R.

According to various embodiments of the disclosure, the first, second and third layers 410, 420 and 430 may be shaped into plates. For example, the plate-shaped first, second and third layers 410, 420, and 430 may be stacked to form a substrate (PCB).

The first layer 410, which is disposed in the antenna device 400, may be grounded by including a ground layer (or ground plane) inside it or being coupled to a ground member adjacent to the first layer 410. For example, the first layer 410 may be grounded by being coupled to the rear plate, the side member or a support member (for example, a bracket). The first layer 410 may be included in a part of a feeding network layer (for example, the network layer 370 in FIG. 4A). While not shown in FIG. 5C, the first layer 410 may be electrically coupled to a communication module (for example, the communication module 190 in FIG. 1 or the third RFIC 226 in FIG. 4A) outside a network layer (for example, the network layer 370 in FIG. 4A) through first and second connectors (for example, the first and second connectors 376-1 and 376-2 in FIG. 4A) or a conductive via (for example, the conductive via 373 in FIG. 4A). According to an embodiment of the disclosure, the first layer 410 may form a base of the substrate. The second layer 420 and the third layer 430 may be formed on the first layer 410 serving as the base.

The second layer 420 may include a dielectric 422. The dielectric 422 may surround at least a part of the antenna element 421 (for example, the antenna element 336 in FIG. 4A), at least partially insulating the antenna element 421. The antenna element 421 may be formed on the outer surface of the dielectric 422 or inside the dielectric 422. According to an embodiment of the disclosure, the antenna element 421 may be disposed at a position apart from one surface of the first layer 410 including the ground by a predetermined distance. In another example, the antenna element 421 may be electrically coupled to an RFIC (for example, the third RFIC 226 in FIG. 4A) positioned on the other surface of the first layer 410 through a power feeding line 423 (for example, the transmission line 274 in FIG. 4A).

For example, the second layer 420 may include at least a part of the power feeding line 423 electrically coupled to the antenna element 421 in the dielectric 422.

At least one layer including conductive cells (for example, the first conductive cells 431) may be disposed on the second layer 420. As illustrated in FIGS. 5A to 5D, one layer (for example, the third layer 430) including a plurality of conductive cells is disposed in a direction in which the antenna element 421 radiates millimeter waves to enhance the radiation performance of the antenna element 421 in a predetermined frequency range. For example, the third layer 430 with a plurality of first conductive cells 431 may be formed on the second layer 420. The plurality of first conductive cells 431 may be arranged on the outer surface of or inside the third layer 430, apart from the antenna element 421 by predetermined distances in parallel with the antenna element 421. According to various embodiments of the disclosure, the third layer 430 may be formed by etching a conductive material layer printed on the substrate or positioned on the top surface of the substrate.

The stacked structure of the first, second and third layers 410, 420, and 430 may include a stack of four or more layers, not limited to a stack of three layers. Further, referring to the embodiment illustrated in FIG. 5D, the second layer 420 may include two or more sub-layers (for example, a $(2\text{-}1)^{th}$ layer 420-1, a $(2\text{-}2)^{th}$ layer 420-2, and a $(2\text{-}3)^{th}$ layer 420-3). When the second layer 420 includes two or more sub-layers, for example, the third layer 430 including the first conductive cells 431 may be disposed on the $(2\text{-}1)^{th}$ layer 420-1. In another example, the antenna element 421 may be disposed on the $(2\text{-}2)^{th}$ layer 420-2. In another example, the first layer 410 including the ground layer may be disposed under the $(2\text{-}3)^{th}$ layer 420-3.

In an embodiment of the disclosure, according to an embodiment of the disclosure, the second layer 420 may be thickest, and the third layer 430 may be much less thick than the second layer 420 in the stacked structure of the first to third layers 410, 420, and 430.

However, the size and position of the antenna element 421, the size and positions of the first conductive cells 431, the number of layers, or the thicknesses of the layers may vary according to embodiments of the disclosure, not limited to the above configuration.

Referring to FIGS. 5A to 5D together, the plurality of first conductive cells 431 may be arranged at predetermined intervals. According to various embodiments of the disclosure, when viewed from above the third layer 430 (or when viewed from above the antenna device), the plurality of first conductive cells 431 may surround at least a part of the antenna element 421, and may be arranged apart from the antenna element 421 by predetermined distances. According to an embodiment of the disclosure, at least a part of the plurality of first conductive cells 431 may function as a radiator in conjunction with the antenna element 421.

According to various embodiments of the disclosure, two or more first conductive cells 431 of the same shape and size among the plurality of first conductive cells 431 may form a periodic structure. The periodic structure may be, for example, an artificial magnetic conductor (AMC) structure, a high impedance periodic (HIP) structure, a high impedance surface (HIS) structure, or an electromagnetic bandgap (EBG) structure.

For example, when the plurality of first conductive cells 431 form the first periodic structure, the first periodic structure including the plurality of first conductive cells 431 may have a high impedance in a specific frequency band. According to an embodiment of the disclosure, when electromagnetic waves are incident on the plurality of first conductive cells 431 forming the periodic structure (for example, the first periodic structure), the phase difference between an incident wave and a reflected wave may be zero. Therefore, reflection in the horizontal direction (a direction perpendicular to an incident direction) may be suppressed, while reflection in the vertical direction (a direction parallel to the incident direction) may be enhanced. Accordingly, the radiation performance (for example, gain) of the antenna device 400 may be improved.

The plurality of first conductive cells 431 may form the first periodic structure in the first area 432 of the third layer 430. In the entire area of the third layer 430 except for the second area 433, the plurality of first conductive cells 431 may be arranged apart from each other at an equal interval. According to an embodiment of the disclosure, at least two or more first conductive cells 431 are arranged adjacent to each other in the horizontal or vertical direction of the third layer 430, so that the plurality of first conductive cells 431 may form a periodic structure having a high impedance (for example, the first periodic structure).

The resonance frequency of the antenna device 400 may vary under the action of at least one parameter. For example, parameters affecting the resonance frequency of the antenna device 400 may include the shape and size of the antenna element 421, the distance between the antenna element 421 and the ground, the shape and size of the first conductive cells 431, the distance between the first conductive cells 431 and the ground, the distance between the antenna element 421 and the first conductive cells 431, or the distance between the plurality of first conductive cells 431. The resonance frequency of the antenna device 400 may vary under the action of at least a part of the various parameters.

For example, the dielectric constant of the dielectric 422 may be about 3.5, the size of the first conductive cells 431 may be about 1.7 mm×1.7 mm, and the gap between the plurality of first conductive cells 431 may be about 56 μm. In this case, the impedance of the surface of the periodic structure may be about 17000Ω at about 28 GHz.

Figure 6:
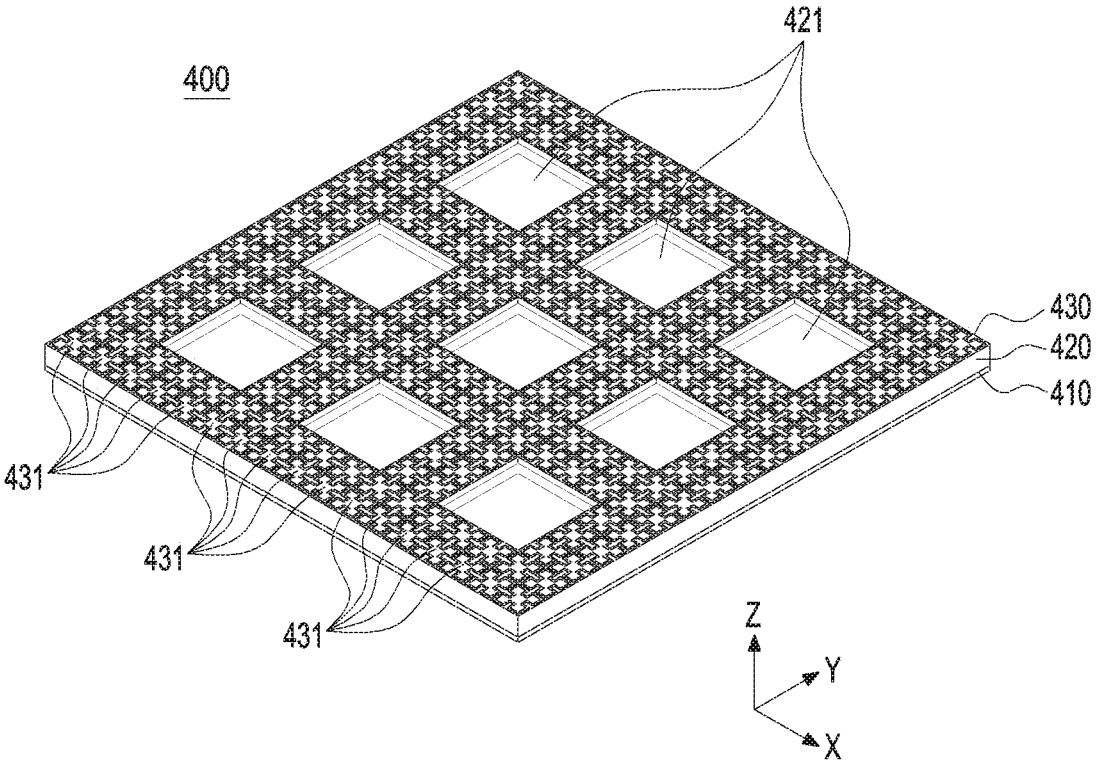
FIG. 6 is a perspective view illustrating an antenna device in which a plurality of antenna elements is arranged in an array according to an embodiment of the disclosure.

FIG. 6 is a perspective view illustrating an antenna device in which a plurality of antenna elements are arranged in an array according to an embodiment of the disclosure.

Referring to FIG. 6, the second layer 420 may include a plurality of antenna elements 421. The antenna device 400 may include a plurality of antenna elements 421 to form an antenna array. For example, various antenna arrays such as a 1><2, 2><2, 1><3, 3><3, 1><4, or 4><4 antenna array are available according to the number of antenna elements 421. In FIG. 6, nine antenna elements 421 are included in the form of a 3×3 array in the antenna device 400.

While not shown in FIG. 6, a power feeding line (for example, the power feeding line 423 in FIG. 5C) may be electrically coupled to each of the plurality of antenna elements 421. One side of the power feeding line may be coupled to an antenna element 421, and the other side thereof may be coupled to a wireless communication circuit, so that power may be supplied to the antenna element 421. The wireless communication circuit may include, for example, an RFIC and a communication module (for example, the communication module 190 in FIG. 1).

Figure 7:
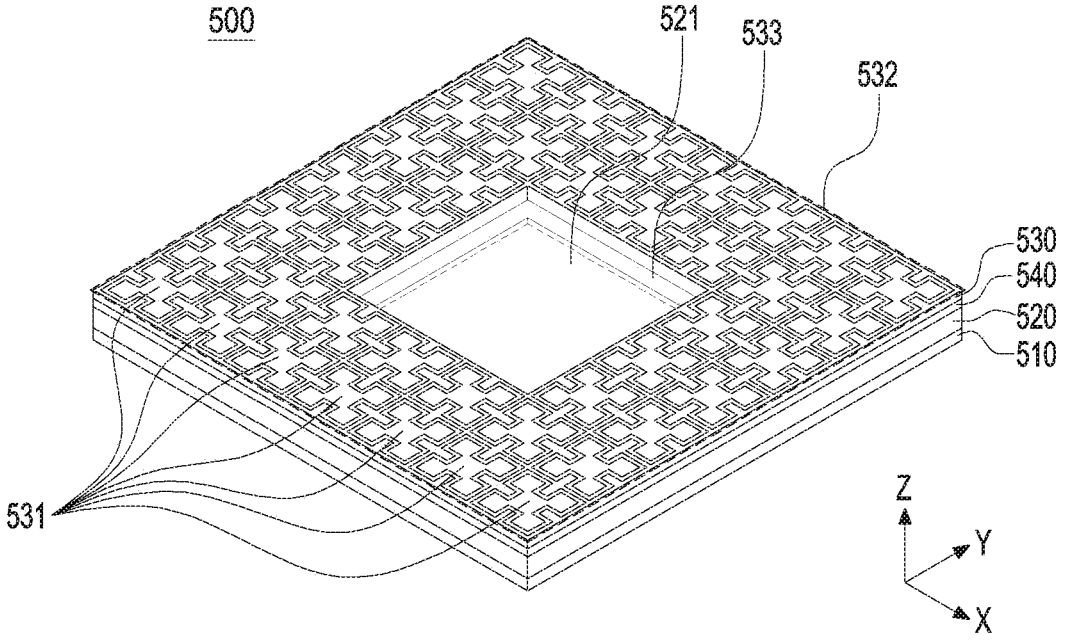
FIG. 7 is a perspective view schematically illustrating an antenna device in an electronic device different from that of FIG. 5A according to an embodiment of the disclosure.

FIG. 7 is a perspective view schematically illustrating an antenna device in an electronic device different from that of FIG. 5A according to an embodiment of the disclosure.

Referring to FIG. 7, a first layer 510, a second layer 520, and/or a third layer 530 may be stacked in the antenna device 500 according to various embodiments of the disclosure. According to various embodiments of the disclosure, the antenna device 500 may further include a fourth layer 540 in addition to the first, second and third layers 510, 520, and 530. The fourth layer 540 may be stacked with the first, second and third layers 510, 520, and 530. A description of FIG. 7 identical to a foregoing description will not be provided herein to avoid redundancy.

Figure 8A:
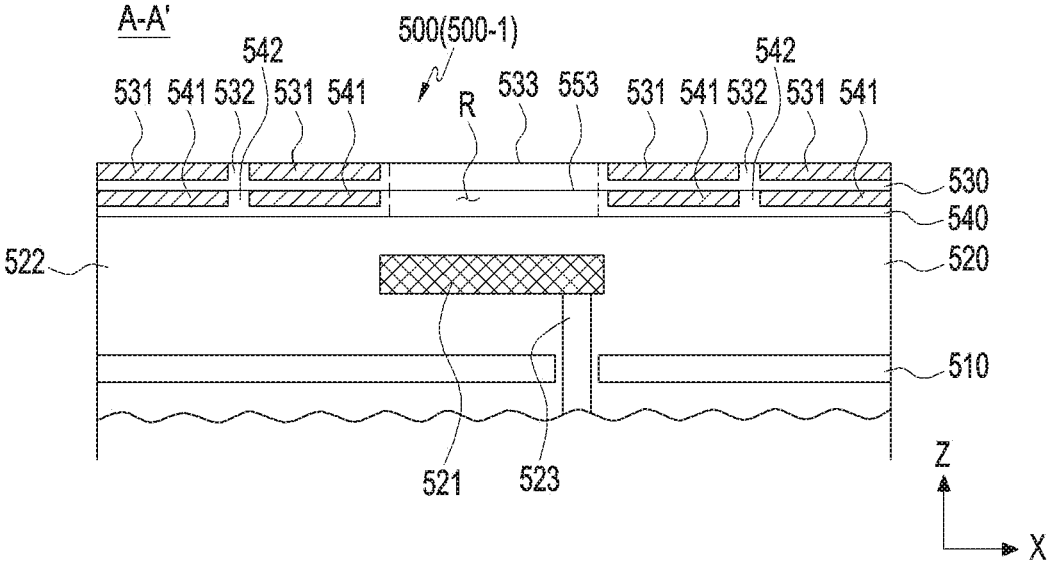
FIG. 8A is a sectional view illustrating a stacked structure of an antenna device illustrated in FIG. 7 according to an embodiment of the disclosure.

FIG. 8A is a sectional view schematically illustrating a stacked structure of an antenna device illustrated in FIG. 7 according to an embodiment of the disclosure.

Figure 8B:
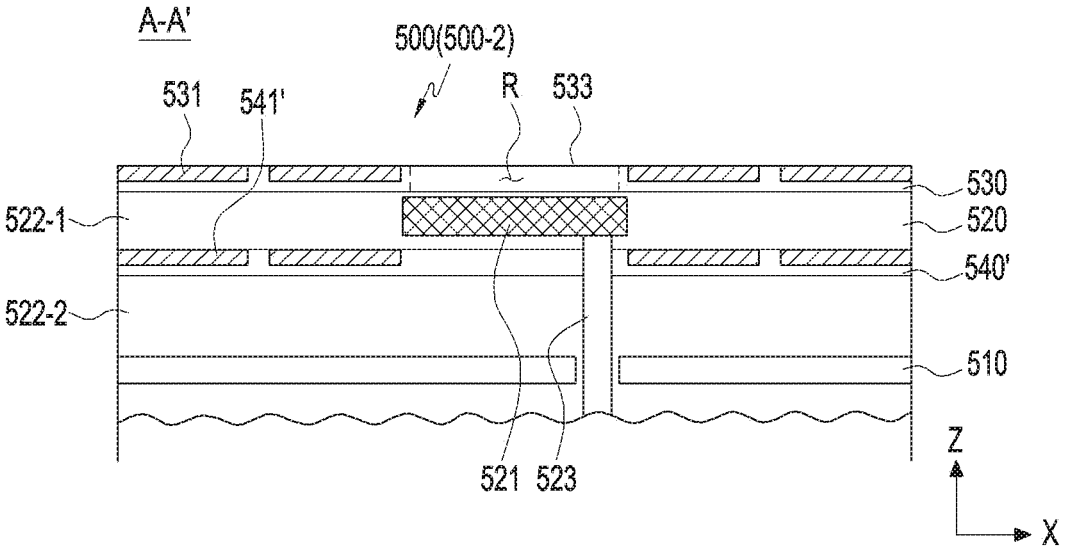
FIG. 8B is a sectional view illustrating a stacked structure of an antenna device different from that of FIG. 8A according to an embodiment of the disclosure.

FIG. 8B is a sectional view schematically illustrating a stacked structure of an antenna device different from that of FIG. 8A according to an embodiment of the disclosure.

According to various embodiments of the disclosure, the stacked position of the fourth layer 540 is not limited to a specific embodiment. According to an embodiment of the disclosure, the fourth layer 540 may be disposed on one surface of the third layer 530 (for example, a surface of the third layer 530, facing in a direction opposite to the Z axis), for example, between the third layer 530 and the second layer 520, as illustrated in FIG. 8A. In another example, a fourth layer 540' may be disposed between the first layer 510 and the second layer 520 as illustrated in FIG. 8B. According to another embodiment of the disclosure, a fourth layer (not shown) may be stacked on the other surface of the third layer 530 (for example, a surface of the third layer 530, facing in the Z-axis direction).

Referring to FIGS. 8A and 8B, first conductive cells 541 and 541' may be formed on the fourth layers 540 and 540'. There may be a plurality of conductive cells 541 and a plurality of conductive cells 541', respectively on the fourth layers 540 and 540', and the conductive cells 541 and 541' may be apart from each other to form a conductive island structure. The plurality of conductive cells 541 and 541' formed on the fourth layers 540 and 540' may also have periodic structures (for example, second periodic structures).

To avoid confusion in description, a conductive cell formed on the third layer 530 is referred to as a "first conductive cell 531" and a conductive cell formed on the fourth layer 540 is referred to as a "second conductive cell 541" in the following description.

Referring to FIG. 8A, for example, the fourth layer 540 may include a third area 542 with a repetition pattern (for example, a second pattern) of the second conductive cells 541 formed therein and a fourth area 543 at least partially surrounded by the third area 542. According to an embodiment of the disclosure, the third area 542 of the fourth layer 540 may correspond to a first area 532 of the third layer 530, and the fourth area 543 of the fourth layer 540 may correspond to a second area 533 of the third layer 530. When the antenna device 500 is viewed from above, the third area 542 may be substantially identical to the first area 532, and the fourth area 543 may be substantially identical to the second area 533.

According to various embodiments of the disclosure, the third area 542 and the fourth area 543 of the fourth layer 540 may be formed at positions corresponding to the first area 532 and the second area 533 of the third layer 530. According to an embodiment of the disclosure, when the fourth layer 540 is viewed from above, the third area 542 may be formed in substantially the same shape at substantially the same position as the first area 532, and the fourth area 543 may also be formed in substantially the same shape at substantially the same position as the second area 533. The third area 542 and the first area 532 may be formed overlapped with each other, for example, in the Z-axis direction, and the fourth area 543 and the second area 533 may be formed overlapped with each other, for example, in the Z-axis direction. According to an embodiment of the disclosure, the periodic structure (for example, a second periodic structure) of the plurality of second conductive cells 541 may be formed in the third area 542, and the fourth area 543 may be surrounded at least partially by the third area 542 with the periodic structure of the second conductive cells 541 formed therein.

According to an embodiment of the disclosure, the first conductive cells 531 formed in the third layer 530 and the second conductive cells 541 formed in the fourth layer 540 may be substantially identical in shape and arrangement. In another example, the gap between the plurality of first conductive cells 531 and the gap between the plurality of second conductive cells 541 may be substantially equal.

According to an embodiment of the disclosure, an opening R may be formed in the fourth area 543 corresponding to the second area 533.

According to an embodiment of the disclosure, the opening R may be formed in the second area 533 and the fourth area 543 so that at least a part of an antenna element 521 may be exposed to the outside, or in either the second area 533 or the four area 543. According to another embodiment of the disclosure, the radiation performance of the antenna device 500 may be improved by appropriately adjusting the dielectric constants of non-conductive materials (for example, dielectrics) formed in the second area 533 and the fourth area 543. Referring to FIG. 8A, the first conductive cells 531 and the second conductive cells 541 may be stacked in the Z-axis direction. According to an embodiment of the disclosure, the first periodic structure of the first conductive cells 531 and the second periodic structure of the second conductive cells 541 may be stacked above the antenna element 521.

Referring to FIG. 8B, the second layer 520 may be disposed between the third layer 530 and the fourth layer 540', so that the antenna element 521 may be interposed between the first conductive cells 531 and the second conductive cells 541'. When the first conductive cells 531 form the first periodic structure and the second conductive cells 541' form the second periodic structure, the periodic structures may be formed above and below the antenna element 521, respectively.

According to an embodiment of the disclosure, the first periodic structure and the second periodic structure may be substantially identical in size and shape, and also in the size, shape, and arrangement of conductive cells.

According to an embodiment of the disclosure, the antenna devices 500-1 and 500-2 having optimal radiation performance in a predetermined frequency may be provided by adjusting the shapes of the first periodic structure and the second periodic structure, or the gap between layers.

As illustrated in FIG. 8B, for example, dielectrics 522-1 and 522-2 may be disposed on and under the fourth layer 540', respectively. The distance between the antenna element 521 and the ground, the distance between the first conductive cells 531 and the ground, the distance between the antenna element 521 and the first conductive cells 531, the distance between the antenna element 521 and the second conductive cells 541', or the distance between the second conductive cells 541' and the ground may be adjusted by variously settings the shapes, dimensions, and/or arrangements of the dielectrics 522-1 and 522-2.

Figure 9:
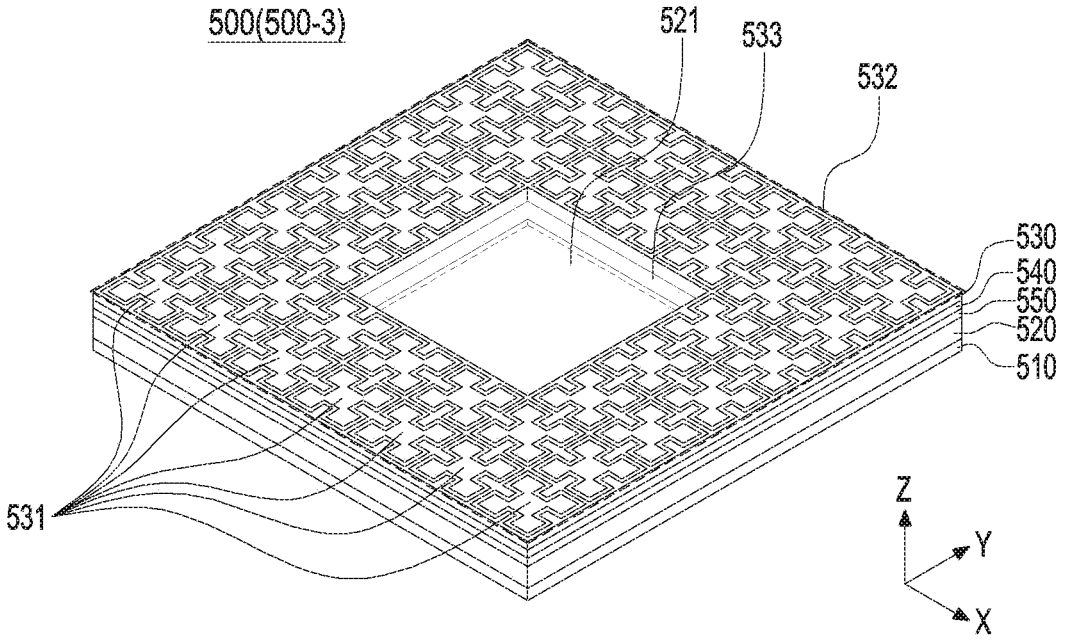
FIG. 9 is a perspective view schematically illustrating an antenna device in an electronic device different from that of FIG. 5A according to an embodiment of the disclosure.

FIG. 9 is a perspective view schematically illustrating an antenna device in an electronic device different from that of FIG. 5A according to an embodiment of the disclosure.

Referring to FIG. 9, the first layer 510, the second layer 520, the third layer 530 and/or the fourth layer 540 may be stacked in the antenna device 500 (or an antenna device 500-3) according to various embodiments of the disclosure. According to various embodiments of the disclosure, the antenna device 500 (or the antenna device 500-3) may further include a fifth layer 550 in addition to the first to fourth layers 510, 520, 530, and 540. The fifth layer 550 may be stacked with the first to fourth layers 510, 520, 530, and 540.

Figure 10A:
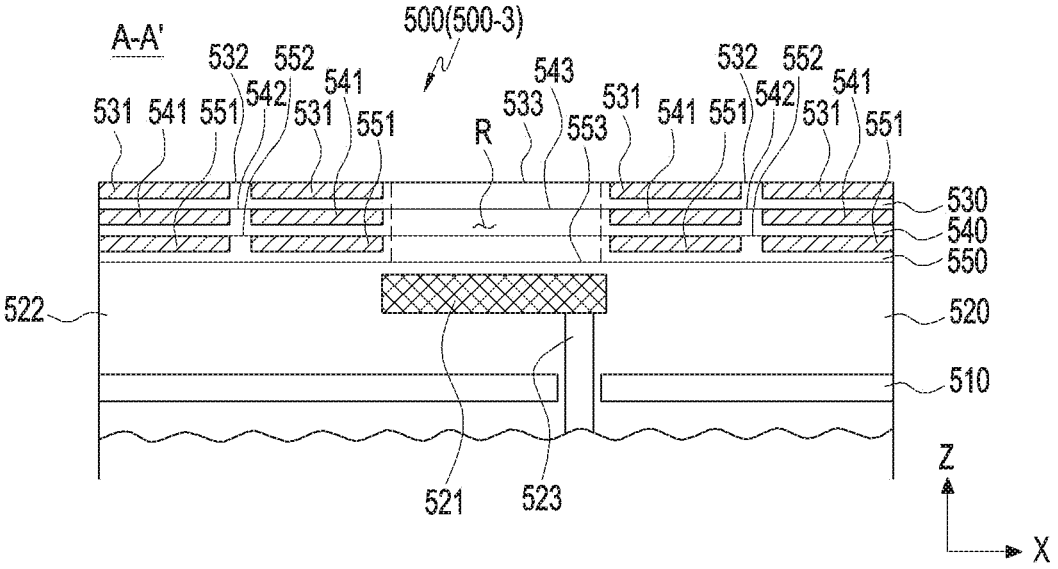
FIG. 10A is a sectional view illustrating a stacked structure of an antenna device illustrated in FIG. 9 according to an embodiment of the disclosure.
Figure 10B:
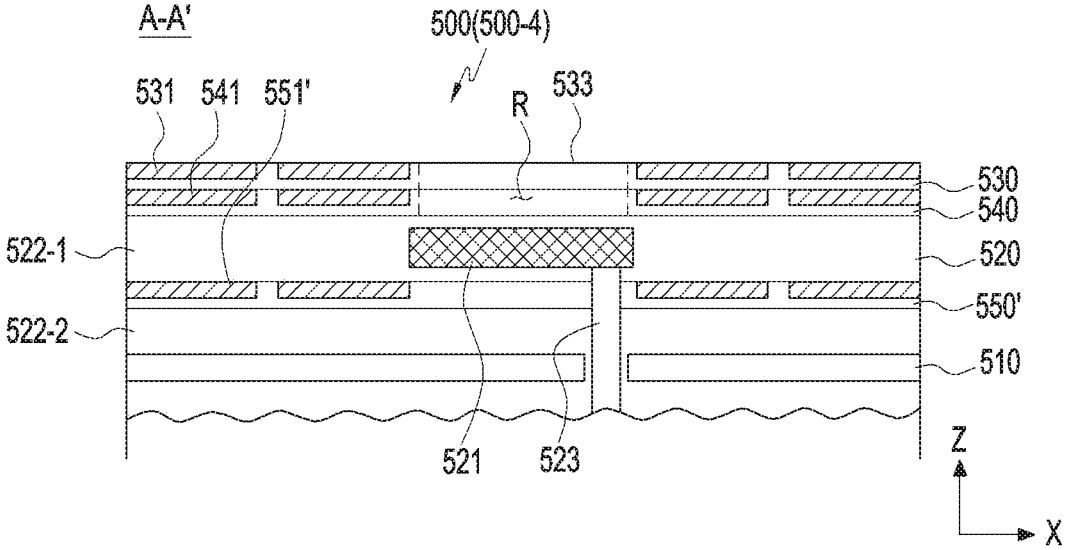
FIG. 10B is a sectional view illustrating a stacked structure of an antenna device different from that of FIG. 10A according to an embodiment of the disclosure.

A description of embodiments illustrated in FIGS. 9, 10A and 10B identical to any of the descriptions of FIGS. 7, 8A and 8B will not be provided herein to avoid redundancy.

FIG. 10A is a sectional view schematically illustrating a stacked structure of an antenna device in an electronic device illustrated in FIG. 9 according to an embodiment of the disclosure.

FIG. 10B is a sectional view schematically illustrating a stacked structure of an antenna device included in an electronic device different from that of FIG. 10A according to an embodiment of the disclosure.

Referring to FIGS. 10A and 10B, for example, the stacked position of the fifth layer is not limited to any particular embodiment. According to an embodiment of the disclosure, the fifth layer 550 including third conductive cell 551 may be disposed between the fourth layer 540 and the second layer 520. According to another embodiment of the disclosure, a fifth layer 550' including third conductive cell 551' may be disposed between the first layer 510 and the second layer 520. According to another embodiment of the disclosure, a fifth layer (not shown) may be stacked between the third layer 530 and the fourth layer 540. According to another embodiment of the disclosure, a fifth layer (not shown) may be stacked on the third layer 530 in the Z-axis direction. Various stacked structures of layers may be provided in various embodiments of the disclosure.

In the embodiment illustrated in FIG. 10A, for example, a conductive cell 551 (hereinafter, referred to as a "third conductive cell 551") may also be formed on the fifth layer 550. A plurality of third conductive cells 551 may be formed on the fifth layer 550, apart from each other to form a conductive island structure. The conductive cells 551 may also be formed in a periodic structure (for example, a third periodic structure) on the fifth layer 550.

According to various embodiments of the disclosure, the fifth layer 550 may include a fifth area 552 with the third periodic structure of the plurality of third conductive cells 551 formed therein, and a sixth area 553 at least partially surrounded by the fifth area 552. The fifth area 552 and the sixth area 553 may correspond to the first area 532 and the second area 533, respectively. According to various embodiments of the disclosure, the conductive cells 531, 541, and 551 may be formed on three or more layers in the antenna device 500. The antenna device 500 may have optimal radiation performance in a predetermined frequency band by adjusting the arrangement and gaps between the second layer 520 with the antenna element 521 formed therein and the layers 530, 540 and 550 with the conductive cells 531, 541, and 551 formed therein.

With the embodiments illustrated in FIGS. 7 to 10B taken into account in combination, a plurality of layers (for example, the third layer 530 and the fourth layer 540 or the third layer 530, the fourth layer 540, and the fifth layer 540) may be disposed on the second layer 520. Accordingly, the antenna element 521 and at least two conductive cells may be stacked along the height direction of the antenna element 521 (for example, the Z-axis direction in FIG. 7). For example, when a plurality of first conductive cells 531 form the first periodic structure on the third layer 530, and a plurality of second conductive cells 541 form the second periodic structure on the fourth layer 540, two or more periodic structures may be stacked in the Z-axis direction of the antenna element 521. According to various embodiments of the disclosure, as the antenna element 521 and at least two periodic structures are stacked, electromagnetic coupling may occur, thereby improving antenna performance.

According to an embodiment of the disclosure, when the sizes of conductive cells forming a periodic structure are set to be constant, the antenna device 500 with the periodic structures of at least two stacked layers may have a high impedance property in a lower frequency band, compared to an antenna device with one periodic structure on a single layer (for example, the antenna device 400 in FIG. 5A).

According to another embodiment of the disclosure, when the antenna device with one periodic structure on a single layer (for example, the antenna device 400 in FIG. 5A) and the antenna device 500 with stacked periodic structures have the same impedance value, the latter may have a smaller cross-sectional area in an individual conductive cell than the former. For example, the antenna device 500 with stacked periodic structures may decrease the cross-sectional area of a periodic structure, compared to the antenna device without stacked periodic structures (for example, the antenna device 400 in FIG. 5A).

In the embodiments illustrated in FIGS. 7, 8A and 8B, for example, when the impedance of the surfaces of the first conductive cells 531 is about 17000Ω at about 28 GHz, the size of each of the plurality of first conductive cells 531 and the plurality of second conductive cells 541 may be about 0.4 mm×0.4 mm, and the gap between the plurality of first conductive cells 531 may be about 50 μm.

For example, when an antenna device having the same level of impedance is configured, the sizes (for example, cross-sectional areas) of the first conductive cells 531 illustrated in FIGS. 7, 8A and 8B may be set to be smaller than the sizes (for example, cross-sectional areas) of the first conductive cells according to the embodiments illustrated in FIGS. 5A to 5D. For example, as illustrated in FIGS. 7, 8A and 8B, when an antenna device having the same level of impedance is configured, the size of an individual conductive cell may be smaller in the embodiments with at least two stacked structures of conductive cells than in a structure in which conductive cells are arranged on a single layer.

Figure 11:
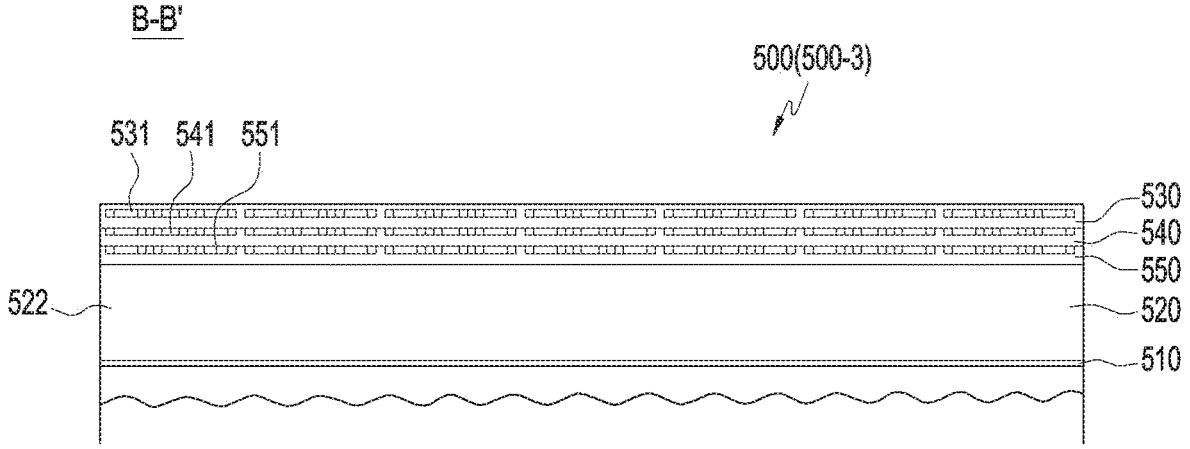
FIG. 11 is a sectional view illustrating a cross-section of a part of a stacked structure of an antenna device, different from the cross-section illustrated in FIG. 10A according to an embodiment of the disclosure.

FIG. 11 is a sectional view illustrating a cross-section of a part of a stacked structure of an antenna device different from the cross-section illustrated in FIG. 10A according to an embodiment of the disclosure.

Referring to FIG. 11, the thicknesses of third, fourth and fifth layers (for example, the third, fourth and fifth layers 530, 540 and 550) in the antenna device 500 according to an embodiment of the disclosure may be smaller than the thickness of the second layer 520. While the thicknesses of the third, fourth and fifth layers (for example, the third, fourth and fifth layers 530, 540 and 550) are shown as equal in FIG. 11, they may be set differently according to embodiments of the disclosure. The sizes and number of conductive cells (for example, the conductive cells 531, 541, and 551) may also vary according to various specifications of the antenna device 500.

According to various embodiments of the disclosure, two different conductive cells located in a mutually stacked direction among a plurality of conductive cells included in the antenna device 500 may overlap with each other, when viewed from above the topmost one of the plurality of layers included in the antenna device 500 (or from above the antenna device 500).

Referring to the embodiment illustrated in FIG. 7, when viewed from above the third layer 530, the first conductive cells 531 and the second conductive cells 541 may overlap at least partially with each other. Referring to the embodiment illustrated in FIG. 9, when viewed from above the third layer 530, the first conductive cells 531 may at least partially overlap with the third conductive cells 551 as well as a second conductive cells 541.

This overlap structure may lead to, for example, improved impedance or electromagnetic coupling between the conductive cells 531, 541, and 551, thereby enabling precise adjustment of a resonance frequency.

Figures 12A, 12B, 12C:
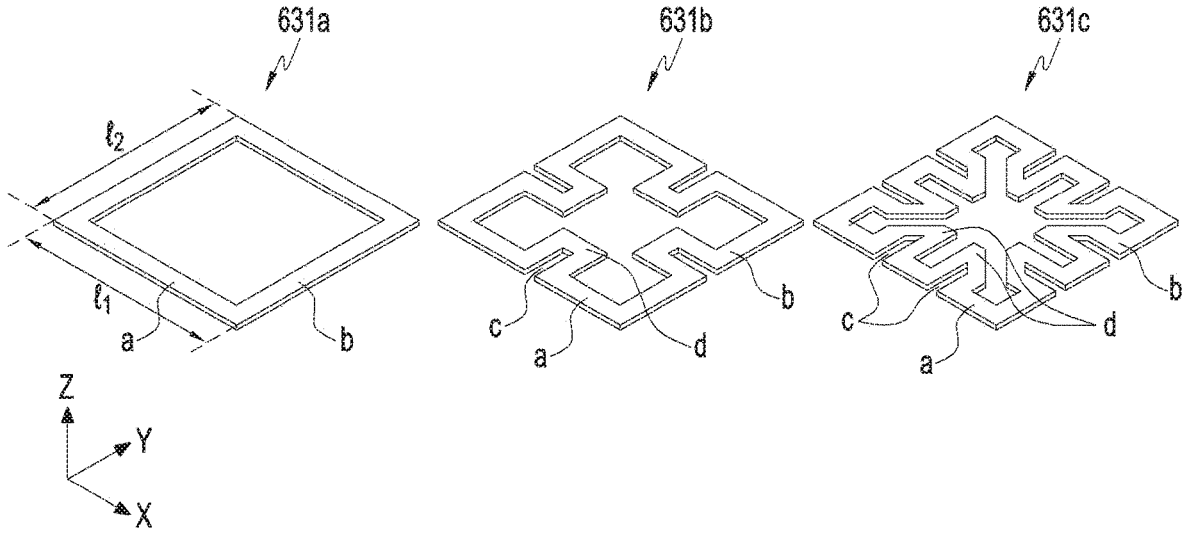
FIGS. 12A, 12B, and 12C are perspective views illustrating various shapes of conductive cells according to various embodiments of the disclosure.

FIGS. 12A, 12B, and 12C are perspective views illustrating various shapes of conductive cells according to various embodiments of the disclosure.

Referring to FIGS. 12A to 12C, the conductive cells 631*a*, 631*b*, and 631*c* may represent, for example, first conductive cells (for example, the first conductive cells 531 in FIG. 7), second conductive cells (for example, the second conductive cells 541 in FIG. 7), and/or third conductive cells (for example, the third conductive cells 551 in FIG. 9).

According to various embodiments of the disclosure, the conductive cells (for example, the first, second and third conductive cells 531, 541, and 551) may be meandering in shape, such as the conductive cells 631*a*, 631*b*, and 631*c* illustrated in FIGS. 12A to 12C. The conductive cells 631*a*, 631*b*, and 631*c* may be formed in a structure in which the horizontal and vertical sides of each of the conductive cells 631*a*, 631*b*, and 631*c* are symmetrical respectively with respect to the center of the conductive cell.

FIG. 12A illustrates a rectangular conductive cell 631*a* with horizontal sides 'a' of a length $l_1$ and vertical sides 'b' of a length $l_2$. FIG. 12B illustrates a conductive cell 631*b* with horizontal sides and vertical sides of the same lengths as those of the conductive cell 631*a* illustrated in FIG. 12A, in which each of the horizontal sides and vertical sides includes one inlet portion 'c' and an inner protrusion 'd' corresponding to the inlet portion 'c'. FIG. 12C illustrates a conductive cell 631*c* with horizontal sides and vertical sides of the same lengths as those of the conductive cell 631*a* illustrated in FIG. 12A, in which each of the horizontal sides and vertical sides includes two inlet portions 'c' and two inner protrusions 'd' corresponding to the inlet portions 'c'.

According to an embodiment of the disclosure, the conductive cell 631*b* illustrated in FIG. 12B may have a longer loop length than the conductive cell 631*a* illustrated in FIG. 12A, so that the conductive cell 631*b* illustrated in FIG. 12B may cover a low frequency band more easily.

According to another embodiment of the disclosure, while the conductive cell 631*c* illustrated in FIG. 12C has a larger loop length than the conductive cell 631*b* illustrated in FIG. 12B, the space inside the loop is excessively narrow due to the longer loop, and thus it may be difficult to cover a low frequency band. Accordingly, a comparison between the conductive cell 631*b* illustrated in FIG. 12B and the conductive cell 631*c* illustrated in FIG. 12C reveals that it may be easier to cover a low frequency band with the conductive cell 631*b* with a relatively short loop illustrated in FIG. 12B than with the conductive cell 631*c* with a relatively long loop illustrated in FIG. 12C in some embodiments of the disclosure.

Figures 13A, 13B, 13C:
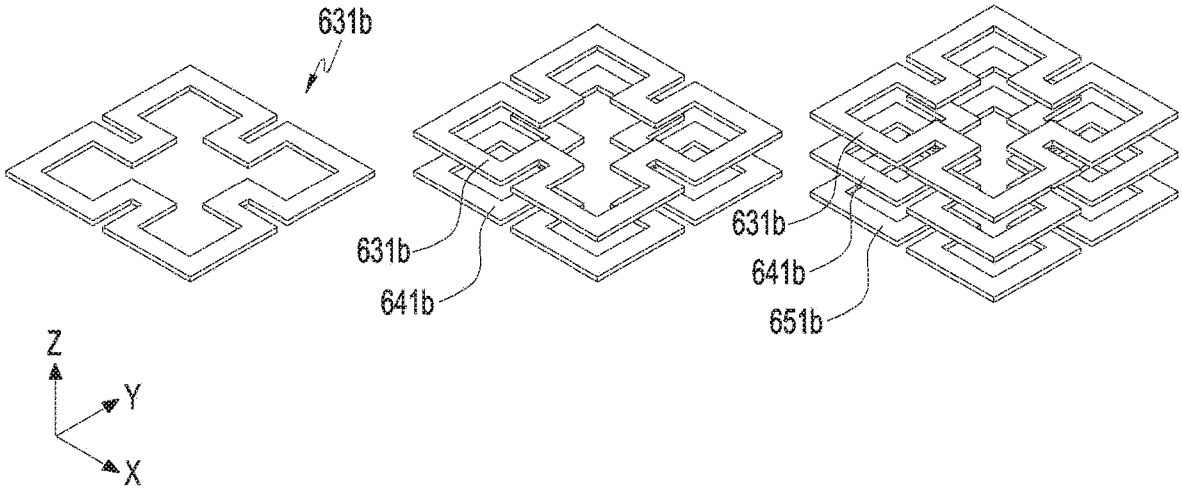
FIGS. 13A, 13B, and 13C are perspective views illustrating a stacked structure of conductive cells including a second meandering cell illustrated in FIG. 12B according various embodiments of the disclosure.

FIGS. 13A, 13B, and 13C are perspective views illustrating stacked structures of conductive cells including a second meandering cell illustrated in FIG. 12B according to various embodiments of the disclosure. The conductive cell 631*b* illustrated in FIG. 12B may be referred to as a "second meandering conductive cell 631*b*".

Referring to FIG. 13A, it may be applied to the embodiment with a single-layer periodic structure in FIG. 5A, FIG. 13B may be applied to the embodiment with a multi-layer periodic structure in FIG. 7, and FIG. 13C may be applied to the embodiment with another multi-layer periodic structure in FIG. 9. The stacked structures of conductive cells illustrated in FIGS. 13A to 13C may be applied to various other embodiments.

According to various embodiments of the disclosure, when the shape and size of the conductive cell 631*b* are specified, conductive cells 631*b* may be disposed in multiple layers, so that a periodic structure including the conductive cells 631*b* may have a high impedance in a specific frequency band, as illustrated in FIGS. 13B and 13C. It is to be noted herein that the conductive cells illustrated in FIGS. 13A to 13C are not spaced from each other by as much as shown, but may be very close to each other.

Figure 14:
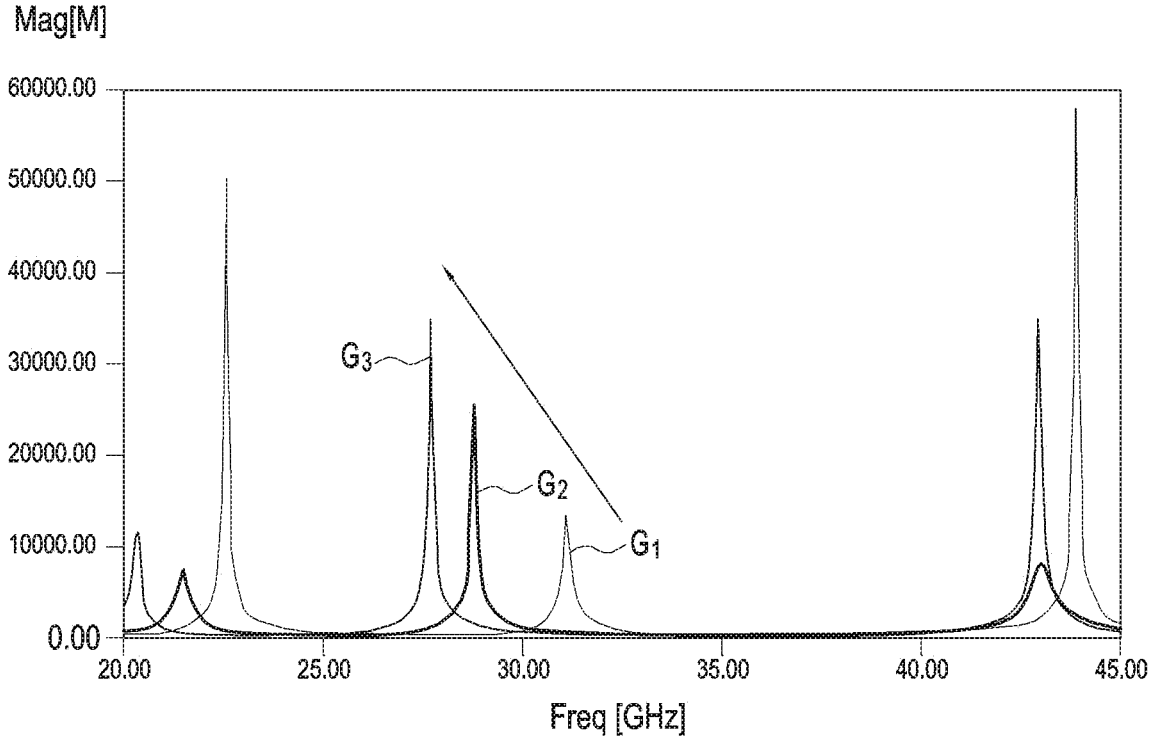
FIG. 14 is a graph illustrating magnitudes of impedances of various conductive cells in various frequency bands illustrated in FIGS. 13A to 13C according to an embodiment of the disclosure.

FIG. 14 is a graph illustrating magnitudes of impedances in various frequency bands in stacked structures of conductive cells illustrated in FIGS. 13A to 13C according to an embodiment of the disclosure.

Impedance measurements in an embodiment with the conductive cell 631*b* illustrated in FIG. 13A, an embodiment with the stacked structure of conductive cells 631*b* and 641*b* illustrated in FIG. 13B, and an embodiment with the stacked structure of conductive cells 631*b*, 641*b*, and 651*b* illustrated in FIG. 13C are represented along an arrowed direction of FIG. 14.

Referring to FIG. 14, an antenna device to which the conductive cell 631*b* illustrated in FIG. 13A is applied (for example, the antenna device 400 in FIG. 5A) may have impedances in the vicinity of a certain frequency band (for example, 25 GHz to 35 GHz) on a curve G1, and an antenna device to which the conductive cells 631*b* and 641*b* illustrated in FIG. 13B are applied (for example, the antenna device 500 in FIG. 9) may have impedances in the vicinity of a certain frequency band (for example, 25 GHz to 30 GHz) on a curve G2. Further, an antenna device to which the conductive cells 631*b*, 641*b* and 651*b* illustrated in FIG. 13C are applied (for example, the antenna device 500 in FIG. 9) may have impedances in the vicinity of a certain frequency band (for example, 25 GHz to 30 GHz) on a curve G3. It may be noted from FIG. 14 that a frequency band decreases and an impedance magnitude gradually increases in the order of the embodiment with the conductive cell 631*b* illustrated in FIG. 13A, the embodiment with the stacked structure of the conductive cells 631*b* and 641*b* illustrated in FIG. 13B, and the embodiment with the stacked structure of the conductive cells 631*b*, 641*b* and 651*b* illustrated in FIG. 13C. According to an embodiment of the disclosure, impedance may increase with the number of stacked conductive cells. However, when too many conductive cells are stacked, it is difficult to miniaturize the antenna device 400. Accordingly, an appropriate number of conductive cells should be stacked according to a required specification of the antenna device 400. For reference, the frequency bands specified in the above embodiment may vary according to embodiments of the disclosure.

Figures 15A, 15B, 15C:
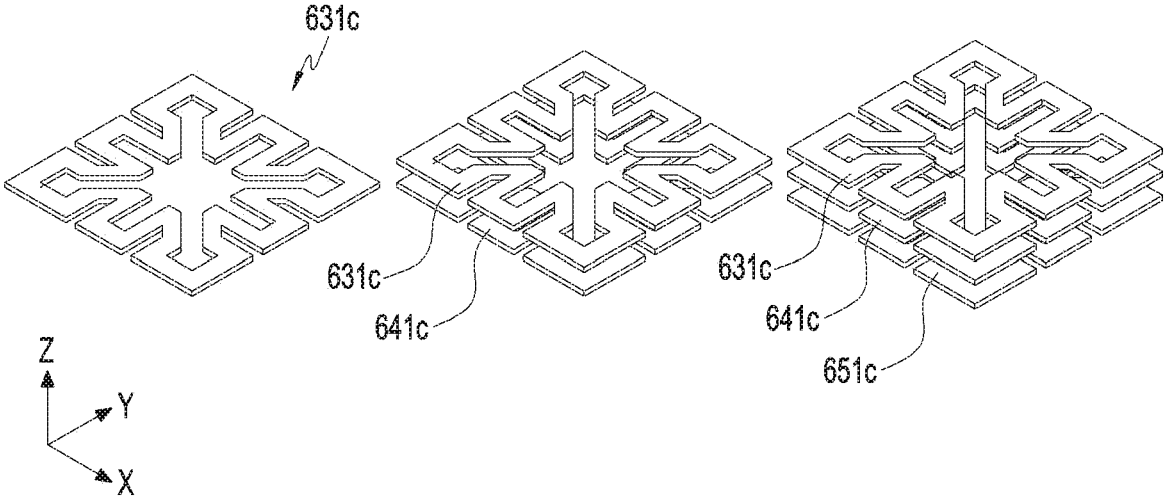
FIGS. 15A, 15B, and 15C are perspective views illustrating a stacked structure of conductive cells including a third meandering cell illustrated in FIG. 12C according to various embodiments of the disclosure.

FIGS. 15A, 15B, and 15C are perspective views illustrating stacked structures of conductive cells including a third meandering cell illustrated in FIG. 12C according to various embodiments of the disclosure. The conductive cell 631*c* illustrated in FIG. 12C may be referred to as a "third meandering conductive cell 631*c*".

FIG. 15A, may be applied to the embodiment with a single-layer periodic structure in FIG. 5A, FIG. 15B may be applied to the embodiment with a multi-layer periodic structure in FIG. 7, and FIG. 15C may be applied to the embodiment with another multi-layer periodic structure in FIG. 9. The stacked structures of conductive cells illustrated in FIGS. 15A to 15C may be applied to various other embodiments.

Figure 16:
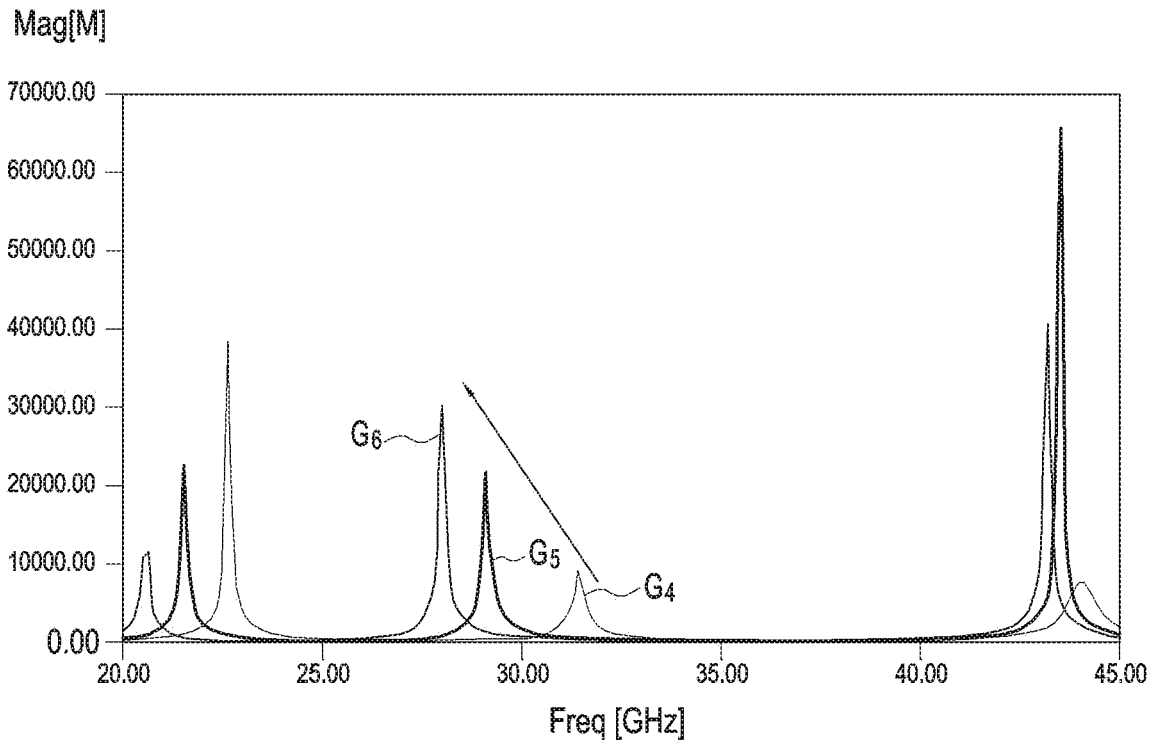
FIG. 16 is a graph illustrating magnitudes of impedances of various conductive cells in various frequency bands in a stacked structure of conductive cells illustrated in FIGS. 15A to 15C according to an embodiment of the disclosure.

FIG. 16 is a graph illustrating magnitudes of impedances in various frequency bands in stacked structures of conductive cells illustrated in FIGS. 15A to 15C according to an embodiment of the disclosure.

Referring to FIG. 15A, impedance measurements in an embodiment with the conductive cell 631*c* is illustrated, referring to FIG. 15B, an embodiment with the stacked structure of conductive cells 631*c* and 641*c* is illustrated, and referring to FIG. 15C, an embodiment with the stacked structure of conductive cells 631*c*, 641*c*, and 651*c* is illustrated and are represented along an arrowed direction of FIG. 16.

Referring to FIG. 16, an antenna device to which the conductive cell 631*c* illustrated in FIG. 13C is applied (for example, the antenna device 400 in FIG. 5A) may have impedances in the vicinity of a certain frequency band (for example, 25 GHz to 35 GHz) on a curve G4, and an antenna device to which the conductive cells 631*c* and 641*c* illustrated in FIG. 15B are applied (for example, the antenna device 500 in FIG. 9) may have impedances in the vicinity of a certain frequency band (for example, 25 GHz to 30 GHz) on a curve G5. Further, an antenna device to which the conductive cells 631*c*, 641*c* and 651*c* illustrated in FIG. 15C are applied (for example, the antenna device 500 in FIG. 9) may have impedances in the vicinity of a certain frequency band (for example, 25 GHz to 30 GHz) on a curve G6. It may be noted from FIG. 16 that a frequency band decreases and an impedance magnitude gradually increases in the order of the embodiment with the conductive cell 631*c* illustrated in FIG. 15A, the embodiment with the stacked structure of the conductive cells 631*c* and 641*c* illustrated in FIG. 15B, and the embodiment with the stacked structure of the conductive cells 631*c*, 641*c* and 651*c* illustrated in FIG. 15C.

A comparison between FIG. 14 and FIG. 16 reveals that the absolute value of an impedance magnitude may be larger in the stacked structures (see the curves G2 and G3) using the second meandering conductive cell having a relatively short loop than in the stacked structures using the third meandering cell having a relatively long loop (see the curves G5 and G6).

Figure 17:
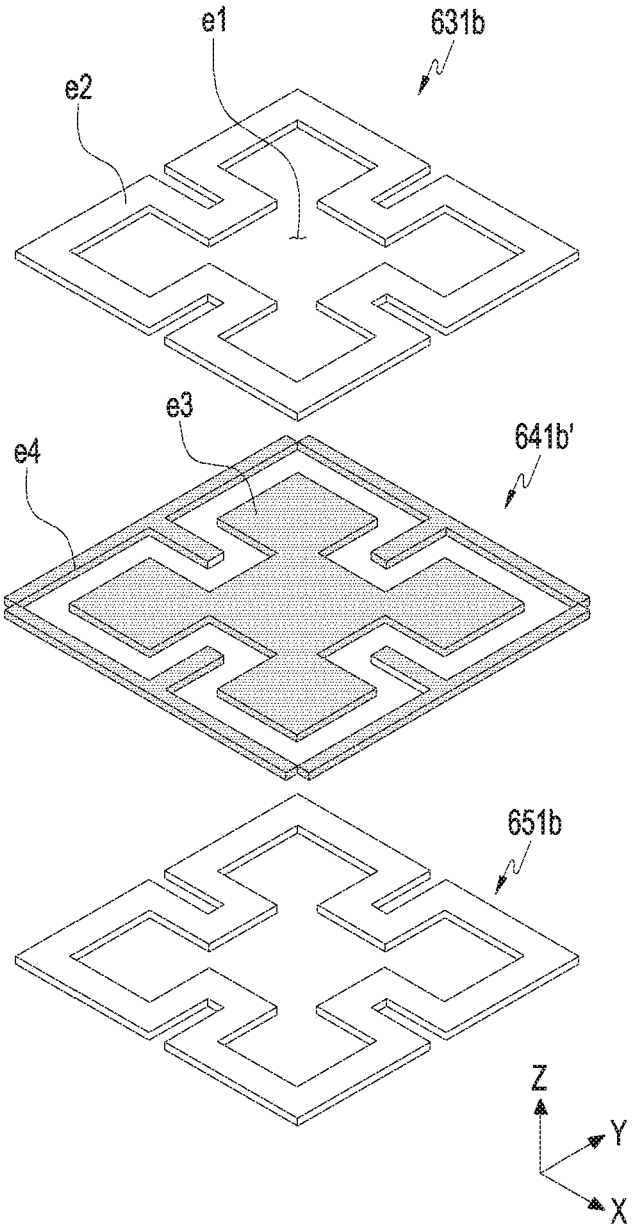
FIG. 17 illustrates a stacked structure of meandering conductive cells different from those of FIGS. 13A to 13C and 15A to 15C according to an embodiment of the disclosure.

FIG. 17 illustrates a stacked structure of meandering conductive cells different from those of FIGS. 13A to 13C and 15A to 15C according to an embodiment of the disclosure.

Referring to FIG. 17, according to various embodiments of the disclosure, two different conductive cells located in a mutually stacked direction (for example, the Z-axis direction) among a plurality of conductive cells included in an antenna device (for example, the antenna device 500 in FIG. 9) may at least partially overlap with each other.

According to an embodiment of the disclosure, the first conductive cell 631*b* and the second conductive cell 641*b* may be formed in the same pattern and size, as illustrated in FIGS. 13A to 13C. When it is said that the first conductive cell 631*b* and the second conductive cell 641*b* have the same pattern, this may imply that the first conductive cell 631*b* and the second conductive cell 641*b* are in a predetermined form or shape. For example, different conductive cells located adjacent to each other in a height direction (for example, the Z-axis direction in FIGS. 13A to 13C) may be formed in substantially the same pattern and size and stacked with each other.

According to another embodiment of the disclosure, the first conductive cell 631*b* and the second conductive cell 641*b*' may be formed in different patterns (or sizes) as illustrated in FIG. 17. For example, different conductive cells located adjacent to each other in a height direction (for example, the Z-axis direction in FIG. 17) may be formed in different patterns and stacked with each other.

In an antenna device with three conductive cells stacked therein (for example, the antenna device 500 in FIG. 9), for example, the first conductive cell 631*b* and the third conductive cell 651*b* may be in the same pattern, whereas the second conductive cell 641*b*' may be in a different pattern, as illustrated in FIG. 17. However, the conductive cells having different patterns are not necessarily limited to adjacent cells. For example, unlike FIG. 17, the first conductive cell and the second conductive cell may have the same pattern, whereas the third conductive cell may have a different pattern. According to another embodiment of the disclosure, all of the three conductive cells may be formed in different patterns. Aside from these embodiments of the disclosure, various other embodiments may be applied.

In a structure in which a plurality of conductive cells is stacked, the pattern of a conductive cell on one layer may be different from the pattern of a conductive cell on another layer. However, in the structure in which the plurality of conductive cells are stacked, the conductive cell on the one layer may overlap at least partially with the conductive cell on the other layer, when viewed from above the antenna device (for example, the antenna device 500 in FIG. 9). According to various embodiments of the disclosure, when viewed from above the plurality of conductive cells, the plurality of conductive cells may be electromagnetically coupled in the at least partially overlapped state.

According to various embodiments of the disclosure, in a structure in which a plurality of conductive cells is stacked, a conductive cell on one layer may be an inversed shadow coupling type with respect to a conductive cell on at least one other layer. The inverted shadow coupling type may refer to the pattern of a conductive cell obtained by inverting another conductive cell located in a height direction, which is at least partially overlapped with the conductive cell.

Referring to FIG. 17, when a first conductive cell 631*b* forms one loop structure, a second conductive cell 641*b*' inverted from the first conductive cell 631*b* may be provided with at least one segmentation part, and thus include sub-cells divided by the segmentation part.

According to an embodiment of the disclosure, a second sub-cell e4 of the second conductive cell 641*b*' may be meandering in correspondence with the meandering shape of a loop e2 of the first conductive cell 631*b*. Further, a first sub-cell e3 of the second conductive cell 641*b*' may be meandering in correspondence with the shape of an opening e1 of the first conductive cell 631*b*. For example, when the first conductive cell 631*b* is formed into the loop e2 surrounding the opening e1 at the center, the second conductive cell 641*b*' may include the first sub-cell e3 located in correspondence with the opening e1, and the second sub-cell e4 located in correspondence with the loop e2. In another example, when the second conductive cell 641*b*' is viewed from above the first conductive cell 631*b*, the second conductive cell 641*b*' may have a sub-cell structure in which the shadow of the first conductive cell 631*b* is formed in a space between the first cell e3 and the second sub-cell e4.

Figure 18:
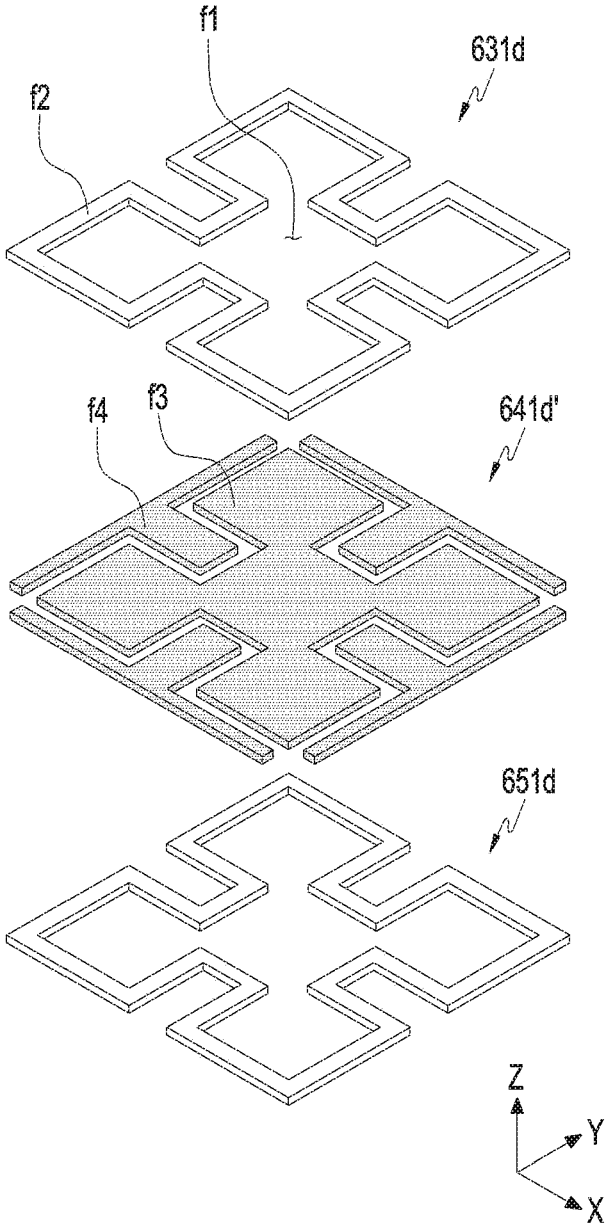
FIG. 18 illustrates a stacked structure of meandering conductive cells different from those of FIGS. 13A to 13C and 15A to 15C according to an embodiment of the disclosure.

FIG. 18 illustrates a stacked structure of meandering conductive cells different from that of FIGS. 13A to 13C and 15A to 15C according to an embodiment of the disclosure. A description of the embodiment of FIG. 18 redundant with the description of the embodiment illustrated in FIG. 17 will not be provided herein.

Referring to FIG. 18, when the first conductive cell 631*d* forms one loop structure, the second conductive cell 641*d*' inverted from the first conductive cell 631*d* may be provided with at least one segmentation part, and thus include sub-cells divided by the segmentation part. For example, the first conductive cell 631*d* may be formed into a loop f2 surrounding an opening f1 at the center. The second conductive cell 641*d*' may include a first sub-cell f3 located in correspondence with the opening f1, and a second sub-cell f4 located in correspondence with the loop f2.

According to various embodiments of the disclosure, when it is said that the first conductive cell 631*b* illustrated in FIG. 17 is formed in a first pattern, it may be said that the first conductive cell 631*d* illustrated in FIG. 18 is formed in a second pattern. The thickness of the loop f2 of the second pattern may be smaller than the thickness of the loop e2 of the first pattern. Because the second pattern has a thinner loop than the first pattern, the space formed by the opening f1 of the second pattern may be larger than the space formed by the opening e1 of the first pattern. Therefore, in the stacked structure of the conductive cell of the second pattern, the area of the first sub-cell f3 of the second conductive cell 641*d*' may be large, relative to the area of the first sub-cell e3 having the first pattern.

Figure 19:
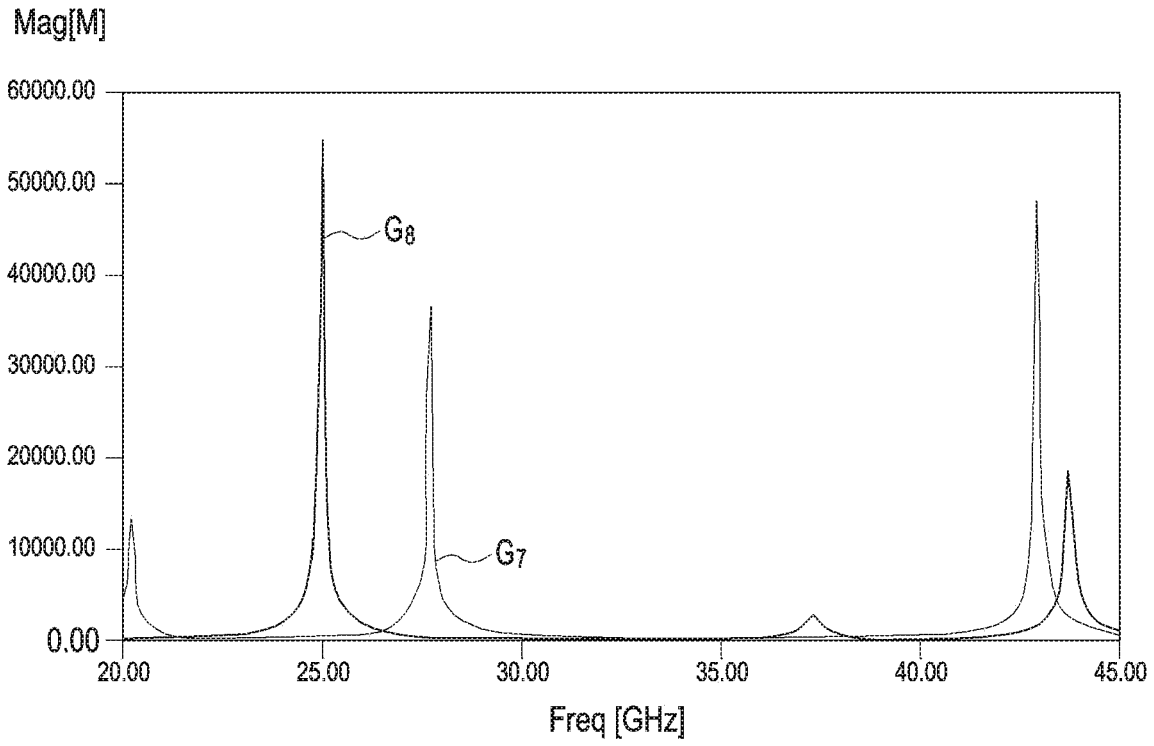
FIG. 19 is a graph comparing impedances of antenna devices to which stacked structures of meandering conductive cells illustrated in FIGS. 17 and 18 are applied according to an embodiment of the disclosure.

FIG. 19 is a graph comparing impedances of an antenna device to which stacked structures of meandering conductive cells illustrated in FIGS. 17 and 18 are applied according to an embodiment of the disclosure.

Referring to FIG. 19, along an arrowed direction, a curve G7 may represent impedance measurements in an embodiment with the conductive cell stacked structure illustrated in FIG. 17, and a curve G8 may represent impedance measurements in an embodiment with the conductive cell stacked structure illustrated in FIG. 18.

Referring to FIG. 19, an antenna device to which the stacked structure of the conductive cells 631*b*, 641*b*', and 651*b* illustrated in FIG. 17 is applied (for example, the antenna device 500 in FIG. 9) may have impedances on the curve G7 in the vicinity of a certain frequency band (for example, 25 GHz to 30 GHz), and an antenna device to which the stacked structure of the conductive cells 631*d*, 641*d*', and 651*d* illustrated in FIG. 18 is applied (for example, the antenna device 500 in FIG. 9) may have impedances on the curve G8 in the vicinity of a certain frequency band (for example, 25 GHz to 30 GHz).

As illustrated in FIGS. 17 and 18, an antenna device (for example, the antenna device 500 in FIG. 9) according to various embodiments of the disclosure may provide the second conductive cells 641*b*' and 641*d*' which are the inversed shadow coupling types of the first conductive cells 631*b* and 631*d*. According to the embodiments illustrated in FIGS. 17 and 18 in which the antenna device (for example, the antenna device 500 in FIG. 9) includes the second conductive cells 641*b*' and 641*d*' of the inversed shadow coupling type, as the area of the opening formed by each of the first conductive cells 631*b* and 631*d* is larger (the area of e1> the area of f1), a larger conductive cell (the total area of the second conductive cell 641*b*'< the total area of the second conductive cell 641*d*') may be formed. It may be noted from FIG. 19 that as a conductive cell of an inversed shadow coupling type (e.g., the second conductive cell 641*d*' in FIG. 18) is larger in area, a higher-impedance antenna device (for example, the antenna device 500 in FIG. 9) may be formed in some embodiments of the disclosure.

Figure 20:
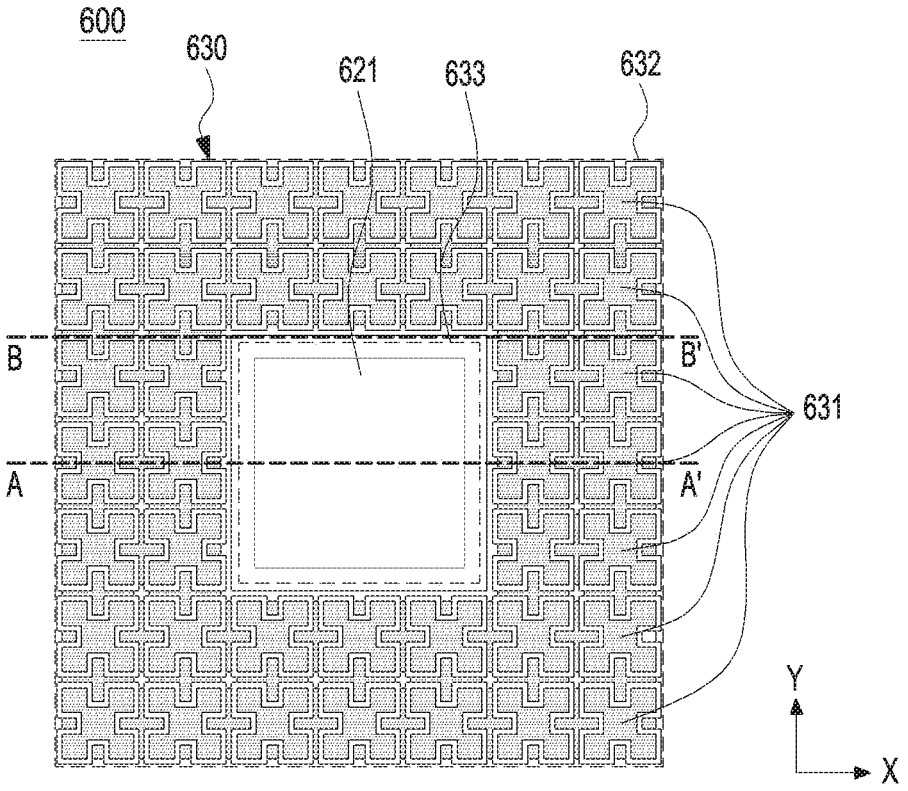
FIG. 20 is a diagram illustrating an antenna device viewed from above a third layer according to an embodiment of the disclosure.

FIG. 20 is a diagram illustrating an antenna device viewed from above a third layer according to an embodiment of the disclosure.

Figure 21:
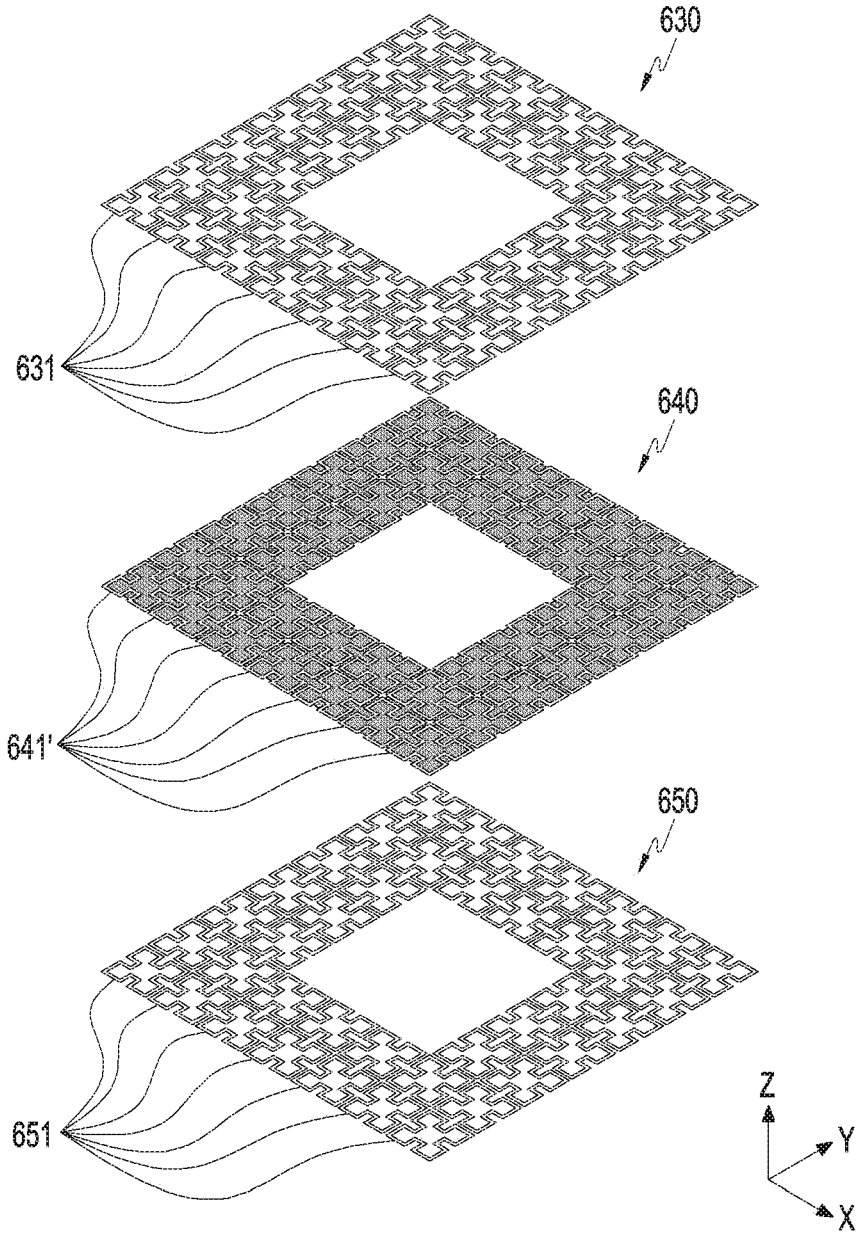
FIG. 21 is a perspective view illustrating a plurality of periodic structures each including a plurality of conductive cells according to an embodiment of the disclosure.

FIG. 21 is a perspective view illustrating a plurality of periodic structures each including a plurality of conductive cells according to an embodiment of the disclosure.

Referring to FIG. 20, when viewed from above the antenna device 600, the antenna device 600 may include a plurality of first conductive cells 631 arranged in a first area 632 (for example, the first area 532 in FIG. 8A) and an antenna element 621 disposed in a second area 633 (for example, the second area 533 in FIG. 8A).

Referring to FIGS. 20 and 21 together, the antenna device 600 may include the third area 630 including the plurality of first conductive cells 631, a fourth layer 640 including a plurality of second conductive cells 641', and/or a fifth layer including a plurality of third conductive cells 651. According to an embodiment of the disclosure, the second conductive cells 641' may be the inversed shadow coupling type of the first conductive cells 631. The plurality of second conductive cells 641' may overlap at least partially with the periodic structure formed by the plurality of first conductive cells 631, and may have a periodic structure inverted from the periodic structure formed by the plurality of first conductive cells 631, on the whole.

Referring to FIGS. 20 and 21 together, when the antenna device 600 is viewed from above, the periodic structure of the fourth layer 640 may be shown as overlapped with the empty space (or opening) of the periodic structure of the third layer 630.

Figure 22:
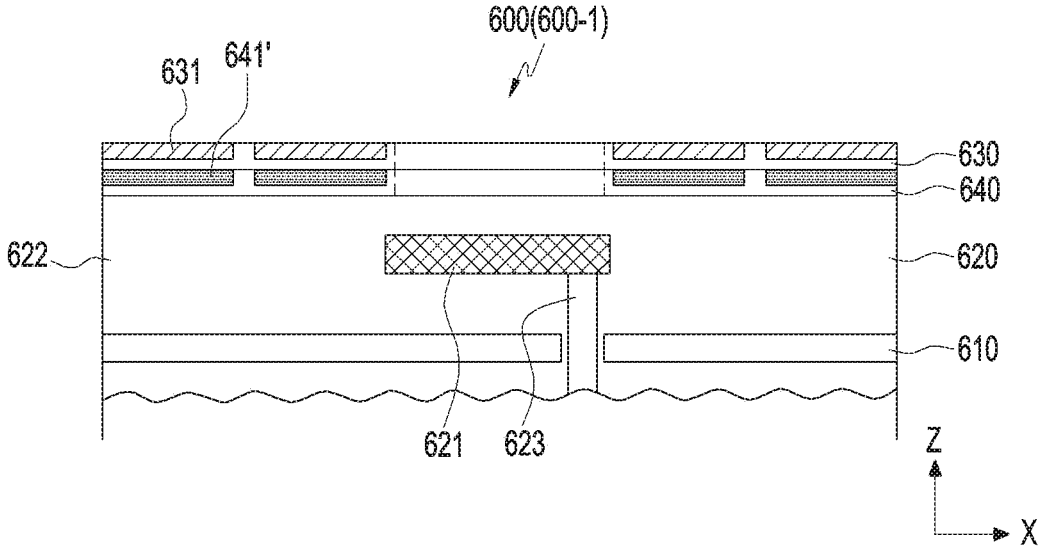
FIG. 22 is a sectional view illustrating an antenna device in which meandering conductive cells of different patterns are stacked according to an embodiment of the disclosure.

FIG. 22 is a sectional view illustrating an antenna device in which meandering conductive cells of different patterns are stacked according to an embodiment of the disclosure.

Figure 23:
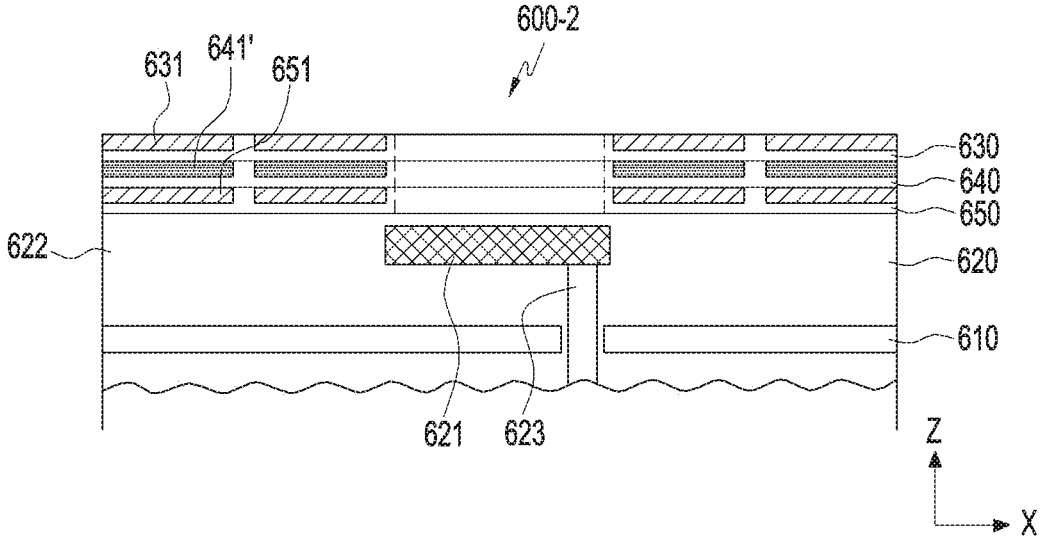
FIG. 23 is a sectional view illustrating an antenna device in which meandering conductive cells of different patterns are stacked different from that of FIG. 22 according to an embodiment of the disclosure.

FIG. 23 is a sectional view illustrating an antenna device in which meandering conductive cells of different patterns are stacked according to an embodiment of the disclosure. FIGS. 22 and 23 may illustrate cross-sections of the antenna device 600 according to the embodiment illustrated in FIG. 20, taken along line A-A'.

Referring to FIGS. 22 and 23 together, each of the antenna devices 600-1 and 600-2 according to various embodiments of the disclosure may include a first layer 610, the second layer 620, and/or the third layer 630. According to an embodiment of the disclosure, the first layer 610 may include a ground layer, and the second layer 620 may include the antenna element 621, a dielectric 622 surrounding at least a part of the antenna element 621, and at least a part of a power feeding line 623. According to an embodiment of the disclosure, the third layer 630 may include a plurality of first conductive cells 631.

Referring to FIG. 22, the antenna device 600-1 according to various embodiments of the disclosure may further include the fourth layer 640 stacked with the first, second and third layers 610, 620 and 630 and having a plurality of second conductive cells 641 formed therein.

Referring to FIG. 23, the antenna device 600-2 according to various embodiments of the disclosure may further include a fifth layer 650. The fifth layer 650 may include a plurality of third conductive cells 651 thereon. Although the plurality of third conductive cells 651 are shown as having a periodic structure similar to that of the first conductive cells 631, the disclosure is not limited thereto.

According to various embodiments of the disclosure, the plurality of first conductive cells 631 formed on the third layer 630 may form a periodic structure, and the plurality of second conductive cells 641' formed on the fourth layer 640 may also form a periodic structure. According to an embodiment of the disclosure, the plurality of first conductive cells 631 may form a first periodic structure, whereas the plurality of second conductive cells 641 may form a second periodic structure which is the inversed shadow of the periodic structure of the first conductive cells 631.

Referring to FIGS. 22 and 23 together, the first periodic structure of the third layer 630 formed by the first conductive cells 631 may be stacked with the second periodic structure of the fourth layer 640 formed by the second conductive cells 641'. In the embodiment illustrated in FIGS. 22 and 23, it is to be noted that although the second periodic structure is shown as being arranged in a row with the first periodic structure in the height direction (for example, the Z-axis direction), the second periodic structure may be formed to substantially cover the inverted shadow.

Referring to FIGS. 17 to 23, a plurality of conductive cells may form a periodic structure on one layer, and at least two layers each including a plurality of such conductive cells may be stacked. A higher impedance may be obtained, when a plurality of conductive cells on at least one layer are different in terms of the pattern and/or the periodic structure from a plurality of conductive cells on an adjacent layer among a plurality of stacked layers than when a plurality of stacked layers have a plurality of conductive cells in the same pattern and/or the same periodic structure. The antenna device 600 having a high impedance may be provided through inversed shadow coupling periodic structures of two different conductive cells (for example, the first conductive cells and the second conductive cells).

Figure 24:
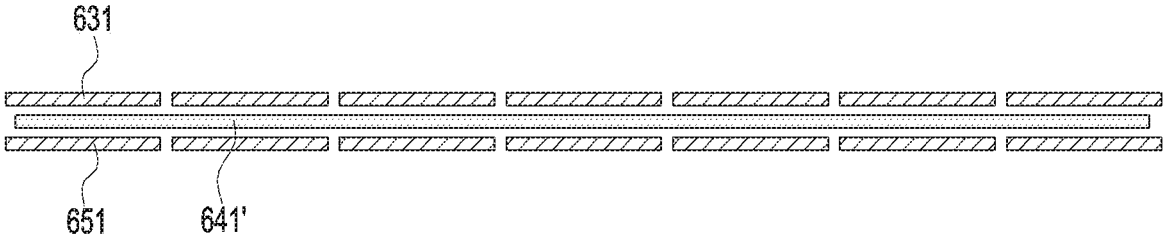
FIG. 24 is a conceptual view illustrating a second conductive cell extended in a plane direction illustrated in FIG. 23 according to an embodiment of the disclosure.

FIG. 24 is a conceptual view illustrating a second conductive cell extended in a place direction according to an embodiment of the disclosure. FIG. 24 may illustrate the stacked layers of the periodic structure in the cross-section of the antenna device 600 according to the embodiment illustrated in FIG. 20, along line B-B'.

Referring to FIG. 24, an antenna device (for example, the antenna device 600 in FIG. 20) according to various embodiments of the disclosure may include a period structure in which the second conductive cells 641' are extended on the fourth layer (for example, in the plane direction of the fourth layer 640 in FIG. 23, such as the X-axis direction in FIG. 23).

Figure 25:
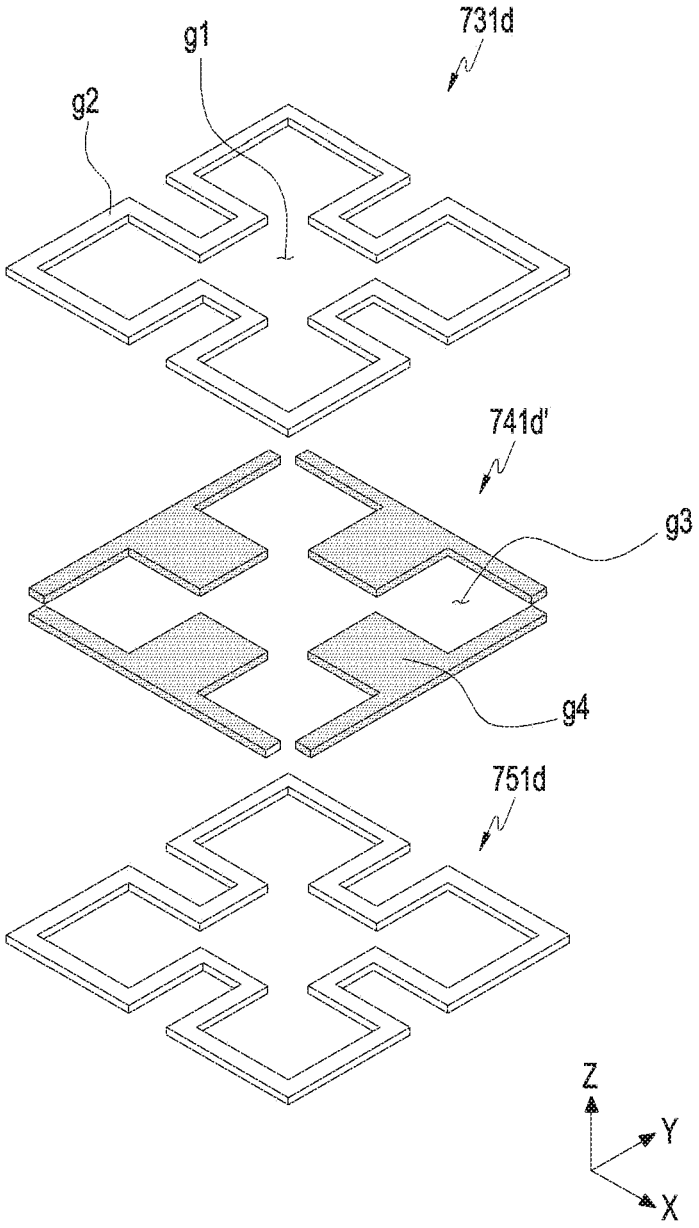
FIG. 25 is a diagram illustrating a stacked structure of conductive cells different from those of FIGS. 17 and 18 according to an embodiment of the disclosure.
Figure 26:
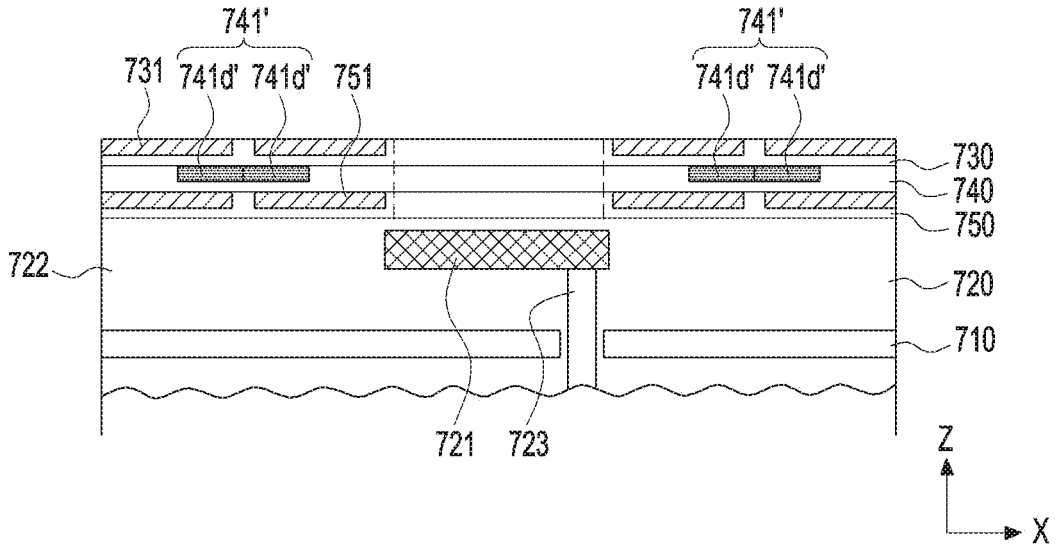
FIG. 26 is a sectional view illustrating an antenna device in which meandering conductive cells illustrated in FIG. 25 are stacked according to an embodiment of the disclosure.
Figure 27:
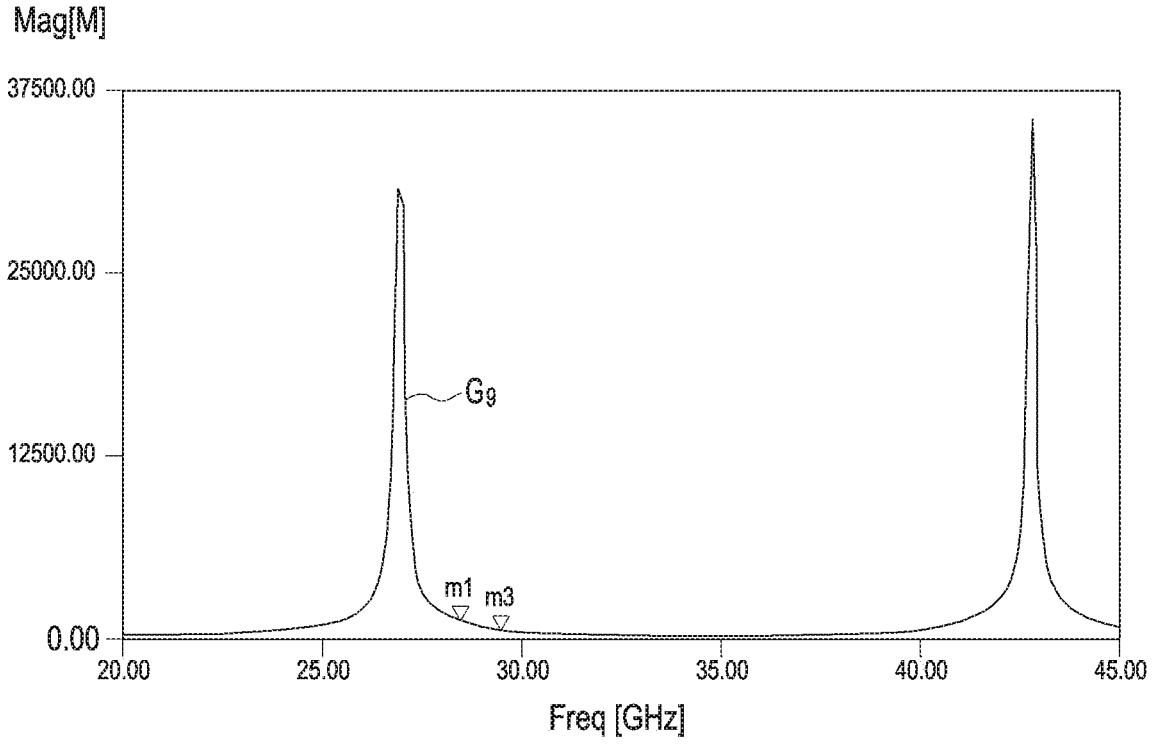
FIG. 27 is a graph illustrating impedances of an antenna device in various frequency bands, which includes a stacked structure of conductive cells illustrated in FIG. 25 according to an embodiment of the disclosure.

While the second conductive cells 641' are shown as integrally extended in FIG. 24, the second conductive cells **641*d*' have segmentation parts at their vertexes as illustrated in FIGS. 17 and 18, so that adjacent conductive cells form conductive island structures spaced from each other. FIG. 25 is a diagram illustrating a stacked structure of meandering conductive cells 731*d*, 741*d*', and 751*d* according to an embodiment different from the embodiments illustrated in FIGS. 17 and 18. FIG. 26 is a sectional view illustrating an antenna device 700 having the meandering conductive cells stacked therein illustrated in FIG. 25 (for example, the antenna device 600 in FIG. 20). FIG. 27 is a graph illustrating impedances in various frequency bands in the antenna device having the meandering conductive cells stacked therein illustrated in FIG. 25 (for example, the antenna device 600 in FIG. 20**).

Compared to the embodiments illustrated in FIGS. 17 and 18 in which there are the first conductive cells **631*b* and 631*d* and the second conductive cells 641*b*' and 641*d*' of inversed shadow coupling types, first conductive cells 731*d* and second conductive cells 741*d*' have at least partially similar patterns in the embodiment of FIG. 25**.

FIG. 25 is a diagram illustrating a stacked structure of conductive cells different from those of FIGS. 17 and 18 according to an embodiment of the disclosure.

Referring to FIG. 25, according to the embodiment illustrated in FIG. 25, a second conductive cell **731*d*' may be shaped in correspondence with the shape of a loop g2 of a first conductive cell 731*d*. According to an embodiment of the disclosure, the second conductive cell 741*d*' may include four sub-cells g4 each including a protrusion corresponding to the shape of the loop g2 of the first conductive cell 731*d*, for example, an inlet part of the first conductive cell 731*d* (or an inward protrusion of the first conductive cell 731*d***).

FIG. 26 is a sectional view illustrating an antenna device in which meandering conductive cells illustrated in FIG. 25 are stacked according to an embodiment of the disclosure.

Referring to FIG. 26, the antenna device 700 according to various embodiments of the disclosure may include a first layer 710, a second layer 720, and/or a third layer 730. According to an embodiment of the disclosure, the second layer 720 may include an antenna element 721, a dielectric 722 surrounding at least a part of the antenna element 721, and at least a part of a power feeding line 723. According to an embodiment of the disclosure, the third layer 730 may include a plurality of first conductive cells 731. The first conductive cells 731 illustrated in FIG. 26 may have a substantially identical configuration to that of the first conductive cells **731*d* having the pattern illustrated in FIG. 25. When there is a plurality of first conductive cells 731*d* illustrated in FIG. 25, each first conductive cell 731*d* may be arranged apart from another adjacent first conductive cell 731*d*** by a predetermined distance.

According to an embodiment of the disclosure, the antenna device 700 may further include a fifth layer 750 and a fourth layer 740, and the fourth layer 740 may include a plurality of second conductive cells **741*d*' illustrated in FIG. 25, thus forming a periodic structure. The second conductive cells 741*d*' of FIG. 26 may be substantially the same as the second conductive cells 741*d*' having the pattern illustrated in FIG. 25. When there are a plurality of second conductive cells 741*d*' illustrated in FIG. 25, one surface of one sub-cell g4 included in a second conductive cell 741*d*' may contact a sub-cell g4 of an adjacent second conductive cell 741*d*' as illustrated in FIG. 26. According to an embodiment of the disclosure, different sub-cells g4 contacting each other on their surfaces may form substantially at least one second conductive cell 741'. In this case, the periodic structure of the second conductive cells 741' may be formed at a position corresponding to a gap between the plurality of first conductive cells 731, not at a position corresponding to the periodic structure formed by the plurality of first conductive cells 731**.

For example, the periodic structure of the second conductive cells 641' described above in the embodiments of FIGS. 22 and 23 may be formed at a position corresponding to the periodic structure of the first conductive cells 631 adjacent in the height direction (for example, the Z-axis direction) of the antenna device 600. The periodic structure of the plurality of second conductive cells **741*d*' according to the embodiment illustrated in FIGS. 25 and 26 may be formed in misalignment with the periodic structure of the first conductive cells 731*d* adjacent in the height direction (for example, the Z-axis direction) of the antenna device 700**.

FIG. 27 is a graph illustrating impedances of an antenna device in various frequency bands, which includes a stacked structure of conductive cells illustrated in FIG. 25 according to an embodiment of the disclosure.

Referring to FIG. 27, in an antenna device to which the stacked structure of the conductive cells 731*d*, 741*d*' and 751*d* illustrated in FIG. 25 is applied (for example, the antenna device 700 in FIG. 26), impedances may be formed in the vicinity of a specific frequency band (for example, 25 GHz to 30 GHz) as represented by a curve G9. It may be confirmed that even when a stacked structure including the second conductive cells 741*d*' having an at least partially similar pattern to the periodic structure of the first conductive cells 731*d* is formed, the antenna device 700 having a high impedance may be formed.

Figure 28:
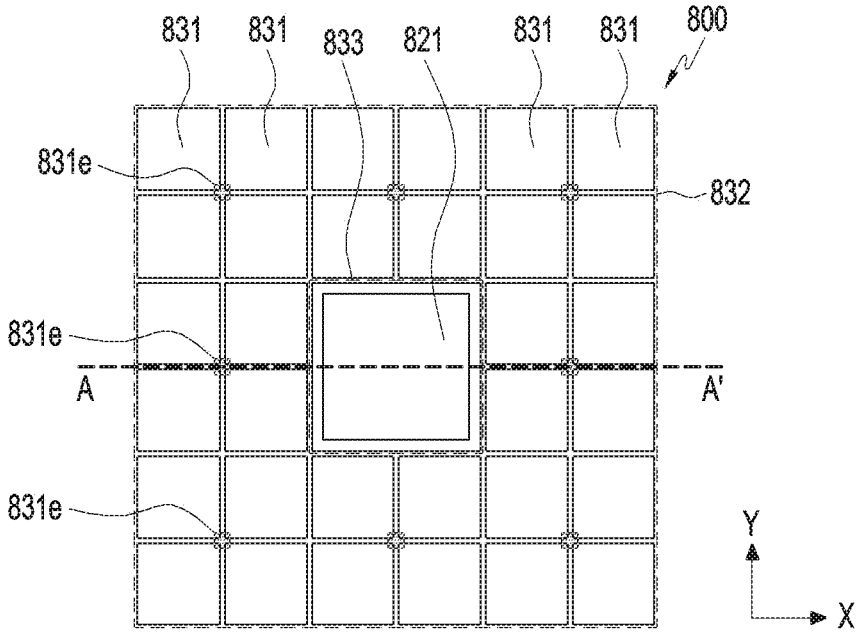
FIG. 28 is a front view schematically illustrating a periodic structure of conductive cells in an antenna device according to an embodiment of the disclosure.

FIG. 28 is a front view schematically illustrating a periodic structure of conductive cells in an antenna device according to an embodiment of the disclosure.

Figure 29A:
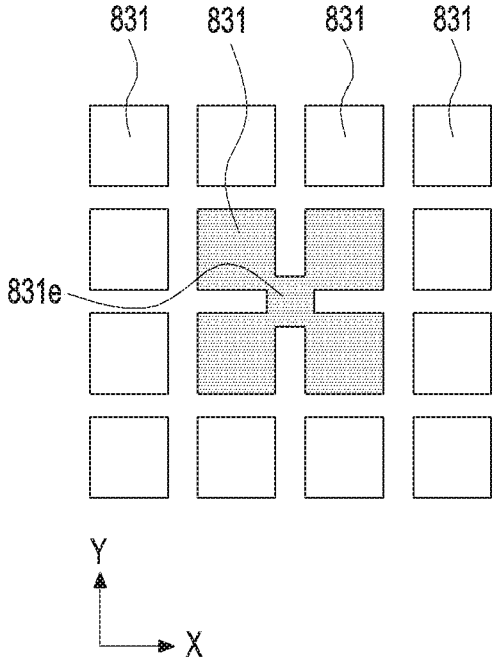
FIGS. 29A and 29B are front views schematically illustrating conductive cells in an antenna device according to various embodiments of the disclosure.
Figure 29B:
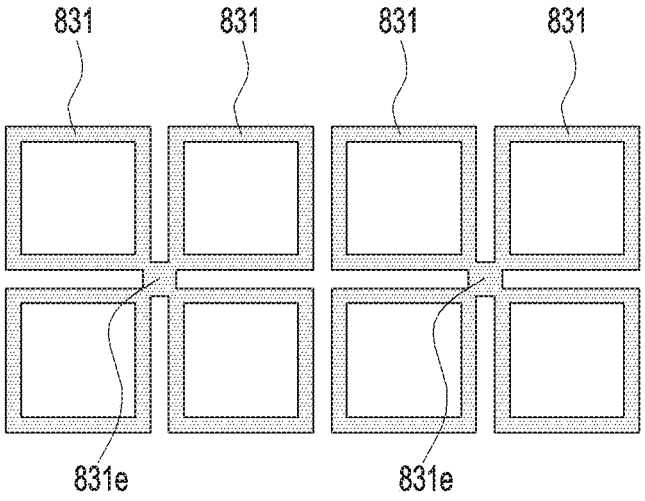

FIGS. 29A and 29B illustrate a front view of conductive cells in an antenna device according to various embodiments of the disclosure.

Figure 30:
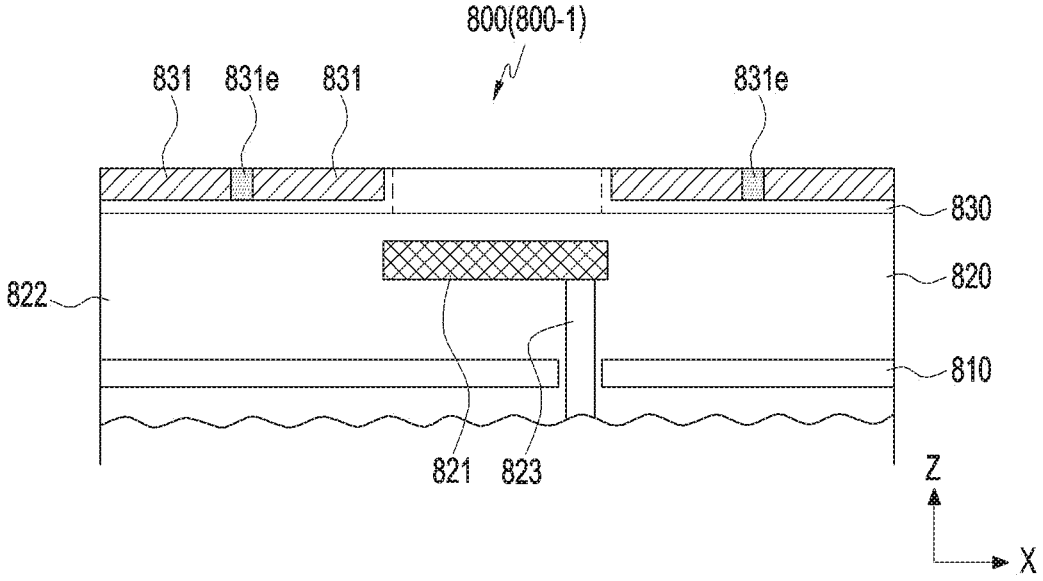
FIG. 30 is a sectional view schematically illustrating conductive cells in an antenna device according to an embodiment of the disclosure.

FIG. 30 is a sectional view schematically illustrating conductive cells in an antenna device according to an embodiment of the disclosure. The sectional view of FIG. 30 may illustrate the cross-section of the antenna device of FIG. 28, taken along line A-A'.

Referring to FIGS. 28, 29A, 29B, and 30 together, the antenna device 800 according to various embodiments of the disclosure may include a first layer 810, a second layer 820, and/or a third layer 830. According to an embodiment of the disclosure, the first layer 810 may include a ground layer, and the second layer 820 may include an antenna element 821, a dielectric 822 surrounding at least a part of the antenna element 821, and at least a part of a power feeding line 823. According to an embodiment of the disclosure, the third layer 830 may include a plurality of first conductive cells 831 and a second area 833 at least partially surrounded by the first area 832.

One of the plurality of first conductive cells 831 may be disposed apart from an adjacent first conductive cell 831 by a predetermined distance on the third layer 830. According to an embodiment of the disclosure, the plurality of first conductive cells 831 may be arranged at equal intervals from each other. According to an embodiment of the disclosure, the plurality of first conductive cells 831 may form a first periodic structure.

Referring to FIGS. 28, 29A, and 29B, the plurality of first conductive cells 831 may be arranged side by side on one layer. Each first conductive cell 831 may form a gap with other adjacent first conductive cells 831, and the antenna device 800 may further include a connection member 831*e* which fills at least a part of the gap and connect at least two first conductive cells 831 to each other. For example, in the embodiment of FIG. 28, the connection member 831*e* is shown as connecting four adjacent first conductive cells 831 to each other.

According to an embodiment of the disclosure, a plurality of first conductive cells 831 forming a periodic structure on one layer may be connected to other adjacent first conductive cells 831 by a connection member 831*e* and thus grouped. According to various embodiments of the disclosure, the connection member 831*e* may be formed on parts (for example, edges or corners) of the first conductive cells 831. According to an embodiment of the disclosure, the connection member 831*e* may be integrally formed with the first conductive cells 831. In this manner, a group of first conductive cells 831 may form a substantially new meandering conductive cell having a larger size.

The plurality of first conductive cells 831 on the third layer 830 of the antenna device 800 form a periodic structure in a first area 832, and at least two first conductive cells 831 of the periodic structure may be electrically coupled to each other by a connection member 831*e*.

According to an embodiment of the disclosure, when the size of the first conductive cells 831 is excessively small and thus it is difficult to secure desired radiation performance for the antenna device 800, at least two first ones out of the plurality of first conductive cells 831 may be electrically coupled to each other, so that at least a part of the plurality of first conductive cells 831 may be grouped.

For example, as in the embodiment illustrated in FIG. 29A, only a part of the plurality of first conductive cells 831 arranged on one layer may be selectively grouped, or as in the embodiment illustrated in FIG. 29B, all of the plurality of conductive cells 831 arranged on one layer may be grouped.

Referring to FIG. 30, a plurality of first conductive cells 831 disposed on the third layer 830 may be interconnected by a connection member 831*e*. According to an embodiment of the disclosure, the connection member 831*e* may be located on the same layer as the first conductive cells 831.

While the antenna device 800 according to the embodiment illustrated in FIGS. 28, 29A, 29B, and 30 (hereinafter, referred to as an "antenna device 800-1" distinguishable from the antenna device of FIG. 31) includes the first layer 810, the second layer 820, and the third layer 830, the antenna device 800 may include more other layers (for example, a fourth layer and a fifth layer).

Figure 31:
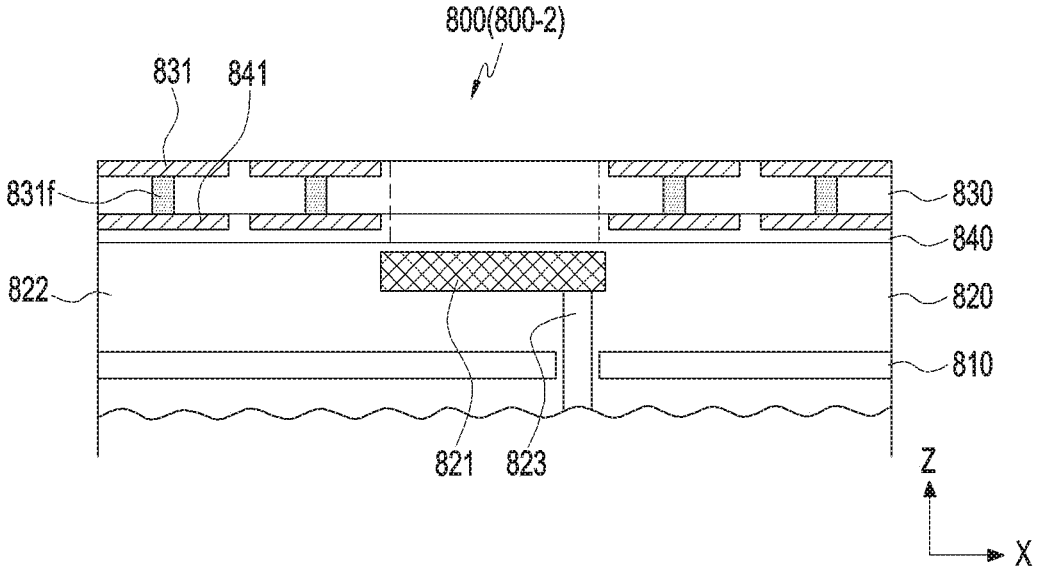
FIG. 31 is a sectional view schematically illustrating conductive cells in an antenna device different from that of FIG. 30 according to an embodiment of the disclosure.

FIG. 31 is a sectional view schematically illustrating conductive cells in an antenna device according to an embodiment of the disclosure. FIG. 31 may illustrate an embodiment of connecting different conductive cells in a different manner from in FIGS. 29A and 29B.

Referring to FIG. 31, the antenna device 800-2 according to various embodiments of the disclosure may include the first layer 810, the second layer 820, the third layer 830, and the fourth layer 840 stacked with the first, second and third layers 810, 820 and 830. While the fourth layer 840 is shown in FIG. 31 as disposed between the second layer 820 and the third layer 830, the position of the fourth layer 840 is not limited thereto. According to an embodiment of the disclosure, the first layer 810 may include a ground layer, and the second layer 820 may include the antenna element 821, the dielectric 822 surrounding at least a part of the antenna element 821, and at least a part of the power feeding line 823. According to an embodiment of the disclosure, the third layer 830 may include a plurality of first conductive cells 831, and the fourth layer 840 may include a plurality of second conductive cells 841.

As illustrated in FIG. 31, the plurality of first conductive cells 831 of the third layer 830 and the plurality of second conductive cells 841 of the fourth layer 840 may be arranged apart from each other by a predetermined distance in a stacked direction (for example, the Z-axis direction). Further, the first conductive cells 831 and the second conductive cells 841 may be electrically coupled to each other by connection members 831*f*. According to an embodiment of the disclosure, each of the connection members 831*f* may include, for example, a conductive via.

The antenna device 800-2 according to various embodiments of the disclosure may further include the connection members 831*f* to electrically couple the conductive cells disposed on different layers. According to an embodiment of the disclosure, periodic structures located on different layers each including a plurality of conductive cells may be coupled to each other by the connection members 831*f*.

When the embodiments of FIGS. 28, 29A, 29B, 30, and 31 are considered comprehensively, various frequency bands provided by the antenna device 800-2 may be configured by using the connection members 831*e* and 831*f*.

Figure 32:
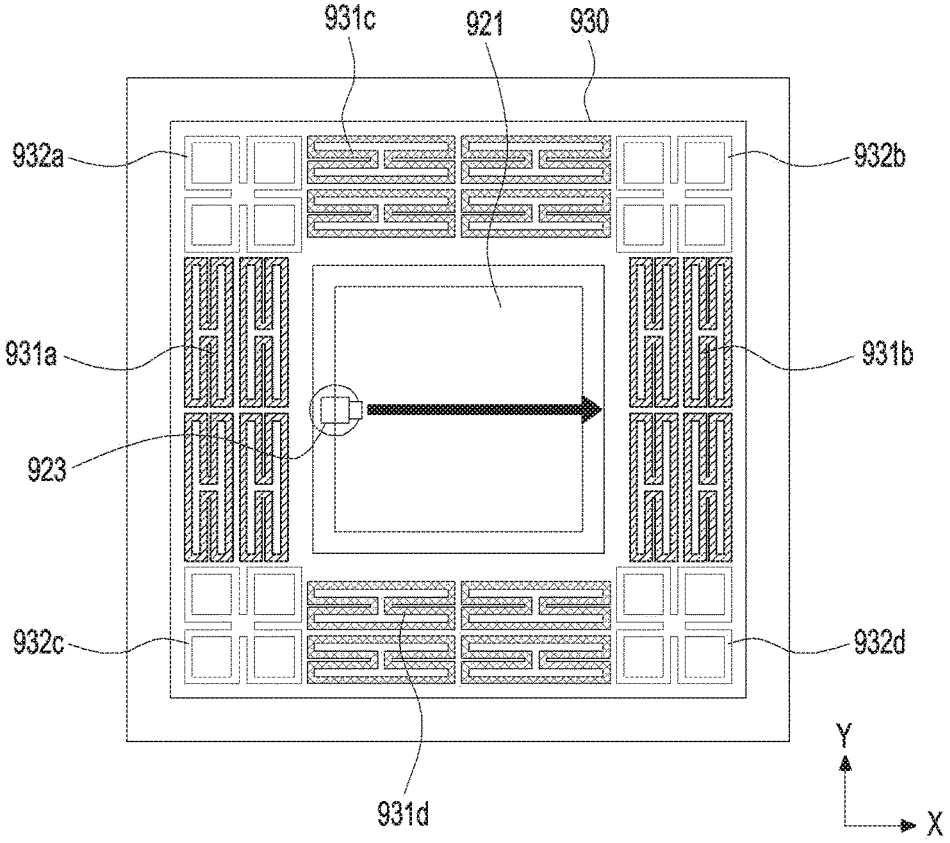
FIG. 32 is a front view schematically illustrating periodic structures on a third layer in an antenna device according to an embodiment of the disclosure.

FIG. 32 is a front view schematically illustrating a third layer in an antenna device according to an embodiment of the disclosure. FIG. 32 may illustrate the antenna device 900 when viewed from above the third layer 930.

Referring to FIG. 32, the antenna device 900 may include a plurality of conductive cells on one layer (for example, the third layer 930). According to various embodiments of the disclosure, a plurality of conductive cells on one layer may have two or more different patterns. A plurality of periodic structures may be formed on one layer by using the plurality of conductive cells having various patterns.

According to an embodiment of the disclosure, as illustrated in FIG. 32, different types of conductive cells 931*a*, 931*b*, 931*c*, 931*d*, 932*a*, 932*b*, 932*c*, and 932*d* may be formed on one layer (for example, the third layer 930). According to an embodiment of the disclosure, the conductive cells 931*a*, 931*b*, 931*c*, 931*d*, 932*a*, 932*b*, 932*c*, and 932*d* may include conductive cells 931*a* and 931*b* of a $(1\text{-}1)^{th}$ pattern, conductive cells 931*c* and 931*d* of a $(1\text{-}2)^{th}$ pattern, or conductive cells 932*a*, 932*b*, 932*c*, and 932*d* having a $(1\text{-}3)^{th}$ pattern. According to an embodiment of the disclosure, the conductive cells 931*a* and 931*b* having the $(1\text{-}1)^{th}$ pattern may be symmetrical with respect to the center of the layer (for example, the third layer 930). The conductive cells 931*c* and 931*d* having the $(1\text{-}2)^{th}$ pattern may be symmetrical with respect to the center of the layer (for example, the third layer 930). The conductive cells 932*a*, 932*b*, 932*c*, and 932*d* having the $(1\text{-}3)^{th}$ pattern may be symmetrical in a diagonal direction with respect to the center of the layer (for example, the third layer 930). According to an embodiment of the disclosure, a main periodic structure may be formed by using the conductive cells 931*a* and 931*b* having the $(1\text{-}1)^{th}$ pattern and/or the conductive cells 931*c* and 931*d* having the $(1\text{-}2)^{th}$ pattern. An auxiliary periodic structure may be formed by using the conductive cells 932*a*, 932*b*, 932*c*, and 932*d* having the $(1\text{-}3)^{th}$ pattern. Besides, many other examples may be applied.

Each of the conductive cells may be formed in various shapes. Each of the conductive cells 931*a*, 931*b*, 931*c*, and 931*d* of the main periodic structure illustrated in FIG. 32 may be formed into a rectangle (or the "H" shape). Various frequency bands may be configured for the antenna device 900 through various shapes of the conductive cells, which may bring the same effect as adjusting the intensity of a beam emitted from the antenna device 900. As described above, it is to be noted that the plurality of conductive cells on one layer may not necessarily be formed in the same shape in the antenna device 900.

Figure 33:
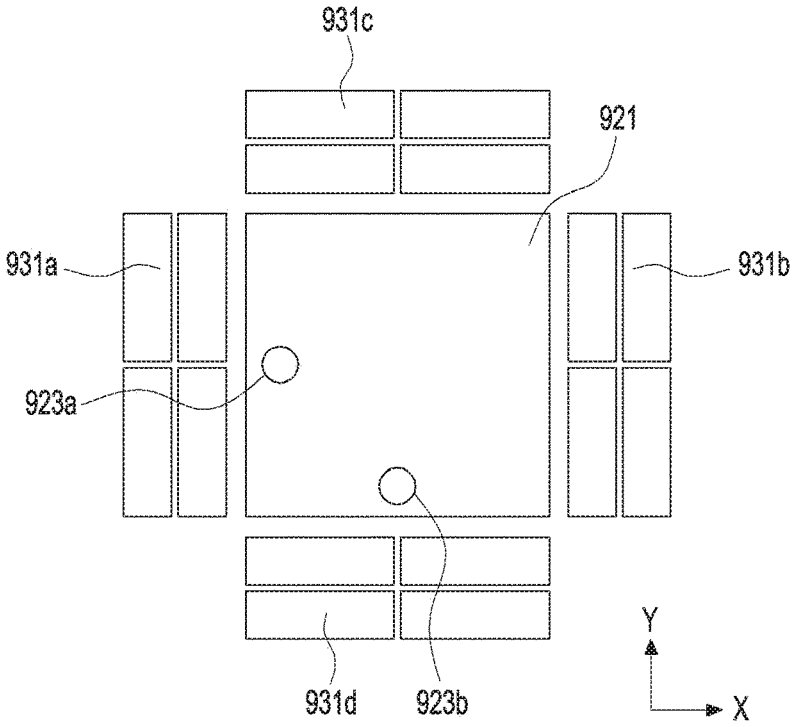
FIG. 33 is a front view illustrating a main periodic structure among various periodic structures and positions of power feeding points in an antenna device illustrated in FIG. 32 according to an embodiment of the disclosure.

FIG. 33 is a front view illustrating a part of periodic structures and positions of power feeding points according to an embodiment of the disclosure.

Referring to FIG. 33, according to various embodiments of the disclosure, an antenna device (for example, the antenna device 900 in FIG. 32) may include periodic structures in which a plurality of conductive cells 931*a*, 931*b*, 931*c*, and 931*d* are symmetrical vertically and horizontally with respect to the center of a layer (for example, the third layer 930).

According to various embodiments of the disclosure, the power feeding lines (for example, the power feeding line 523 in FIG. 10A) included in the antenna device (for example, the antenna device 900 in FIG. 32) may be coupled to an antenna element 921 at one or more power feeding point 923*a* and 923*b*. According to an embodiment of the disclosure, the power feeding lines may include a first power feeding line for generating polarization (or 'polarized wave') in a first direction in the antenna element, and a second power feeding line for generating polarization in a second direction different from the first direction in the antenna element.

According to various embodiments of the disclosure, radio waves having a first polarization property (for example, horizontal polarization) in one direction (for example, +X-axis or −X-axis direction) may be transmitted and received by one power feeding point 923*a*, whereas radio waves having a second polarization property (for example, vertical polarization) may be transmitted and received in another direction (for example, +Y-axis or −Y-axis direction) by another power feeding point 923*b*. When conductive cells are arranged symmetrically with respect to the center of the layer (for example, the third layer 930) in correspondence with a polarization direction, the antenna device 900 may have a periodic property for the polarization direction.

For example, as illustrated in FIG. 33, each of the conductive cells 931*a* and 931*b* of the $(1\text{-}1)^{th}$ pattern and the conductive cells 931*c* and 931*d* of the $(1\text{-}2)^{th}$ pattern may be formed into a rectangle with long sides and short sides. According to an embodiment of the disclosure, the conductive cells 931*a* and 931*b* of the $(1\text{-}1)^{th}$ pattern and the conductive cells 931*c* and 931*d* of the $(1\text{-}2)^{th}$ pattern may be arranged in correspondence with the first polarization property and the second polarization property, respectively. For example, the long sides of the conductive cells 931*a* and 931*b* of the $(1\text{-}1)^{th}$ pattern may be arranged to face each other in the vicinity of the first power feeding point 923*a*. The conductive cells 931*c* and 931*d* of the $(1\text{-}2)^{th}$ pattern may be disposed in the vicinity of the second power feeding point 923*b*. The conductive cells 931*a* and 931*b* of the $(1\text{-}1)^{th}$ pattern may have a periodic property for the first power feeding point 923*a* adjacent thereto, and the pattern conductive cells 931*c* and 931*d* of the $(1\text{-}2)^{th}$ pattern may have a periodic property for the second power feeding point 923*b* adjacent thereto.

According to another embodiment of the disclosure, conductive cells may be arranged symmetrically in correspondence with the shape (or pattern) of the antenna element 921, rather than in correspondence with a polarization direction.

Figure 34:
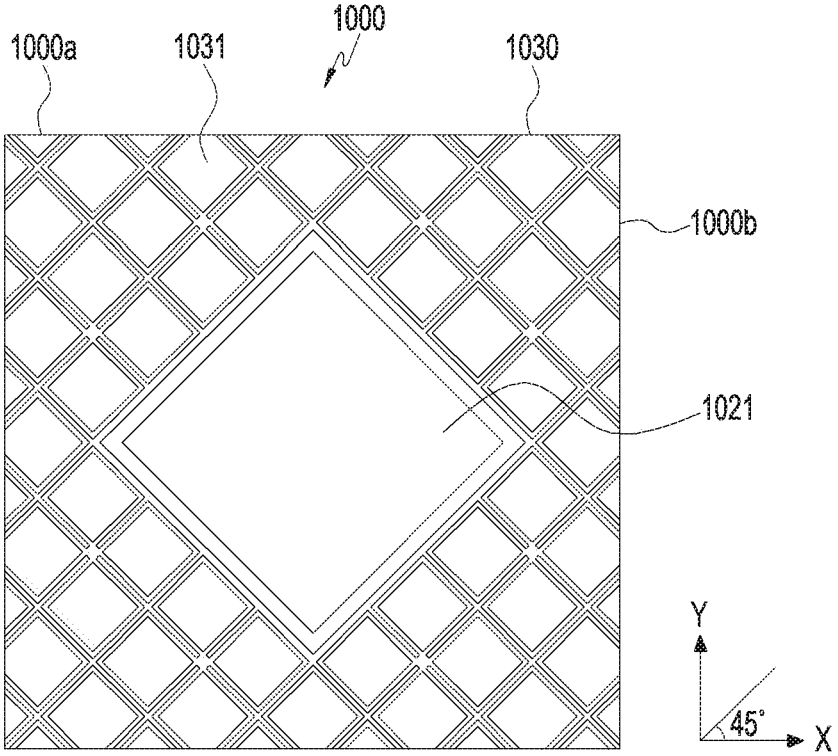
FIG. 34 is a front view schematically illustrating an antenna device in an electronic device according to an embodiment of the disclosure.

FIG. 34 is a front view schematically illustrating an antenna device in an electronic device according to an embodiment of the disclosure.

Figure 35:
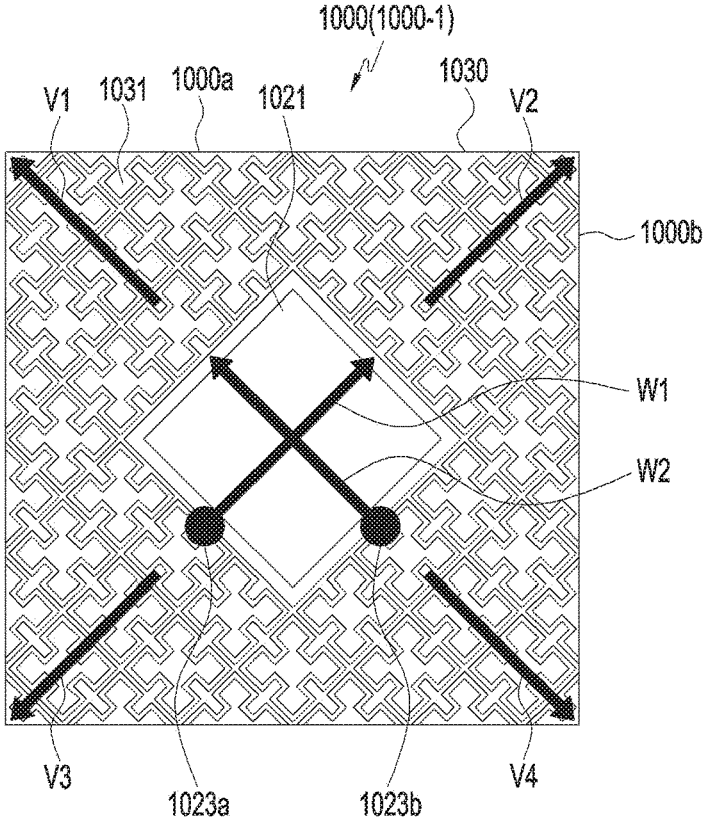
FIG. 35 is a diagram illustrating polarization directions in an antenna device according to an embodiment of the disclosure.

FIG. 35 illustrates polarization directions in an antenna device according to an embodiment of the disclosure.

Figure 36:
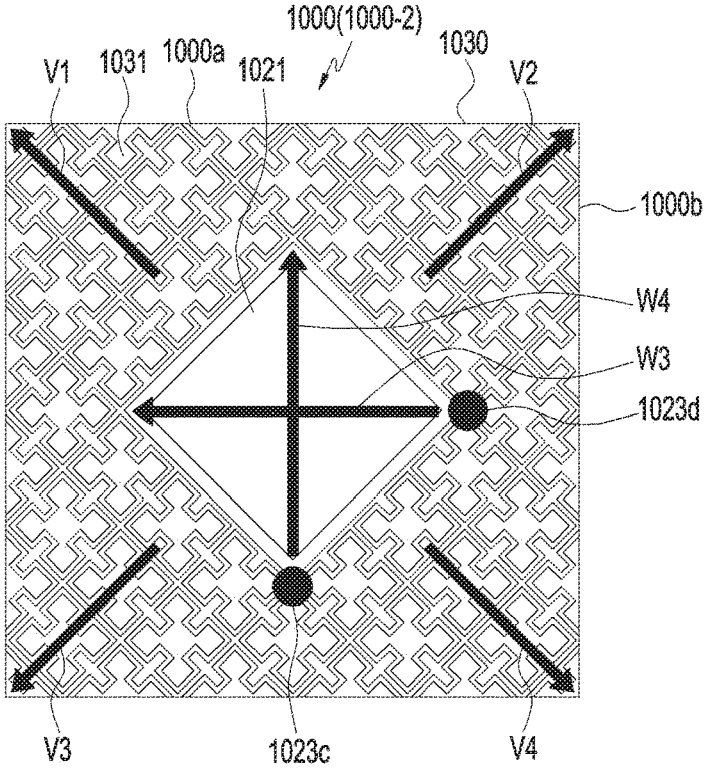
FIG. 36 is a diagram illustrating polarization directions in an antenna device according to an embodiment of the disclosure.

FIG. 36 illustrates polarization directions in an antenna device according to an embodiment of the disclosure.

Figure 37:
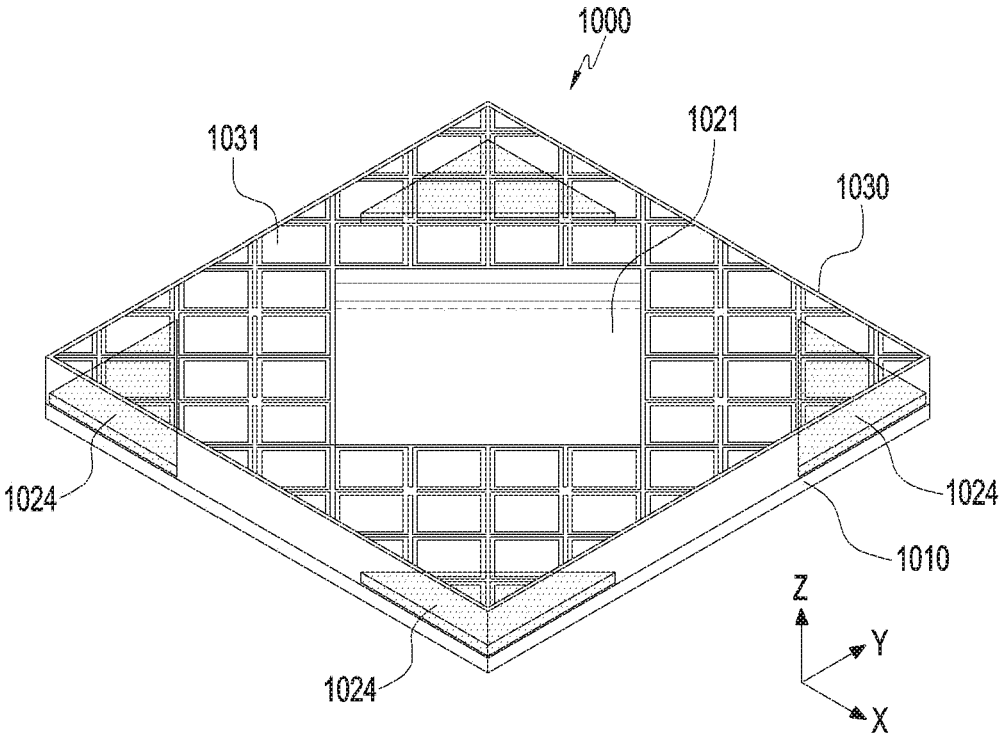
FIG. 37 is a perspective view schematically illustrating an antenna device in an electronic device according to an embodiment of the disclosure.

FIG. 37 is a perspective view schematically illustrating an antenna device included in an electronic device according to an embodiment of the disclosure.

Figure 38:
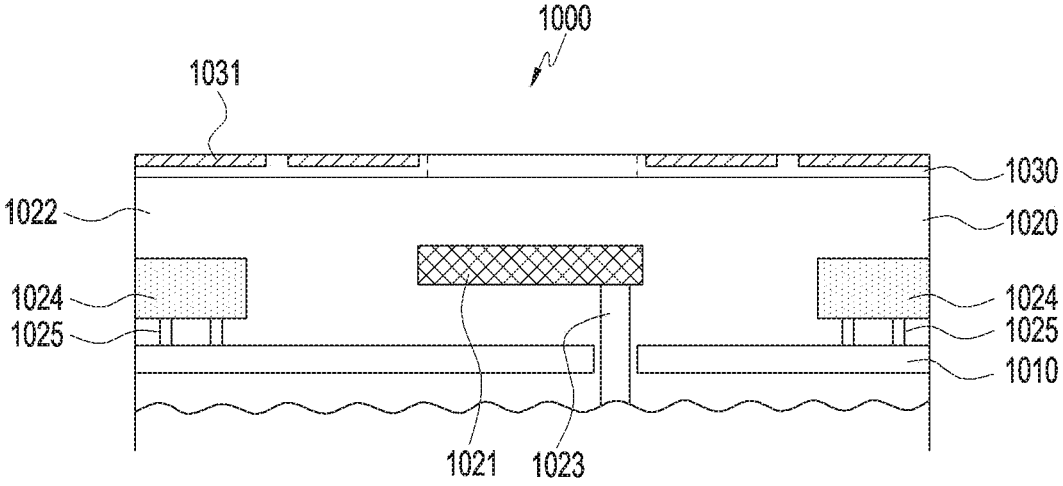
FIG. 38 is a sectional view schematically illustrating an antenna device in an electronic device according to an embodiment of the disclosure.

FIG. 38 is a sectional view schematically illustrating an antenna device in an electronic device according to an embodiment of the disclosure.

Referring to FIGS. 34, 35, 36, 37, and 38, the antenna device 1000 according to various embodiments of the disclosure (for example, the antenna device 700 in FIG. 7) includes a first layer 1010, a second layer 1020, and a third layer 1030. While not shown, the antenna device 1000 may further include a fourth layer, a fifth layer, and/or various other layers.

According to an embodiment of the disclosure, the first layer 1010 of the antenna device 1000 may include a ground layer, and the second layer 1020 may include an antenna element 1021, a dielectric 1022 surrounding at least a part of the antenna element 1021, and at least a part of a power feeding line 1023. According to an embodiment of the disclosure, the third layer 1030 may include a plurality of first conductive cells 1031. In another example, when the antenna device 1000 includes the fourth layer, the fifth layer, and/or various other layers, the fourth layer, the fifth layer, and/or the various other layers may also include a plurality of conductive cells.

The plurality of first conductive cells 1031 included in the antenna device 1000 may be formed in a first pattern. According to an embodiment of the disclosure, the plurality of first conductive cells 1031 may be formed in a periodic structure (for example, a first periodic structure).

According to various embodiments of the disclosure, the antenna element 1021 may be formed in various shapes in the antenna device 1000. For example, the antenna element 1021 may be formed in the shape of a square patch as illustrated in FIGS. 5A and 5B, a circular patch, or the like. As illustrated in FIG. 34, the antenna element 1021 may be formed into a rhombus.

For example, when the antenna element 1021 is shaped into a rhombus, the plurality of first conductive cells 1031 arranged to surround at least a part of the antenna element 1021 may also be parallel with the sides of the rhombus.

According to various embodiments of the disclosure, the periodic structure formed by the plurality of first conductive cells 1031 may be tilted with respect to horizontal sides 1000*a* or vertical sides 1000*b* of the antenna device 1000, when viewed from above the antenna device toward the front thereof (or the front of the first layer), as illustrated in FIGS. 35 and 36. For example, the periodic structure formed by the first conductive cells 1031 may be tilted at 45 degrees with respect to the horizontal sides 1000*a* (for example, the X-axis direction) of the antenna device 1000, as illustrated in FIG. 34.

According to various embodiments of the disclosure, the reflection coefficient of the antenna device 1000 may be variously adjusted by changing power feeding points 1023*a*, 1023*b*, 1023*c*, and 1023*d* coupled to the antenna element 1021 or changing the positions of the power feeding points to various other positions not shown in the drawing.

Referring to FIGS. 35 and 36 together, the periodic structure formed by the first conductive cells 1031 may generate auxiliary polarizations V1, V2, V3, and V4 depending on the arrangement of the first conductive cells 1031 regardless of the positions of the power feeding points 1023*a*, 1023*b*, 1023*c*, and 1023*d*. For example, the auxiliary polarizations V1, V2, V3, and V4 may assist polarizations W1, W2, W3, and W4 caused by radiation of the antenna element 1021, when power is supplied to the antenna element 1021 through the power feeding points 1023*a*, 1023*b*, 1023*c*, and 1023*d*. As the auxiliary polarizations V1, V2, V3, and V4 are formed according to the arrangement of the first conductive cells 1031, the isolation of the antenna device may be controlled.

According to various embodiments of the disclosure, the antenna device 1000 may have at least one power feeding point coupled to the antenna element 1021. Referring to FIGS. 35 and 36, the antenna device 1000 may be provided with the power feeding points 1023*a*, 1023*b*, 1023*c*, and 1023*d* at various positions regardless of the shapes of the antenna element 1021 and conductive cells (for example, the first conductive cells 1031).

According to various embodiments of the disclosure, the antenna device 1000 may include a plurality of power feeding points (for example, the power feeding points 1023*a* and 1023*b*) at different positions, which are coupled to the antenna element 1021. For example, the antenna device 1000 illustrated in FIG. 35 (hereinafter referred to as the "antenna device 1000-1" distinguishable from the antenna device in FIG. 36) may include the power feeding point 1023*a* disposed in a −135-degree direction with respect to the center of the antenna element 1021, and the power feeding point 1023*b* disposed in a −45-degree direction with respect to the center of the antenna element 1021. When the power feeding points 1023*a* and 1023*b* are formed as illustrated in FIG. 35, the polarizations W1 and W2 may be configured to be oriented in a diagonal direction (for example, in a 45-degree direction) with respect to the horizontal sides 1000*a* or the vertical sides 1000*b* of the antenna device 1000.

Alternatively, as illustrated in FIG. 36, power feeding points 1023*c* and 1023*d* of an antenna device 1000-2 may be formed at such positions that polarizations W3 and W4 are formed in parallel to the horizontal sides 1000*a* or the vertical sides 1000*b* of the antenna device 1000. For example, the power feeding points 1023*c* and 1023*d* may be formed in the vicinity of corners of the rhombus-shaped antenna element 1021 so that the polarization directions of the antenna device 1000 are parallel to the horizontal or vertical direction of the antenna device 1000. In this case, since the tilting direction of the periodic structure of the conductive cells and the polarization directions of the antenna device 1000 are different, a beam having a frequency band and/or impedance different from that of FIG. 35 may be radiated.

According to various embodiments of the disclosure, a plurality of antenna devices 1000 may be provided in an array (for example, an antenna array in FIG. 39 as described later). The distance between polarizations generated in an antenna device (for example, the antenna device 1000-1 of FIG. 35) provided with power feeding points (e.g., the power feeding points 1023*a* and 1023*b* in FIG. 35) configured to generate polarizations in the 45-degree direction may be larger than the distance between polarizations generated in an antenna device (for example, the antenna device 1000-2 of FIG. 36) provided with power feeding points (e.g., the power feeding points 1023*c* and 1023*d* in FIG. 36) configured to generate horizontal or vertical polarizations. When the distance between polarizations is large, interference between adjacent antenna devices included in the antenna array may be reduced, or the reflection coefficient of the antenna element 1021 may be reduced. Accordingly, the radiation performance of the antenna device may be improved.

As described above, the antenna device 1000 may be configured to vary polarizations depending on the positions of the power feeding points 1023*a*, 1023*b*, 1023*c*, and 1023*d*. For example, the radiation performance may be improved, such as reduction of interference between antenna devices or a decrease in the reflection coefficient of the antenna element 1021, by changing the position of a power feeding point coupled to the antenna element 1021.

According to various embodiments of the disclosure, while not shown, a power feeding point may be formed at a different position for each of a plurality of antenna elements 1021, to which the power feeding point is coupled, in an antenna array including the plurality of antenna elements 1021 (e.g., the antenna array 1000' in FIG. 39 as described later).

Referring to FIGS. 37 and 38, the antenna device 1000 according to various embodiments of the disclosure may include at least one wall 1024. According to an embodiment of the disclosure, the wall 1024, which is electrically coupled to the ground, is disposed inside the antenna device 1000 to increase polarization isolation and thus contribute to improvement of the radiation performance of the antenna device 1000. According to an embodiment of the disclosure, the wall 1024 may be formed at an edge of an inner dielectric 1022 of the antenna device 1000.

According to various embodiments of the disclosure, the wall 1024 may be disposed inside the antenna device 1000 to surround at least a part of the antenna element 1021. According to an embodiment of the disclosure, the wall 1024 may be disposed at a corner of the antenna device 1000, as illustrated in FIG. 37. In another example, the wall 1024 may be formed at an edge of the antenna device 1000, parallel to a side of the antenna element 1021. For example, when the antenna element 1021 is shaped into a quadrangle having four sides, the wall 1024 may be formed at an edge of the antenna device 1000 parallel to at least one of the four sides of the antenna element 1021. According to various embodiments of the disclosure, the wall 1024 may be disposed at a position which increases polarization isolation based on the tilting direction of a periodic structure of conductive cells included in the antenna device 1000 and/or a polarization direction of the antenna device 1000.

According to an embodiment of the disclosure, in the antenna device 1000 in which the periodic structure of the conductive cells is tilted at a predetermined angle, a plurality of walls 1024 may be arranged at edges of the antenna device 1000, in parallel with the tilting direction of the periodic structure. For example, in the antenna device 1000 in which the periodic structure of the conductive cells is tilted at 45 degrees as illustrated in FIGS. 37 and 38, four walls 1024 may be disposed at four corners of the antenna device 1000, respectively.

According to an embodiment of the disclosure, the wall 1024 may be disposed to be grounded. For example, as illustrated in FIG. 38, the wall 1024 may be disposed at a predetermined distance from the first layer 1010 including the ground, and at least partially coupled electrically to the ground via a conductive via 1025, thus being grounded.

According to various embodiments of the disclosure, when power is supplied to the antenna element 1021 through the power feeding line 1023, a beam is radiated from the antenna element 1021. Then, the degree of isolation around the antenna element 1021 may be increased through the wall 1024, thereby improving the radiation performance of the antenna device 1000.

Figure 39:
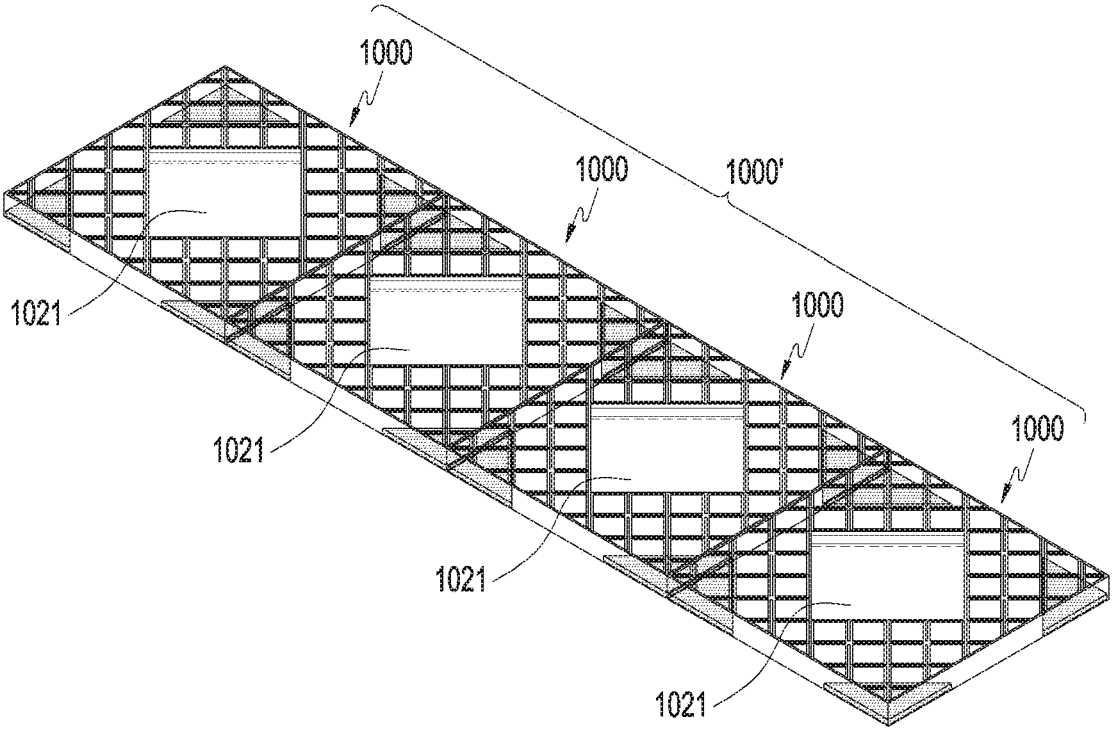
FIG. 39 is a perspective view illustrating a structure of an antenna array according to an embodiment of the disclosure.

FIG. 39 is a perspective view illustrating an antenna array according to an embodiment of the disclosure.

Figure 40:
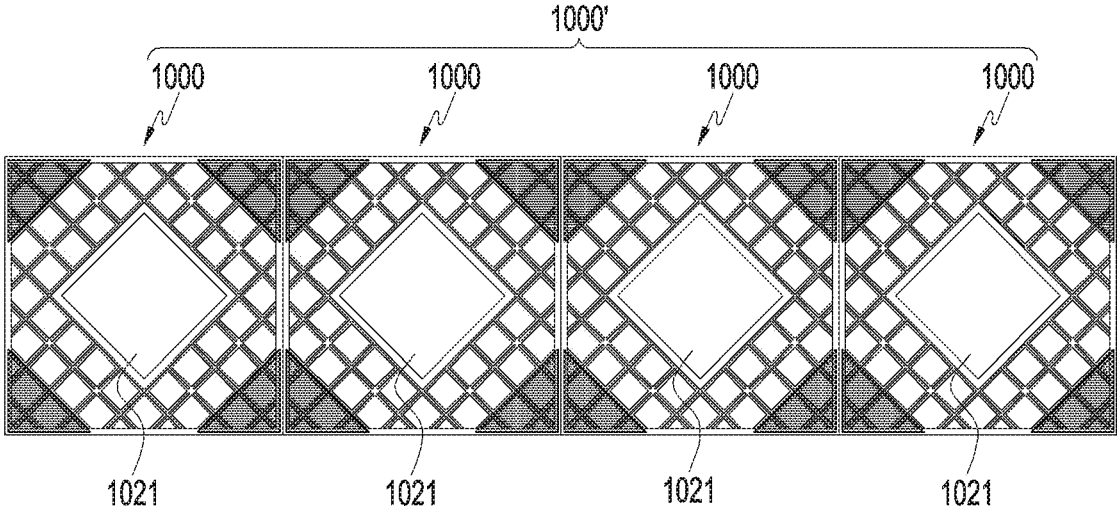
FIG. 40 is a front view illustrating a structure of an antenna array according to an embodiment of the disclosure.

FIG. 40 is a front view illustrating an antenna array according to an embodiment of the disclosure.

Referring to FIG. 39, according to various embodiments of the disclosure, the antenna array 1000' may be formed by connecting a plurality of antenna devices 1000 in the form of an array. For example, as illustrated in FIGS. 39 and 40, four antenna devices 1000 may be formed into one antenna array 1000'. According to various embodiments of the disclosure, the antenna array 1000' may be formed with any other different number of antenna devices 1000. While the antenna array 1000' with antenna devices 1000 according to the embodiment illustrated in FIG. 37 is illustrated in FIGS. 39 and 40, the antenna array 1000' is not limited thereto. Further, while the periodic structure of conductive cells are the same in each antenna of the antenna array 1000' in the embodiment illustrated in FIGS. 39 and 40, the disclosure is not limited thereto.

Referring to FIG. 40, according to an embodiment of the disclosure, one antenna array (not shown) may be formed with antenna devices (not shown) each having a periodic structure tilted in a different direction. According to another embodiment of the disclosure, one antenna array may be formed with antenna devices having different polarization directions.

According to various embodiments of the disclosure, a wall 1024 may be formed at an edge of each antenna device 1000 included in the antenna array 1000'. As illustrated in FIGS. 39 and 40, the antenna array 1000' may include a wall 1024 in each of the plurality of antenna devices 1000. The use of the walls 1024 may lead to improved isolation between neighboring antenna devices and increased gains of the antenna devices.

Figure 41:
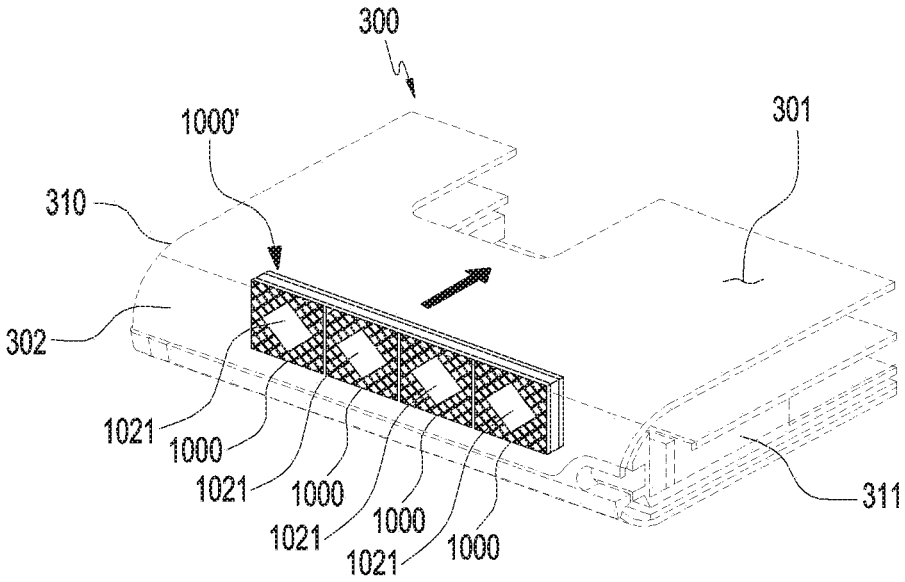
FIG. 41 is a perspective view schematically illustrating an antenna array mounted inside an electronic device according to an embodiment of the disclosure.

FIG. 41 is a perspective view schematically illustrating an antenna array mounted inside an electronic device according to an embodiment of the disclosure.

Figure 42:
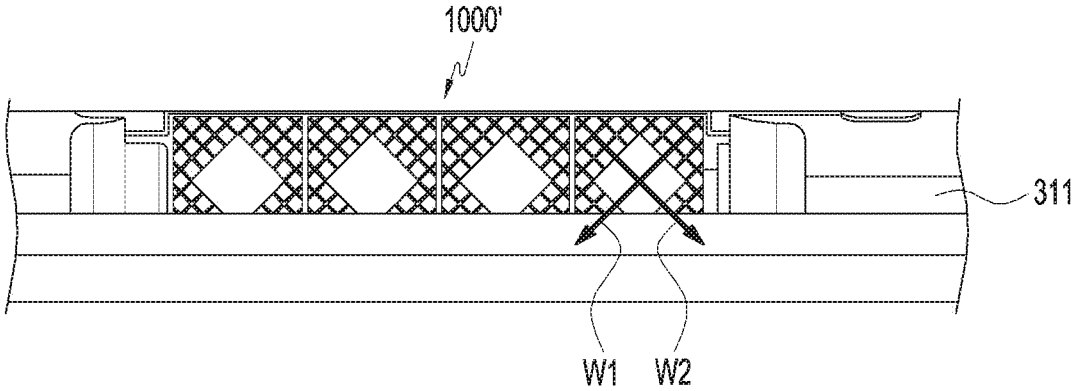
FIG. 42 is a front view schematically illustrating an antenna array mounted inside an electronic device according to an embodiment of the disclosure.

FIG. 42 is a front view schematically illustrating an antenna array mounted inside an electronic device according to an embodiment of the disclosure.

Figure 43:
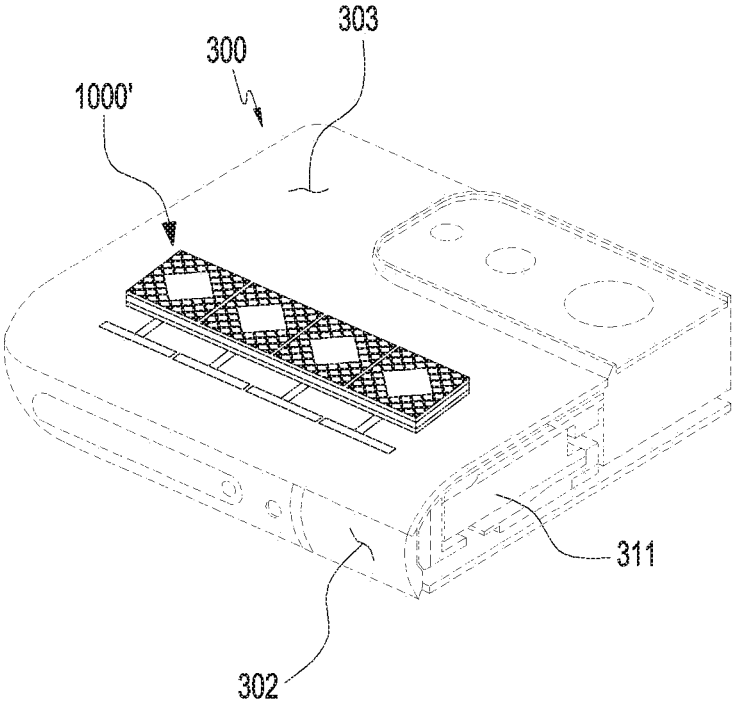
FIG. 43 is a perspective view schematically illustrating an antenna array mounted inside an electronic device according to an embodiment of the disclosure.

FIG. 43 is a perspective view schematically illustrating an antenna array mounted inside an electronic device according to an embodiment of the disclosure.

Referring to FIG. 41, the antenna array 1000' may be mounted at various positions inside the electronic device 300. For example, as illustrated in FIG. 41, the antenna array 1000' may be mounted so that antenna elements (for example, the antenna elements 1021 in FIG. 40) face a side member 302 of the electronic device 300, and as illustrated in FIG. 43, the antenna array 1000' may be mounted so that a front surface (for example, a front surface 301 in FIG. 41) or a rear surface of the electronic device 300 faces the antenna elements (for example, the antenna elements 1021 in FIG. 40). According to an embodiment of the disclosure, the antenna array 1000' may be supported by at least one support member 311 (for example, a bracket) and mounted in the electronic device 300.

According to various embodiments of the disclosure, the antenna array 1000' may be disposed to face the side member 302 of the electronic device 300. Thus, a beam emitted from the antenna array 1000' may be radiated to the outside of the side member 302. According to an embodiment of the disclosure, when at least a part of a housing of the electronic device 300 includes a metallic material, antenna radiation performance may be affected.

Referring to FIG. 42, according to some embodiments of the disclosure, when the side member 302 in the electronic device 300 includes a metallic material, the radiation performance of the antenna array 1000' installed to form a beam toward a side may be affected. In this case, adjustment of the polarization direction of the radiation beam of the antenna array 1000' may prevent degradation of the radiation performance. When the antenna array 1000' faces the side member 302 of the electronic device 300, as a beam emitted from the antenna array 1000' is polarized in a tilted state, the degradation of the radiation performance or the deviation between two different polarized waves may be reduced.

According to various embodiments of the disclosure, the antenna array 1000' may be disposed to face a rear plate 303 of the electronic device 300. Thus, a beam emitted from the antenna array 1000' may be radiated to the outside of the rear plate 303.

According to various embodiments of the disclosure, a plurality of antenna arrays 1000' may be provided. The positions and mounting directions of the plurality of antenna arrays 1000' may all be set identically, or may be set individually in various manners.

Referring to FIGS. 41, 42, and 43 together, the antenna device 1000 included in the electronic device 300 may be operated by selectively receiving power from one of a plurality of power feeding points. According to an embodiment of the disclosure, the efficiency of data transmission and reception between an electronic device including the antenna device 1000 (for example, the electronic device 101 in FIG. 1) and an external electronic device (for example, the electronic device 102 in FIG. 1 or a BS) may be improved by changing the position of a power feeding point in the antenna device 1000.

An electronic device (for example, the electronic device 101 in FIG. 1) according to various embodiments of the disclosure may include a processor (for example, the processor 120 in FIG. 1). The processor 120 may execute software to control at least one other component (for example, a hardware or software component) of the electronic device 101 coupled to the processor 120, and process and compute various data. For example, the processor 120 may be coupled to a communication circuit of the antenna device 1000 so that the antenna device 1000 has high data transmission/reception efficiency by actively changing a polarization direction according to a use environment.

Figure 44:
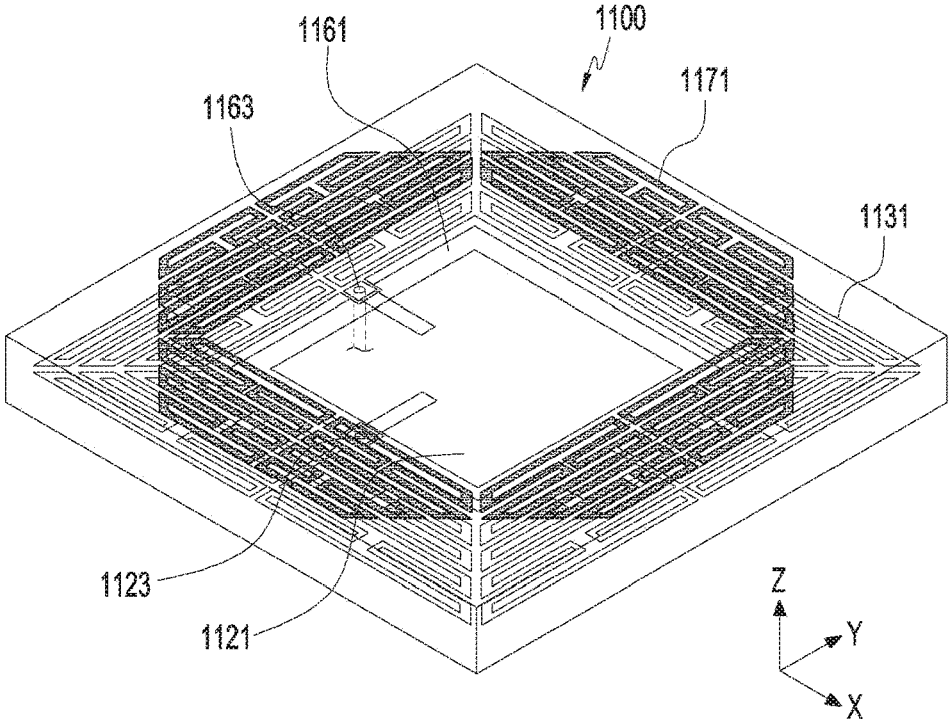
FIG. 44 is a perspective view schematically illustrating an antenna device in an electronic device according to an embodiment of the disclosure.

FIG. 44 is a perspective view schematically illustrating an antenna device in an electronic device according to an embodiment of the disclosure.

Figure 45:
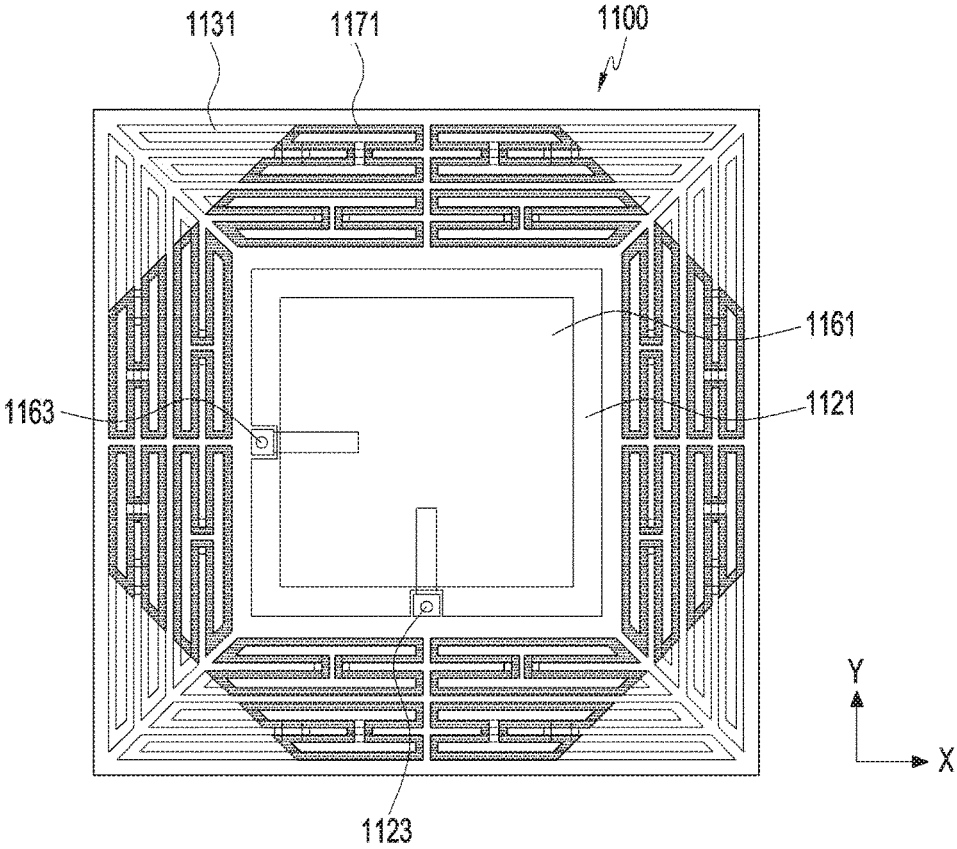
FIG. 45 is a front view schematically illustrating an antenna device in an electronic device illustrated in FIG. 44 according to an embodiment of the disclosure.

FIG. 45 is a front view schematically illustrating an antenna device in an electronic device according to an embodiment illustrated in FIG. 44 according to an embodiment of the disclosure.

According to various embodiments of the disclosure, the electronic device (for example, the electronic device 101 in FIG. 1) may be provided with the antenna device 1100 configured in a dual-band dual-polarization antenna radiation structure (or a dual-type antenna radiation structure) in which a plurality of antenna elements, for example, two antenna elements are stacked inside the single antenna device 1100.

Referring to FIGS. 44 and 45, a plurality of antenna elements 1121 and 1161 are stacked in the single antenna device 1000.

For example, two different antenna elements 1121 and 1161 may be intended for independently covering different frequency bands, respectively. For example, the antenna device 1100 may be an antenna device in which two substantially different antenna devices are integrated. Therefore, the antenna device 1100 may cover two different frequency bands.

According to various embodiments of the disclosure, one of the plurality of antenna elements 1121 and 1161 included in the antenna device 1100 may be coupled to conductive cells 1123 and 1163 having a corresponding periodic structure to cover a designated frequency band. According to an embodiment of the disclosure, the first antenna element 1121 may be coupled to first conductive cells 1131 to support a first frequency band, whereas the second antenna element 1161 may be coupled to second conductive cells 1171 to support a second frequency band. For example, the first antenna element 1121 may be designed to support a frequency band at about 29 GHz, and the second antenna element 1161 may be designed to support a frequency band at about 39 GHz, which is a higher range than that of the first antenna element 1121. Therefore, various ranges of frequency bands may be supported using the single antenna device 1100.

According to various embodiments of the disclosure, the size of the second antenna element 1161 is smaller than the size of the first antenna element 1121, so that the second antenna element 1161 may support a higher frequency band than the first antenna element 1121. According to various embodiments of the disclosure, a plurality of conductive cells may be designed to cover an area and a length corresponding to the size of an antenna element to be coupled with the conductive cells. For example, the total area and length of the plurality of second conductive cells 1171 coupled with the second antenna element 1161 may be smaller than those of the plurality of first conductive cells 1131 coupled with the first antenna element 1121.

Figure 46:
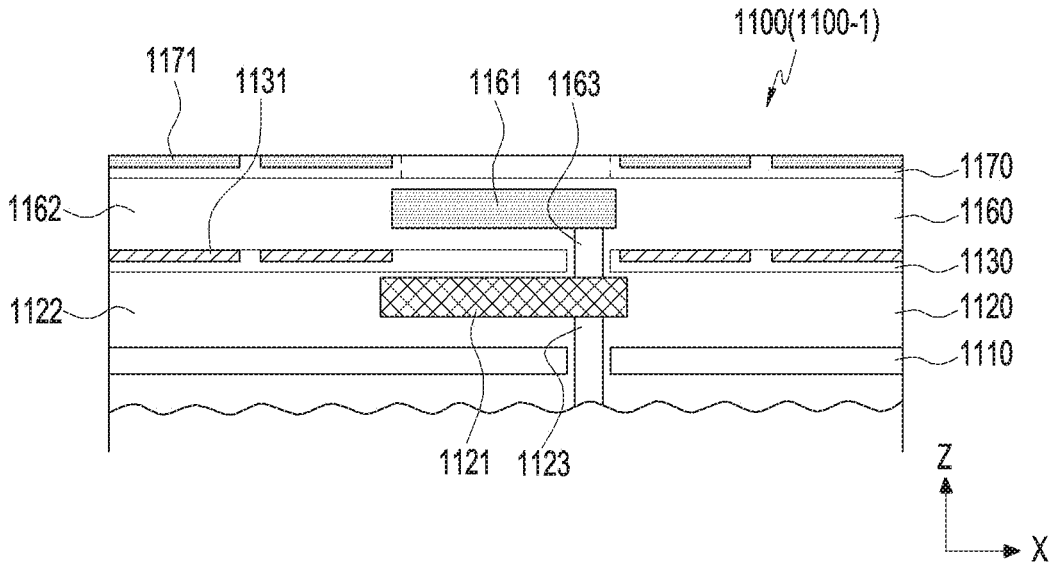
FIG. 46 is a sectional view illustrating a stacked structure of an antenna device according to an embodiment of the disclosure.

FIG. 46 is a sectional view illustrating a stacked structure of an antenna device according to an embodiment of the disclosure.

Figure 47:
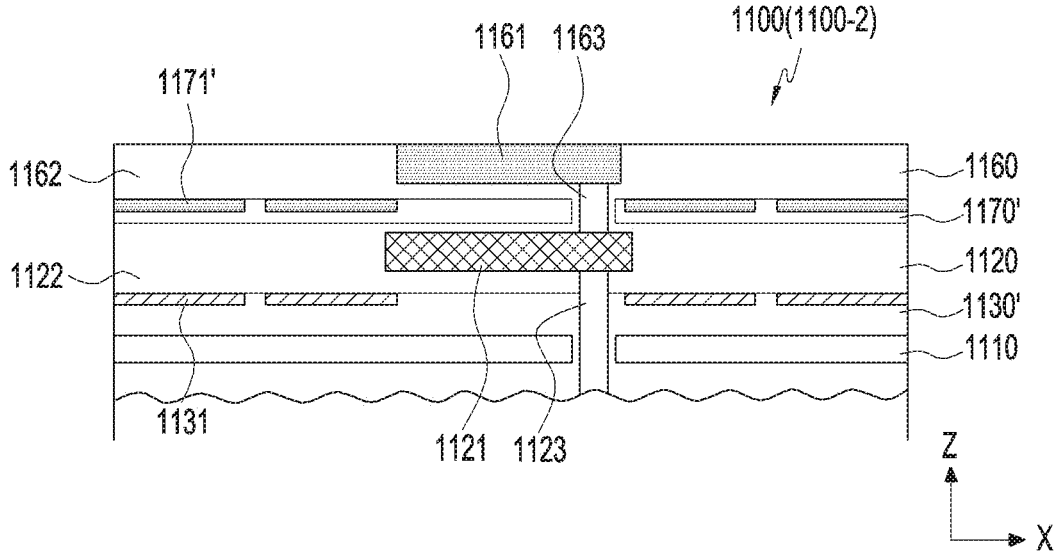
FIG. 47 is a sectional view illustrating a stacked structure of an antenna device different from that of FIG. 46 according to an embodiment of the disclosure.

FIG. 47 is a sectional view illustrating a stacked structure of an antenna device according to a different embodiment from that of FIG. 46 according to an embodiment of the disclosure.

Referring to FIG. 46, the antenna device 1100-1 may include a first layer 1110 including a ground, a second layer 1120 including at least one antenna element 1121, a dielectric 1122 disposed adjacent to the at least one antenna element 1121, and a third layer 1130 including a first periodic structure of first conductive cells 1131. According to an embodiment of the disclosure, the antenna device 1100 may further include a sixth layer 1160 which is formed separately from the second layer 1120 and forms a stacked structure together with the second layer 1120, and which includes at least one antenna element 1161 and a dielectric layer 1162 adjacent to the at least one antenna element 1161.

According to an embodiment of the disclosure, the plurality of first conductive cells 1131 may form a periodic structure (for example, the first periodic structure).

According to various embodiments of the disclosure, the antenna device 1100-1 may further include a seventh layer 1170 including a fourth conductive cell 1171. A plurality of fourth conductive cells 1171 may be provided, and form a periodic structure (for example, a second periodic structure).

According to an embodiment of the disclosure, when viewed from above the antenna device 1100-1, the periodic structure of the first conductive cells 1131 may overlap at least partly with the periodic structure of the fourth conductive cells 1171. In another example, the periodic structure of the first conductive cells 1131 may be identical to or different from that of the fourth conductive cells 1171 depending on embodiments of the disclosure.

Referring to FIG. 46, the second layer 1120 including the antenna element 1121, the third layer 1130 including the first conductive cells 1131, the sixth layer 116 including the antenna element 1161, or the seventh layer 1170 including the second conductive cells 1171 may be sequentially arranged in the Z-axis direction in the antenna device 1100-1 according to an embodiment of the disclosure Referring to FIG. 47, a third layer 1130' including the first conductive cells 1131, the second layer 1120 including the antenna element 1121, a seventh layer 1170' including the second conductive cells 1171', or a sixth layer 1160 including the antenna element 1161 may be sequentially arranged in the Z-axis direction in the antenna device 1100-2 according to another embodiment.

In the antenna device 1100 including a dual-band dual-polarization antenna radiation structure, when a layer including conductive cells only on at least one antenna element 1121 and/or 1161 is disposed, sufficient radiation performance may be secured. Therefore, various effects of the disclosure may be achieved even with the embodiment illustrated in FIG. 47. Because an electronic device (for example, the electronic device 101 in FIG. 1) according to various embodiments of the disclosure includes the antenna devices 1100-1 and 1100-2 of the dual-band dual-polarization antenna radiation structure, the electronic device may cover a wide range of frequency bands of the antenna devices 1100-1 and 1100-2 and shift between different frequency bands by changing an antenna polarization direction through power feeding points at different positions.

FIGS. 48A, 48B, 48C, and 48D are diagrams illustrating methods of feeding electricity to an antenna device according to various embodiments of the disclosure. FIGS. 48A to 48D may illustrate the methods of feeding electricity to the antenna device according to the various embodiments illustrated in FIGS. 44 to 47.

Figure 48A:
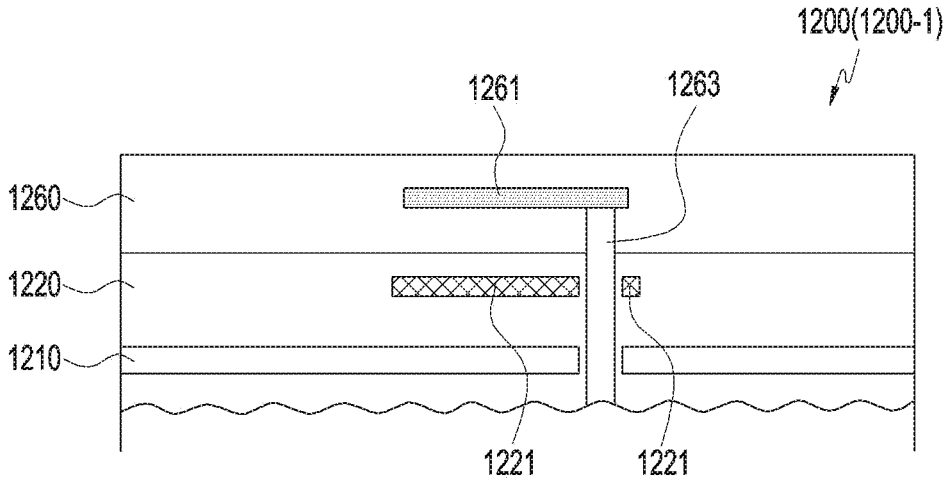
FIGS. 48A, 48B, 48C, and 48D are diagrams illustrating a method of feeding electricity to an antenna device according to various embodiments of the disclosure.

FIG. 48A is a diagram illustrating a method of feeding electricity to an antenna device according to an embodiment of the disclosure.

Figure 48B:
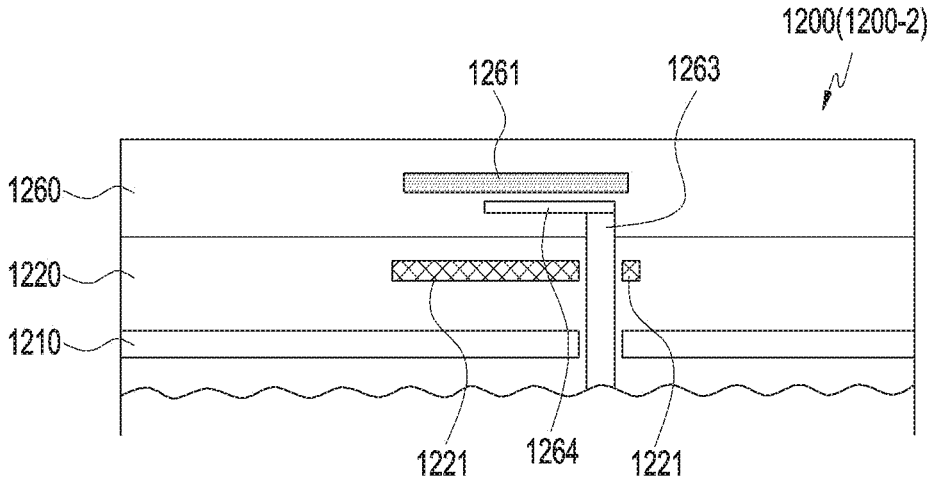

FIG. 48B is a diagram illustrating a method of feeding electricity to an antenna device according to an embodiment of the disclosure different from the embodiment of FIG. 48A.

Figure 48C:
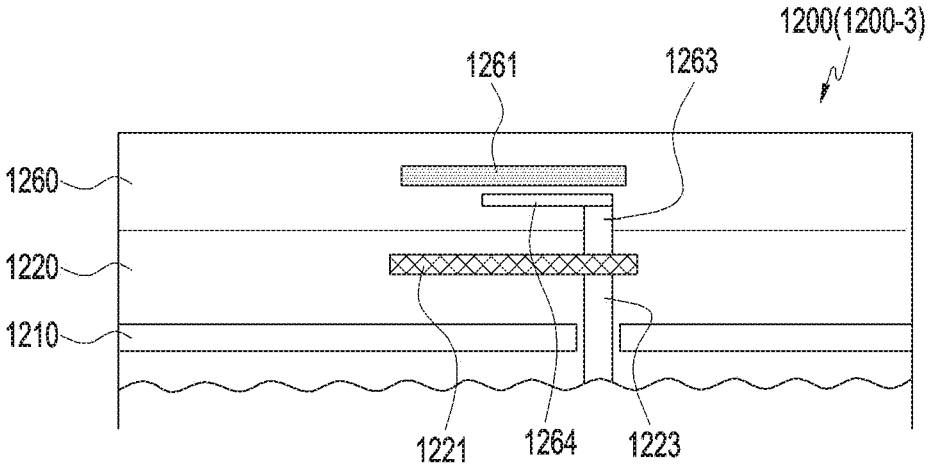

FIG. 48C is a diagram illustrating a method of feeding electricity to an antenna device according to an embodiment of the disclosure different from the embodiment of FIG. 48A.

Figure 48D:
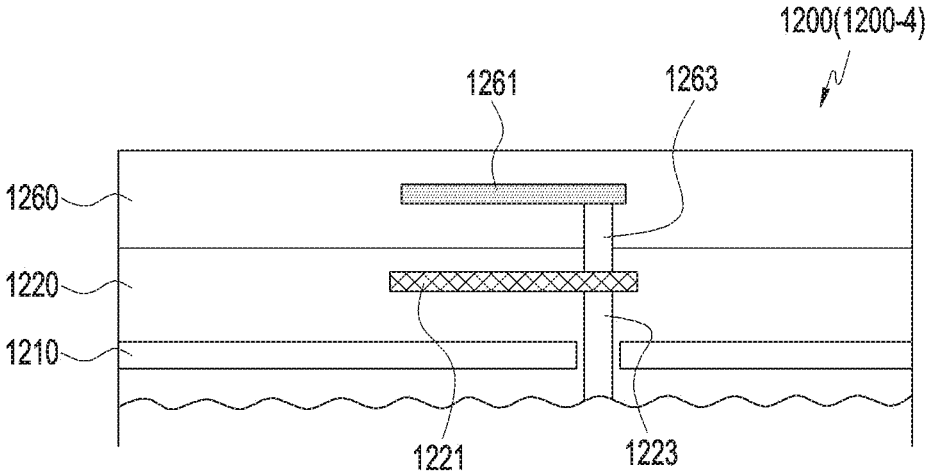

FIG. 48D is a diagram illustrating a method of feeding electricity to an antenna device according to an embodiment of the disclosure different from the embodiment of FIG. 48C.

According to various embodiments of the disclosure, in each of the antenna devices 1200-1, 1200-2, 1200-3, and 1200-4, including a dual-band dual-polarization antenna radiation structure, one antenna element (for example, a second antenna element 1261) may be configured to cover a higher frequency band than another antenna element (for example, a first antenna element 1221). For each antenna element, a power feeding point is formed such that polarization is generated in at least one direction (for example, vertical polarization and horizontal polarization). Therefore, polarization may be generated in various directions by means of a single antenna device 1200-1, 1200-2, 1200-3, or 1200-4.

According to various embodiments of the disclosure, each of the antenna devices 1200-1, 1200-2, 1200-3, and 1200-4 may include a PCB (not shown) on which a plurality of antenna layers 1220 and 1260 are formed (for example, the PCB 310 in FIG. 4A). The PCB includes a network layer (for example, the network layer 370 in FIG. 4A). Referring to FIGS. 48A to 48D, the other layers may not be shown, except for a first layer 1210 including a ground layer included in the network layer.

According to various embodiments of the disclosure, an antenna layer 1220 may include at least one dielectric, the first antenna element 1221, and/or a power feeding line (for example, a power feeding line 1223 in FIG. 48C). The antenna layer 1260 may also include at least one dielectric, an antenna element 1261 and/or a power feeding line 1263. According to an embodiment of the disclosure, at least a part of the power feeding line and/or the power feeding line 1263 may include a conductive via. The power feeding line (for example, the power feeding line 1223 in FIG. 48C) and/or the power feeding line 1263 may be directly or indirectly (for example, by coupling) connected to a wireless communication circuit (for example, the third RFIC 226 in FIG. 4A). For the convenience of description, a description redundant with the embodiment of FIG. 4A will be omitted.

Various feeding methods may be applied to the plurality of antenna layers 1220 and 1260. For each antenna element 1221 or 1261 covering a different frequency band, various feeding methods may be employed. According to an embodiment of the disclosure, one of direct feeding and coupling feeding may be adopted for the antenna element. According to an embodiment of the disclosure, regarding coupling feeding, one (for example, the first antenna element 1221) of the two antenna elements may be coupled, apart from the first layer 1210 including the ground, and the other antenna element (for example, the second antenna element 1261) may be coupled, apart from a feeding plate 1264 extended from the power feeding line 1263.

According to various embodiments of the disclosure, the feeding method may vary depending on whether a power feeding line (for example, the power feeding line 1223 and/or the power feeding line 1263) and the antenna element (for example, the first antenna element 1121) are combined.

For example, when the first antenna element 1221 and the second antenna element 1261 support different frequency bands (for example, the first antenna element 1221 supports a lower frequency band than the second antenna element 1261), coupling feeding may be adopted for the first antenna element 1221 and direct coupling may be adopted for the second antenna element 1221 because the first antenna element 1221 is not connected to the power feeding line 1263 and the second antenna element 1261 is directly connected to the power feeding line 1263, as illustrated in FIG. 48A. In another example, as illustrated in FIG. 48B, since either of the first antenna element 1121 and the second antenna element 1261 is not connected to the power feeding line 1263, coupling feeding may be adopted for both of the first and second antenna elements 1121 and 1261. In another example, as illustrated in FIG. 48C, direct coupling may be adopted for the first antenna element 1221 connected to the power feeding line 1223 and/or the power feeding line 1263, whereas coupling feeding may be adopted for the second antenna element 1261 which is not connected to the feed line 1263. According to another embodiment of the disclosure, as illustrated in FIG. 48D, direct coupling may be adopted for both of the first and second antenna elements 1221 and 1261 because the first antenna element 1221 is connected to the power feeding line 1223 and/or the power feeding line 1263 and the second antenna element 1261 is connected to the power feeding line 1263.

Figure 49:
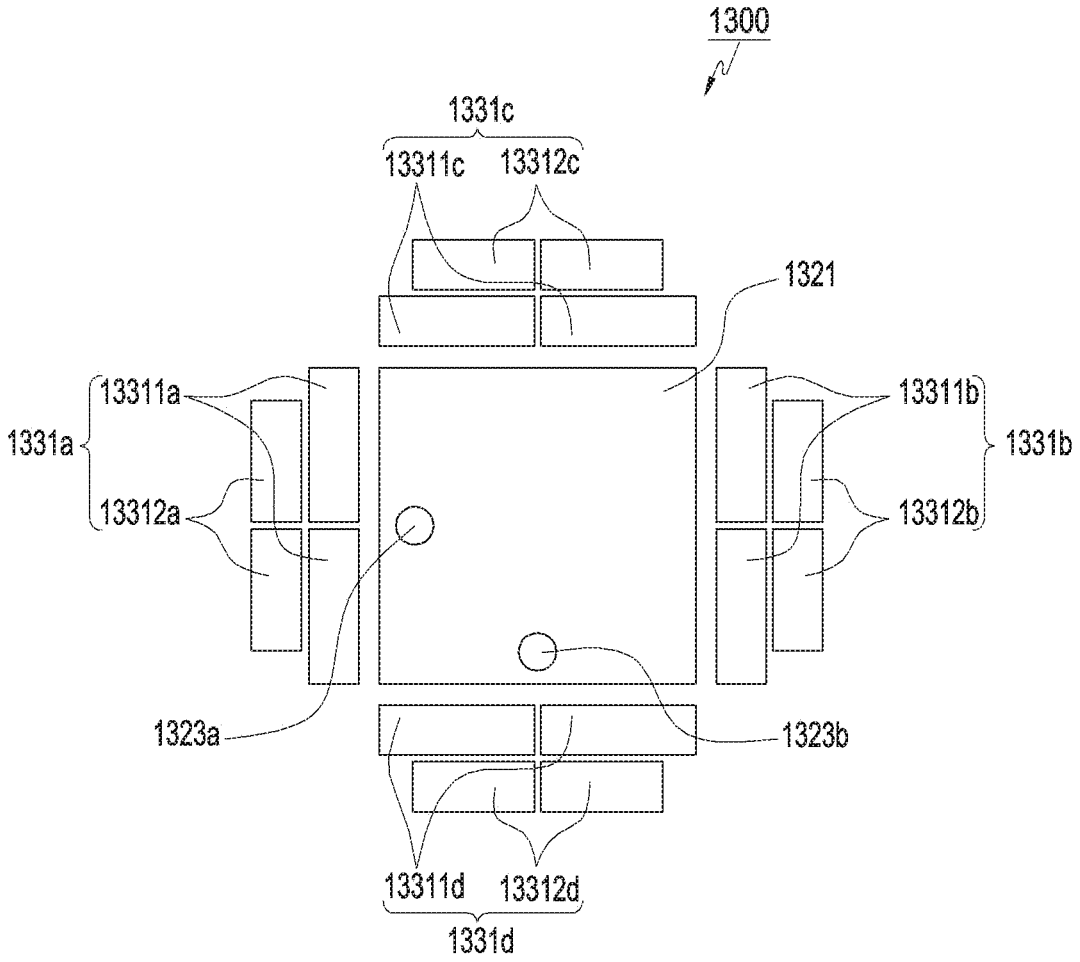
FIG. 49 is a front view of an antenna device illustrating a layout of a plurality of conductive cells according to an embodiment of the disclosure.

FIG. 49 is a front view illustrating an antenna device including a plurality of conductive cells forming various repeating structures on one layer according to an embodiment of the disclosure.

Figure 50:
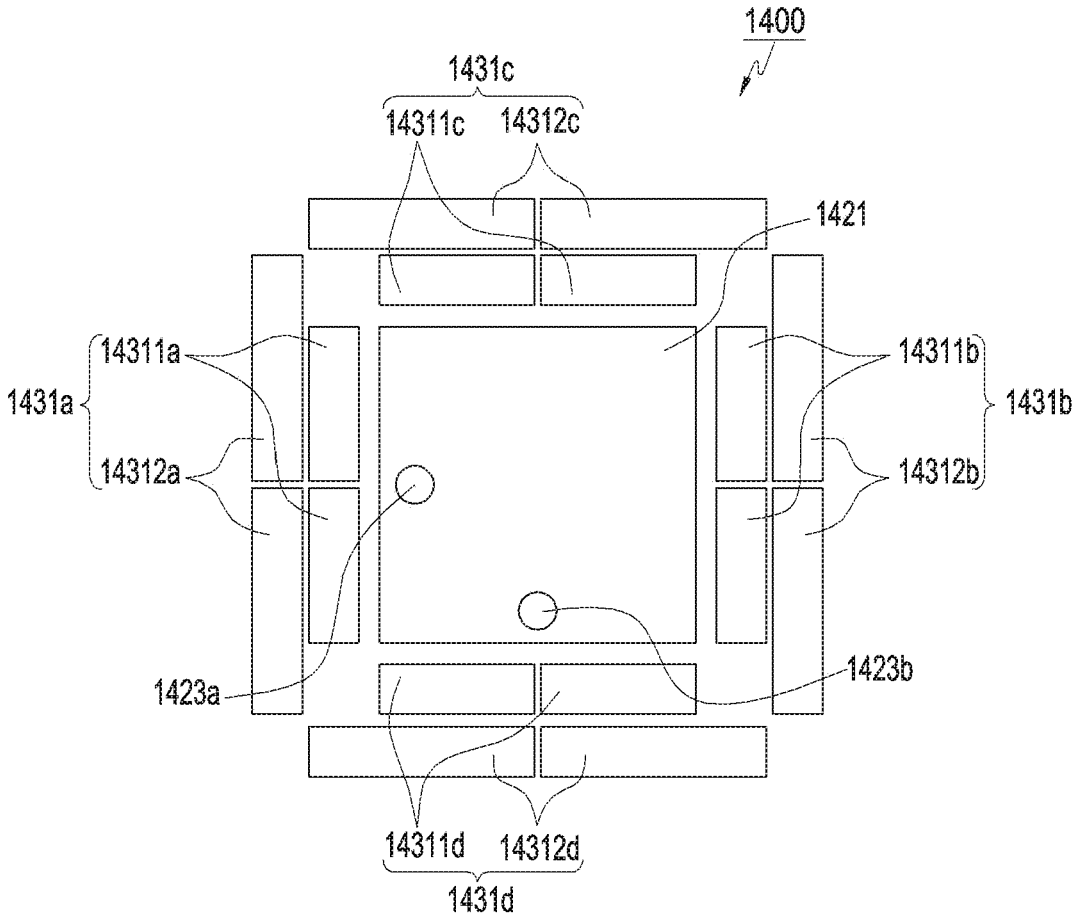
FIG. 50 is a front view of an antenna device illustrating a layout of a plurality of conductive cells different from that of FIG. 49 according to an embodiment of the disclosure.

FIG. 50 is a front view illustrating an antenna device including a plurality of conductive cells arranged in various repeating structures on one layer different from that of FIG. 49 according to an embodiment of the disclosure.

Referring to FIGS. 49 and 50, according to various embodiments of the disclosure, a plurality of conductive cells 1331*a*, 1331*b*, 1331*c*, and 1331*d* included in the antenna device 1300 (for example, the antenna device 500 in FIG. 7) may be arranged periodically in various patterns on one layer. In each of the antenna devices 1300 and 1400 according to various embodiments of the disclosure, a plurality of conductive cells may form an irregular periodic structure.

Referring to the above-described embodiments, the periodic structure of a plurality of conductive cells means that at least two or more conductive cells of the same pattern and size are arranged adjacent to each other in one direction (for example, the horizontal direction) or the other direction (for example, the vertical direction) on one layer (for example, the first layer) to have high impedance.

According to various embodiments of the disclosure, as far as it offers high impedance, a pattern (for example, an irregular periodic structure) in which conductive cells of different patterns and sizes are formed as well as a periodic structure formed by conductive cells of the same pattern and size according to the disclosure may fall within the scope of the disclosure.

For example, as illustrated in FIG. 49, the antenna device 1300 may include a layer on which conductive cells are arranged periodically such that the size of conductive cells 13312*a*, 13312*b*, 13312*c*, and 13312*d* far from the antenna element 1321 is smaller than the size of conductive cells 13311*a*, 13311*b*, 13311*c*, and 13311*d* near to the antenna element 1321. In another example, as illustrated in FIG. 50, an antenna device 1400 may include a layer on which conductive cells are arranged periodically such that the size of conductive cells 14312*a*, 14312*b*, 14312*c*, and 14312*d* far from an antenna element 1421 is larger than the size of conductive cells 14311*a*, 14311*b*, 14311*c*, and 14311*d* near to the antenna element 1421.

According to various embodiments of the disclosure, the antenna devices 1300 and 1400 may have a structure in which conductive cells on one side and the other side are symmetrical to each other with respect to the antenna elements. Referring to FIG. 49, for example, conductive cells 1331*a* (or conductive cells 1331*c*) adjacent to a power feeding point 1323*a* (or power feeding point 1323*b*) may be symmetrical to conductive cells 1331*b* (or conductive cells 1331*d*) on the opposite side with respect to the antenna element 1321. In another example, referring to FIG. 50, for example, conductive cells 1431*a* (or conductive cells 1431*c*) adjacent to a power feeding point 1423*a* (or power feeding point 1423*b*) may be symmetrical to conductive cells 1431*b* (or conductive cells 1431*d*) on the opposite side with respect to the antenna element 1421.

According to various embodiments of the disclosure, the plurality of conductive cells 1331*a*, 1331*b*, 1331*c*, and 1331*d* (or 1431*a*, 1431*b*, 1431*c*, 1431*d*) may be arranged in a combination of two or more periodic structures on one layer. For example, while not shown, a pattern of incremental loop-type conductive cells is formed along a polarization direction (for example, the horizontal direction) of an antenna according to the position of a first power feeding point (for example, the power feeding point 1323*a*), whereas a pattern of decremental loop-type conductive cells may be formed along a polarization direction (for example, the vertical direction) of the antenna according to the position of a second power feeding point (for example, the power feeding point 1323*b*).

Repetition patterns of various other types of conductive cells may be applied.

In the above-described embodiments of the disclosure, the terms "first layer", "second layer", "third layer", "fourth layer", "fifth layer", "sixth layer", "seventh layer", and so on are simply used to distinguish a corresponding component from other corresponding components, not limiting the scope of the disclosure. In addition, while "first layer", "second layer", "third layer", "fourth layer", "fifth layer", "sixth layer", "seventh layer", and so on are classified for the convenience of description, it is to be noted that other layers which have not been described may be provided additionally or alternatively.

The electronic device according to various embodiments of the disclosure may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to various embodiments of the disclosure, an electronic device (for example, the electronic device in FIG. 1) may include a housing (for example, the PCB 310 in FIG. 41) including a front plate (for example, the front plate 301 in FIG. 41), a rear plate (for example, the rear plate 303 in FIG. 43) facing away from the front plate, and a side member (for example, the side member 303 in FIG. 43) attached to the front plate or integrally formed with the rear plate, and surrounding a space between the front plate and the rear plate, an antenna device (for example, the antenna device 500 in FIG. 7) disposed inside the housing and including a first layer (for example, the first layer 510 in FIG. 8A), a second layer (for example, the second layer 520 in FIG. 8A), a third layer (for example, the third layer 530 in FIG. 8A), and a fourth layer (for example, the fourth layer 540 in FIG. 8A) formed in a stacked structure, wherein the first layer includes a ground parallel to the rear plate or the side member, the second layer includes at least one antenna element (for example, the antenna element 521 in FIG. 8A) and a dielectric (for example, the dielectric 522 in FIG. 8A) disposed adjacent to the at least one antenna element, the third layer includes a first area (for example, the first area 532 in FIG. 8A) in which a first periodic structure including a plurality of first conductive cells (for example, the plurality of first conductive cells 531 in FIG. 8A) is disposed and a second area (for example, the second area 533 in FIG. 8A) at least partially surrounded by the first area, and the fourth layer includes a third area (for example, the third area 542 in FIG. 8A) in which a second periodic structure including a plurality of second conductive cells (for example, the plurality of second conductive cells 541 in FIG. 8A) is disposed and a fourth area (for example, the fourth area 543 in FIG. 8A) at least partially surrounded by the third area, and a wireless communication circuit electrically coupled to the antenna element.

According to various embodiments of the disclosure, the wireless communication circuit may be configured to transmit and/or receive a signal in a frequency between 3 GHz and 100 GHz.

According to various embodiments of the disclosure, when viewed from above the antenna device, at least a part of the first area in which the first periodic structure is disposed may overlap with at least a part of the third area in which the second periodic structure is disposed.

According to various embodiments of the disclosure, the first periodic structure of the first conductive cells and the second periodic structure of the second conductive cells may be identical.

According to various embodiments of the disclosure, the first periodic structure of the first conductive cells and the second periodic structure of the second conductive cells may be different.

According to various embodiments of the disclosure, the electronic device may include an antenna device (for example, the antenna device 500-3 in FIG. 10A) including a fifth layer (for example, the fifth layer 550 in FIG. 10A) including a fifth area (for example, the fifth area 552 in FIG. 10A) in which a third periodic structure of third conductive cells (for example, the third conductive cells 551 in FIG. 10A) is disposed and a sixth area (for example, the sixth area 553 in FIG. 10A) at least partially surrounded by the fifth area. The first layer, the second layer, the third layer, the fourth layer, and the fifth layer may be stacked.

According to various embodiments of the disclosure, the second area and the fourth area may overlap with each other, an opening may be formed in at least a part of the second area and at least a part of the fourth area, and at least a part of the antenna element may be exposed through the opening.

According to various embodiments of the disclosure, each of the first conductive cells and the second conductive cells may be formed into a meandering pattern.

According to various embodiments of the disclosure, the third area may substantially correspond to the first area, and the fourth area may substantially correspond to the second area.

According to various embodiments of the disclosure, a coupling pad (for example, the connection members 831*e* and 831*f* in FIGS. 28 and 31) may further be included to electrically couple between adjacent conductive cells on one layer or two adjacent layers.

According to various embodiments of the disclosure, the second layer may include at least one power feeding line (for example, the power feeding line 523 in FIG. 8A) coupled to the antenna element.

According to various embodiments of the disclosure, the power feeding line may be selectively coupled to a first power feeding point (for example, the first power feeding point 1023*a* in FIG. 35) configured to generate polarization in a first direction in the antenna element and a second power feeding point (for example, the second power feeding point 1023*b* in FIG. 35) configured to generate polarization in a second direction different from the first direction in the antenna element.

According to various embodiments of the disclosure, at least one of the first periodic structure of the first conductive cells or the second periodic structure of the second conductive cells may be tilted with respect to the rear plate or the side member.

According to various embodiments of the disclosure, the antenna device may further include at least one wall (for example, the wall 1024 in FIG. 37) at an edge of the antenna device.

According to various embodiments of the disclosure, the antenna device may further include a layer (for example, the sixth layer 1160 in FIG. 46) formed separately from the second layer in a stacked structure with the second layer (for example, the second layer 1120 in FIG. 46), and including at least one antenna element and a dielectric disposed adjacent to the at least one antenna element to form a dual-band dual-polarization antenna radiation structure.

According to various embodiments of the disclosure, an electronic device (for example, the electronic device 101 in FIG. 1) may include an antenna device (for example, the antenna device 500 in FIG. 8A) including: a first layer (for example, the first layer 510 in FIG. 8A) including a ground, a second layer (for example, the second layer 520 in FIG. 8A) including at least one antenna element (for example, the antenna element 521 in FIG. 8A) and a dielectric disposed adjacent to the at least one antenna element, a third layer including a first area (for example, the first area 532 in FIG. 8A) in which a first periodic structure including a plurality of first conductive cells (for example, the plurality of first conductive cells 531 in FIG. 8A) is disposed and a second area (for example, the second area 533 in FIG. 8A) at least partially surrounded by the first area, and a fourth layer (for example, the fourth layer 540 in FIG. 8A) including a third area (for example, the third area 542 in FIG. 8A) in which a second periodic structure including a plurality of second conductive cells (for example, the plurality of second conductive cells 541 in FIG. 8A) is disposed and a fourth area (for example, the fourth area 543 in FIG. 8A) at least partially surrounded by the third area, and a wireless communication circuit electrically coupled to the antenna device. When viewed from above the antenna device, at least a part of the first periodic structure may overlap with at least a part of the second periodic structure.

According to various embodiments of the disclosure, the first layer, the second layer, the third layer, and the fourth layer may be stacked.

According to various embodiments of the disclosure, the wireless communication circuit may be configured to transmit and/or receive a signal in a frequency between 3 GHz and 100 GHz.

According to various embodiments of the disclosure, an electronic device (for example, the electronic device 101 in FIG. 1) may include an antenna device (for example, the antenna device 1100 in FIG. 46) which includes: a first layer (for example, the first layer 1110 in FIG. 46) including a ground, a second layer (for example, the second layer 1120 in FIG. 46) including a first antenna element (for example, the first antenna element 1121 in FIG. 46) and a dielectric (for example, the dielectric 1122 in FIG. 46) disposed adjacent to at least a part of the first antenna element, a third layer (for example, the third layer 1130 in FIG. 46) in which a first periodic structure including a plurality of first conductive cells (for example, the plurality of first conductive cells 1131 in FIG. 46) is disposed, a fourth layer (for example, the seventh layer 1170 in FIG. 46) in which a second periodic structure including a plurality of second conductive cells (for example, the plurality of second conductive cells 1171 in FIG. 46) is disposed, and a fifth layer (for example, the sixth layer 1160 in FIG. 46) including a second antenna element (for example, the second antenna element 1161 in FIG. 46) and a dielectric disposed (for example, the dielectric 1162 in FIG. 46) adjacent to at least a part of the second antenna element, and a wireless communication circuit electrically coupled to each of the first antenna element and the second antenna element and configured to transmit and/or receive signals in different frequency bands simultaneously or at different time points.

According to various embodiments of the disclosure, two different power feeding lines electrically coupled to the first antenna element and the second antenna element, respectively may be included. The two different power feeding lines may be configured to transmit and/or receive signals polarized in different directions in the first antenna element and the second antenna element.

As is apparent from the foregoing description, according to various embodiments of the disclosure, an electronic device including an antenna array which may increase a bandwidth, a gain, and a radiation angle and decrease coupling between antennas may be provided.

According to various embodiments of the disclosure, as a periodic structure optimized for millimeter wave radiation is provided, the periodic structure may increase antenna performance and may be miniaturized. Thus, the periodic structure may be applied to various sizes of electronic devices.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including a front plate, a rear plate facing away from the front plate, and a side member attached to the front plate or integrally formed with the rear plate, and surrounding a space between the front plate and the rear plate;

an antenna device disposed inside the housing and including a first layer, a second layer, a third layer, and a fourth layer formed in a stacked structure, wherein the first layer includes a ground, the second layer includes at least one antenna element and a dielectric disposed adjacent to the at least one antenna element, the third layer includes a first area in which a first periodic structure including a plurality of first conductive cells is disposed and a second area at least partially surrounded by the first area, and the fourth layer includes a third area in which a second periodic structure including a plurality of second conductive cells is disposed and a fourth area at least partially surrounded by the third area; and a wireless communication circuit electrically coupled to the at least one antenna element, wherein an entire area of the third layer except for the second area, which the first periodic structure including the plurality of first conductive cells may be arranged apart from each other at an equal interval, wherein the at least one antenna element is disposed in an area corresponding to the second area and the fourth area, and wherein each of at least one of the plurality of first conductive cells or the plurality of second conductive cells is formed into a meander-type pattern.

2. The electronic device of claim 1, wherein the wireless communication circuit is configured to at least one of transmit or receive a signal in a frequency between 3 GHz and 100 GHz.

3. The electronic device of claim 1, wherein, when viewed from above the antenna device, at least a part of the first area in which the first periodic structure is disposed overlaps with at least a part of the third area in which the second periodic structure is disposed.

4. The electronic device of claim 1, wherein the first periodic structure of the first conductive cells and the second periodic structure of the plurality of second conductive cells are identical.

5. The electronic device of claim 1, wherein the first periodic structure of the first conductive cells and the second periodic structure of the plurality of second conductive cells are different.

6. The electronic device of claim 1, wherein the antenna device further includes a fifth layer including a fifth area in which a third periodic structure of third conductive cells is disposed and a sixth area at least partially surrounded by the fifth area, and wherein the first layer, the second layer, the third layer, the fourth layer, and the fifth layer form a stacked structure.

7. The electronic device of claim 1, wherein the second area and the fourth area overlap with each other, wherein an opening is formed in at least a part of the second area and at least a part of the fourth area, and wherein when viewed from above the first layer, the opening overlaps with at least a part of the at least one antenna element.

8. The electronic device of claim 1, wherein at least one layer including conductive cells is disposed on the second layer.

9. The electronic device of claim 1, further comprising a connection member configured to electrically couple adjacent conductive cells to each other on one layer or two adjacent layers.

10. The electronic device of claim 1, wherein the second layer includes at least a part of at least one power feeding line coupled to the at least one antenna element.

11. The electronic device of claim 10, wherein the power feeding line is selectively coupled to a first power feeding point configured to generate polarization in a first direction in the at least one antenna element and a second power feeding point configured to generate polarization in a second direction different from the first direction in the at least one antenna element.

12. The electronic device of claim 1, wherein at least one of the first periodic structure of the first conductive cells or the second periodic structure of the plurality of second conductive cells is tilted with respect to at least one of corners of the antenna device.

13. The electronic device of claim 1, wherein the antenna device further includes at least one wall at an edge of the antenna device.

14. The electronic device of claim 1, wherein the antenna device further includes a layer disposed between the first layer and the second layer in a stacked structure with the second layer, and including at least one antenna element and a dielectric disposed adjacent to the at least one antenna element, to form a dual-band dual-polarization antenna radiation structure.

15. An electronic device comprising:

an antenna device including:

a first layer including a ground;

a second layer including at least one antenna element and a dielectric disposed adjacent to the at least one antenna element;

a third layer including a first area in which a first periodic structure including a plurality of first conductive cells is disposed and a second area at least partially surrounded by the first area; and a fourth layer including a third area in which a second periodic structure including a plurality of second conductive cells is disposed and a fourth area at least partially surrounded by the third area; and a wireless communication circuit electrically coupled to the at least one antenna element, wherein, when viewed from above the antenna device, at least a part of the first periodic structure overlaps with at least a part of the second periodic structure, wherein an entire area of the third layer except for the second area, which the first periodic structure including the plurality of first conductive cells may be arranged apart from each other at an equal interval, wherein the at least one antenna element is disposed in an area corresponding to the second area and the fourth area, and wherein each of at least one of the plurality of first conductive cells or the plurality of second conductive cells is formed into a meander-type pattern.

16. The electronic device of claim 15, wherein the first layer, the second layer, the third layer, and the fourth layer are stacked.

17. The electronic device of claim 15, wherein the wireless communication circuit is configured to at least one of transmit or receive a signal in a frequency between 3 GHz and 100 GHz.

18. An electronic device comprising:

an antenna device including:

a first layer including a ground;

a second layer including a first antenna element and a dielectric disposed adjacent to at least a part of the first antenna element;

a third layer including a first area in which a first periodic structure including a plurality of first conductive cells is disposed and a second area at least partially surrounded by the first area;

a fourth layer including a third area in which a second periodic structure including a plurality of second conductive cells is disposed and a fourth area at least partially surrounded by the third area; and a fifth layer including a second antenna element and a dielectric disposed adjacent to at least a part of the second antenna element; and a wireless communication circuit electrically coupled to each of the first antenna element and the second antenna element and configured to at least one of transmit or receive signals in different frequency bands simultaneously or at different time points, wherein an entire area of the third layer except for the second area, which the first periodic structure including the plurality of first conductive cells may be arranged apart from each other at an equal interval, wherein the first antenna element and the second antenna element are disposed in an area corresponding to the second area and the fourth area, and wherein each of at least one of the plurality of first conductive cells or the plurality of second conductive cells is formed into a meander-type pattern.

19. The electronic device of claim 18, further comprising:

two different power feeding lines electrically coupled to the first antenna element and the second antenna element, respectively, wherein the two different power feeding lines are configured to at least one of transmit or receive signals polarized in different directions in the first antenna element and the second antenna element.

* * * * *